US006171742B1

(12) United States Patent
Kawada et al.

(10) Patent No.: US 6,171,742 B1
(45) Date of Patent: Jan. 9, 2001

(54) PHOTOSENSITIVE MEMBER TO BE USED FOR IMAGE-FORMING APPARATUS AND IMAGE-FORMING APPARATUS COMPRISING SUCH PHOTOSENSITIVE MEMBER

(75) Inventors: Masaya Kawada, Nara; Takaaki Kaya, Mishima; Tetsuya Karaki, Shizuoka-ken, all of (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/301,128

(22) Filed: Apr. 28, 1999

(30) Foreign Application Priority Data

Apr. 30, 1998 (JP) ..... 10-121170

(51) Int. Cl.[7] ..... G03G 5/14
(52) U.S. Cl. ..... 430/67; 430/66
(58) Field of Search ..... 430/66, 67

(56) References Cited

U.S. PATENT DOCUMENTS

| | | | | |
|---|---|---|---|---|
| 4,748,474 | | 5/1988 | Kurematsu et al. | 355/15 |
| 4,968,578 | | 11/1990 | Light et al. | 430/126 |
| 5,045,424 | | 9/1991 | Rimai et al. | 430/126 |
| 5,561,021 | | 10/1996 | Yamazaki et al. | 430/130 |
| 5,797,072 | | 8/1998 | Ehaira et al. | 399/174 |
| 5,840,455 | * | 11/1998 | Ikuno et al. | 430/66 |
| 5,849,445 | * | 12/1998 | Visser et al. | 430/67 |
| 5,910,386 | * | 6/1999 | Yoshinaga et al. | 430/66 |
| 5,976,745 | * | 11/1999 | Aoki et al. | 430/66 |

FOREIGN PATENT DOCUMENTS

| | | |
|---|---|---|
| 0606004 | 7/1994 | (EP) . |
| 60-022131 | 2/1985 | (JP) . |
| 60-022132 | 2/1985 | (JP) . |
| 60-168156 | 8/1985 | (JP) . |
| 60-178457 | 9/1985 | (JP) . |
| 60-225854 | 11/1985 | (JP) . |
| 61-034578 | 2/1986 | (JP) . |
| 61-100780 | 5/1986 | (JP) . |
| 61-231561 | 10/1986 | (JP) . |
| 1-269945 | 10/1989 | (JP) . |
| 9-068822 | 3/1997 | (JP) . |

OTHER PUBLICATIONS

Database WPI, WK8641, Derwent Publ. AN 86–269 702 for JP 61–198159 on Sep. 2, 1986.

* cited by examiner

*Primary Examiner*—John Goodrow
(74) *Attorney, Agent, or Firm*—Fitzpatrick, Cella, Harper & Scinto

(57) ABSTRACT

A photosensitive member to be used for an image-forming apparatus effectively suppresses the effect of wetting the foreign matters adhered to the surface thereof, reduces the load of the cleaning unit and prolong the service life of the photosensitive member so that the image-forming apparatus may be down-sized. In the photosensitive member, the surface free energy ($\gamma$) on the uppermost surface of the photosensitive member is made between 35 and 65 mN/m and the variation of the surface free energy $\Delta\gamma$ is made less than 25 mN/m during long operation.

26 Claims, 25 Drawing Sheets

CORRELATION BETWEEN SURFACE FREE ENERGY γ AND IMAGE QUALITY (CLEANING FEASIBILITY)

CORRELATION BETWEEN SURFACE FREE ENERGY γ AND STABILITY OF CLEANING FEASIBILITY

PHOTOSENSITIVE MEMBER TO BE USED FOR IMAGE-FORMING APPARATUS AND IMAGE-FORMING APPARATUS COMPRISING SUCH PHOTOSENSITIVE MEMBER

BACKGROUND OF THE INVENTION

1. Field of the Invention

This invention relates to a photosensitive member to be used for an image-forming apparatus and also to an image-forming apparatus comprising such a photosensitive member. More particularly, it relates to a photosensitive member to be used for an image-forming apparatus adapted to electrostatically charge the surface of its photosensitive member operating as image carrier, writing image information on the electrostatically charged surface by means of a beam of visible light or a linear-scanning laser beam, forming a toner image and transferring the image onto a transfer medium to produce an image thereon and comprising a cleaning means for cleaning the surface of the photosensitive member. It also relates to a such an image-forming apparatus.

More specifically, the present invention relates to a photosensitive member to be used for an image-forming apparatus adapted to define the surface characteristics including the amount of surface free energy ($\gamma$) and control the foreign matters adhering to the surface so as to make it apt to form images with a good image quality for a prolonged period of time regardless of fluctuations of environmental factors including moisture and temperature. It also relates to an image-forming apparatus comprising such a photosensitive member.

2. Related Background Art

Currently available image-forming apparatus, electrophotographic apparatus in particular, include printers operating as output means of computers and word processors that have been finding an ever-increasing demand in recent years as well as copying machines. Since such apparatus are operated in a variety of operating environments, they are often provided with a means for stabilizing the output image such as a means for eliminating the influence of fluctuations of environmental factors on the density of the output image. In addition, such printers are required to be low cost and maintenance free particularly because they are used not only for office applications but also for home or personal applications.

Still additionally, such printers are required to be friendly to the environment from the ecological point of view and hence should be adapted to print on the both sides of paper and on recycled paper, and reduce the consumption rate of paper and electric power.

FIG. 1 is a schematic illustration of an image-forming apparatus, illustrating the image-forming process of a copying machine.

Referring to FIG. 1, reference numeral 101 denotes a photosensitive member of the image-forming apparatus, which can rotate toward X-direction as indicated, to be used with an electrophotographic system (hereinafter simply referred to as "photosensitive member"), which is surrounded by a principal charging unit 102, an electrostatic latent image forming site 103, a developing unit 104, a transfer paper feeding system 105, a transfer charging unit 106(*a*), a separation charging unit 106(*b*), a cleaner unit 107, a delivery system 108 and a conditioning light source 109 arranged clockwise in FIG. 1. If necessary, the photosensitive member 101 may be provided with a circumferential internal surface heater 125 for controlling the temperature of the photosensitive member 101.

The surface of the photosensitive member 101 is uniformly and electrostatically charged and, in operation, exposed to light at the electrostatic latent image forming site 103 to form an electrostatic latent image thereon.

The electrostatic latent image is then turned into a visible toner image by the developing sleeve of the developing unit 104 that carries toner on the surface.

Meanwhile, transfer medium P is fed from the transfer paper feeding system 105 as it is guided by a transfer paper guide 119 and its leading edge is registered by register rollers so that the toner image formed on the surface of the photosensitive member 101 is transferred onto the transfer medium P by means of the transfer charging unit 106(*a*). Then, the transfer medium P is separated from the photosensitive member 101 by means of the separation charging unit 106(*b*) and/or a separation means such as a separation pawl (not shown) and subsequently the toner image on the surface of the paper is moved to a fixing unit 123 by means of the delivery system 108, where the toner image is fixed by fixing rollers 124 arranged in the fixing unit 123 before it is delivered to the outside of the image-forming apparatus.

On the other hand, after the toner image is transferred to the transfer medium P, the surface of the photosensitive member 101 is cleaned by a cleaning blade 120 and a cleaning roller (or brush) 121 arranged in the cleaning unit to remove the residual toner and the fine particles of paper adhering to the surface in order to make it ready for the next image forming operation.

As described above, an image-forming apparatus adapted to repeat the operation of forming an image by transferring a toner image on the surface of a photosensitive member onto a transfer medium such as paper needs to be provided with a cleaning means for removing the foreign matters remaining on the surface of the photosensitive member including the residual toner.

Such a cleaning unit 107 typically comprises a cleaning blade made of resin such as rubber and a cleaning brush made of resin fiber. The powdery magnetic objects remaining on the surface of the photosensitive member such as the residual toner may alternative be removed by means of magnetic adsorption.

Now, such a cleaning unit and cleaning means that can be used for the unit will be described below by referring to FIG. 2.

FIG. 2 is a schematic view of a cleaning unit that can be used for the image-forming apparatus of FIG. 1.

Cleaning means that can be used for the cleaning unit 301 of FIG. 2 may comprise a cleaning blade 302 made of urethane rubber, a cleaning roller 303 made of silicon rubber, sponge or a magnetic material, a doctor roller 304, a waste toner pool 305 and a waste toner delivery system 306.

The doctor roller 304 may be arranged whenever necessary and may show a blade-like shape. Then, it will be referred to as scraper (or doctor blade).

For the purpose of simplification, the scraper will be omitted from the following description of the components of the cleaning unit.

Referring to FIG. 2, reference numeral 301 denotes a cleaning unit comprising a cleaning blade 302 made of a material obtained by mixing urethane rubber and one or more than one silicon compounds to have appropriate elasticity and hardness.

A cleaning roller 303 made of a magnet is arranged at an upstream position (lower position in FIG. 2) relative to the cleaning blade 302 in the sense of rotation of the photosensitive member. The cleaning roller 303 attracts powdery magnetic materials including the toner by its magnetic force and hence comes to be coated with the adherers. Thus, the coat of the powdery magnetic materials abuts the surface of the photosensitive member with an appropriate abutting width (referred to as "nip width") and is made to scrub the surface of the photosensitive member at a predetermined relative speed.

While the cleaning roller 303 is made of a magnet in the above description, it may alternatively be a roller that is magnetically biased with the polarity opposite to that of the toner or made of silicon rubber of spongy resin.

Still alternatively, the cleaning roller 303 may be replaced by a brush-shaped member made of a material selected appropriately by taking the hardness of the photosensitive member and the processing speed of the image-forming apparatus into account.

When the brush is used with a photosensitive member showing a high surface hardness such as an a-Si type photosensitive member, it may be a chemical fiber brush made of polyethylene or polystyrene or a brush made of electroconductive fiber obtained by adding carbon to chemical fiber in order to provide the fiber with an desired level of electroconductivity or fiber of amorphous metal (e.g. "Bolfa": tradename, available from Unitika).

The nip width of the photosensitive member 101 and the cleaning roller or the cleaning brush is desirably held to a constant value in order to achieve a constant cleaning performance and prevent any problem such as an abraded photosensitive member due to excessive local abutment.

The mechanism for holding the cleaning roller or the cleaning brush in abutment with the photosensitive member 101 may be achieved by using small rollers held in abutment with the photosensitive member in an area other than the image-forming site or by pushing the roller against the photosensitive member under a predetermined level of pressure. In the case of a cleaning roller made of a magnetic material, a constant nip width can be achieved by regulating the thickness of the toner coat.

The cleaning unit may also be realized by removing part of the above components or using one or than one additional components.

FIGS. 3A through 3D illustrate how a cleaning operation is repeated for an image-forming apparatus of the type under consideration.

Now, the cleaning operation will be described by referring to FIGS. 3A through 3D. Note that the photosensitive member 101 is indicated by a straight line (with no radius of curvature) for the purpose of simplicity.

[Step 1]

The photosensitive member 101 with which the cleaning unit 301 is held in abutment is driven to rotate at a predetermined rate of revolution. In FIG. 3A, the surface of the photosensitive member 101 moves from left to right to come closer to the cleaning blade 302.

On the surface of the photosensitive member 101 a toner image is formed by said steps of electrostatically charging the surface, forming a latent image thereon and developing the latent image.

The adherers 3001 including the toner that has not been transferred to the transfer medium and pieces of resin and talc are also brought closer to the cleaning unit as they are forced to adhere to the surface of the photosensitive member by electrostatic force, inter-molecular force, frictional force and other forces that makes them adherent.

If necessary, the photosensitive member is held at a predetermined temperature.

As described above, the cleaning unit may not comprise a cleaning roller 303 (or a cleaning brush, which will not specifically be mentioned hereinafter).

When the cleaning blade 302 is used at the site of abutment with the surface of photosensitive member, powder may often be applied to it to provide a lubricating effect. In the step of FIG. 3A, part of the collected waste toner or the toner supplied to the cleaning roller by an appropriate means is appropriately supplied for use from the cleaning roller 303 by way of the toner pool 307.

[Step 2]

If the cleaning unit comprises a cleaning roller 303, the above described adherers 3001 including the residual toner are scrubbed and scraped or sucked by the cleaning roller 303 for collection. The adherers 3001 are then taken up into the cleaning roller 303 (FIG. 3B).

[Step 3]

The adherers 3001 that include the residual toner and are taken up by the cleaning roller 303 are then partly collected by an appropriate mechanism such as a doctor roller (or a doctor blade, which will not specifically be mentioned hereinafter). The collected adherers 3001 including the residual toner are then fed to the toner pool 305 within the cleaning unit 301 (FIG. 3C).

As described above, the residual toner may be discharged from the cleaning roller 303 at an appropriate rate from the viewpoint of lubricating effect of the cleaning blade 302 on the photosensitive member.

The collected toner is then moved into a waste toner container (not shown) by way of the waste toner delivery system 306.

Alternatively, the collected toner may be screened and the screened toner may be partly or mostly reused.

[Step 4]

The adherers 3001 including the residual toner not collected by the cleaning roller 303, the residual toner that has not discharged from the cleaning roller of a cleaning unit not comprising a cleaning blade 303 or the residual toner left after the discharge of toner from the cleaning roller are brought closer to the cleaning blade 302 as they remain adhering to the surface of the photosensitive member 101. Then, the residual toner and other adherers are then scraped off typically by the cleaning blade 302 of the cleaning unit 301 and collected.

The collected toner is then moved to a waste toner storage container (not shown) by way of the waste toner delivery system 306 typically comprising a screw and delivered further away (FIG. 3D).

The waste toner storage container may be arranged at a position (not shown) within the image-forming apparatus or, alternatively, incorporated in the cleaning unit when the image-forming apparatus is a cartridge type laser beam printer (LBP).

The electrostatic latent image that is left on the surface of the photosensitive member is erased by a conditioning light source 109.

As described above, the cleaning roller 303 may be replaced by a cleaning brush that is held in abutment with the surface of the photosensitive member to scrape off various adherers.

There has been proposed the use of a magnetic cleaning roller made of a magnetic material, a cleaning roller magnetically biased with the polarity opposite to that of the toner or a cleaning roller having the properties opposite to those of the toner, which is made to collect the residual toner on the surface of the photosensitive member in a non-contact way or as it is brought to contact directly with the surface of the photosensitive member or indirectly therewith by way of the toner already sucked by and deposited onto the surface thereof.

Such devices (cleaning blade, cleaning brush, cleaning roller, etc.) are selectively arranged within the cleaning unit and used independently or in combination so as to effectively remove foreign matters and powder of the toner from the surface of the photosensitive member.

As pointed out earlier, an increasing number of image-forming apparatus are being used under various different operating conditions including a well air-conditioned environment and extending between a low temperature/light moisture setting and a high temperature/heavy moisture setting.

In view of the use in a particularly harsh environment, there is a strong demand for image-forming apparatus that operate electrophotographically stably without giving rise to problems such as a poor cleaning performance and the adhesion of molten toner so as to make them meet the requirement of maintenance free and a long service life.

Thus, image-forming apparatus using an electrophotography system are required to stably provide clear and high quality images for a prolonged period of time regardless of environmental fluctuations as they find more and more personal applications with diversified operating environment. Additionally, they have to meet the requirement of down-sizing and cost reduction.

In order for an image-forming apparatus to provide clear and high quality images for a prolonged period of time, then it is necessary to precisely control the latent image and uniformly clean the surface of the photosensitive member. Additionally, the cleaning unit of the image-forming apparatus has to be down-sized and comprise a reduced number of components that are simply configured.

However, as the cleaning system is simplified and made to show a long service life, there arises a problem that the residual toner is, if partly, not removed by the cleaning blade 302 and other members and remains on the surface of the photosensitive member.

The remaining adherers will then be subjected to the steps from the electrostatically charging step on for more than once.

Additionally, the adherers remaining on the surface of the photosensitive member can be spread over a wider area of and/or laid higher from the surface of the photosensitive member as they are scraped by the cleaning blade 302 and the cleaning brush or the cleaning roller 303 and also by the transfer material (not shown) and/or the heat existing on the surface.

Furthermore, as the above steps are repeated, additional foreign matters may adhere to the surface to increase the area and the height of the adherers.

Thus, the adherers that are not removed from the surface of the photosensitive member by the cleaning unit gradually grow until they eventually become visually recognizable black spots on the images produced by the apparatus.

Particularly, if the image-forming apparatus is used after a long pause, the toner and the debris of paper collected in the cleaning unit (hereinafter referred to collectively as the collected toner) are often found to have agglomerated within the unit.

If the collected toner is not found to have agglomerated when the apparatus is used after a long pause, the residual toner located near the contact point or line of the surface of the photosensitive member and the cleaning unit and the collected toner can often become agglomerated as the temperature rises near the photosensitive member of the apparatus to consequently raise the temperature of the toner.

Particularly, in an image-forming apparatus provided with a heater for regulating the surface temperature of the photosensitive member, the toner found on the surface of the photosensitive member and the cleaning unit can become agglomerated to give rise to a phenomenon referred to as blocking phenomenon that damages the cleaning means of the cleaning unit including the cleaning blade and the cleaning roller in the initial stages of the image-forming operation conducted after a long pause.

Additionally, as the adhering toner grows, there arise a number of problems to the cleaning unit such as damaged cleaning members including a chipped or burred cleaning blade and a cleaning roller having one or more than one grooves formed on the surface, a vibrating cleaning blade and an uneven nip width extending between the cleaning roller and the photosensitive member and along the axis of the photosensitive member. Such problems can give rise to an abnormally cleaned condition on the part of the surface of the photosensitive member.

Then, the surface of the photosensitive member shows "poor cleaning", which is far from a satisfactorily cleaned state.

The poor cleaning by turn can give rise to disadvantageous phenomena such as "black streaks" of toner produced by a chipped cleaning blade, "filming" that makes the entire surface of the photosensitive member thinly coated with toner and "fusion" in which black spots appear on the image due to the adhesion of the toner.

Additionally, both the thickness of the coated toner on the surface of the cleaning roller and the pressure of the cleaning roller applied to the photosensitive member can show local unevenness to make the surface of the photosensitive member become scraped unevenly.

Then, incident light applied to the photosensitive member can be refracted unevenly to give rise to interference, which by turn produce local variations in the effective quantity of light entering the photoconductive layer of the photosensitive member and hence an uneven image density.

These and other phenomena degrade the quality of image and require frequent servicing and even replacement of parts for the apparatus so that the image-forming apparatus as a whole becomes far from maintenance free.

Various techniques have been proposed and are currently used in order to eliminate such problems by completely removing the foreign matters adhered to the surface of the photosensitive member. Known techniques include the following:

(1) a technique of controlling the pressure (abutment pressure) of the cleaning member such as the cleaning blade, the cleaning brush or the cleaning roller which is abut the photosensitive member;

(2) a technique of selecting an optimal relative speed of the cleaning member and the photosensitive member and using an optimal material for the cleaning member to improve the effect of scraping the adherers;

(3) a technique of modifying the surface profile of the cleaning roller typically by forming a helical groove on the surface; and (4) a technique of controlling the cleaning operation by means of a magnetic material or a bias.

A phenomenon of "(high humidity) smeared image" that occurs when the image-forming apparatus is repeatedly used in a high humidity/high temperature environment and gives a faint image can get to be definitely apparent as the surface of the photosensitive member becomes apt to adsorb moisture under the influence of corona products attributable to ozone that is produced from the charging unit. Then, the phenomenon by turn gives rise to a lateral flow out of the electrostatic charge and a smeared image.

In the case of an a-Si type photosensitive member, Japanese Utility Model Publication No. 1-34205 describes an anti-smeared image measure using a heater to vaporize the moisture that has been adsorbed in the surface of the photosensitive member. Similarly, Japanese Patent Publication No. 2-38956 describes a method of removing corona products from the surface of the photosensitive member by brushing the surface by means of a brush formed from a magnetic roller and a magnetic toner. Japanese Patent Application Laid-Open No. 61-100780 describes a method of removing corona products by scrubbing the surface of the photosensitive member by means of an elastic roller.

On the other hand, a cleaning roller or a cleaning brush as described above may also be used to scrub the surface of the photosensitive member.

A technique of scrubbing the surface of the photosensitive member is particularly feasible when the surface is very hard as in the case of an a-Si type photosensitive member.

In the case of a relatively soft photosensitive member such as an organic photosensitive member (OPC), there have been proposed a technique of designing an electrophotographic apparatus on the assumption that the photosensitive member is scrubbed and polished and a technique of providing the photosensitive member with a measure for making it to become polished evenly to show a prolonged service life.

However, most of the proposed techniques for improving the effect of removing foreign matters consist in increasing the extent of abutment or intrusion (=deformation) of the cleaning member or the relative speed of the cleaning brush or the cleaning roller and the photosensitive member to increase the frictional force.

Then, as a result, the surface of the photosensitive member becomes abraded to baffle the attempt of prolonging the service life thereaof. Additionally, the cleaning blade can become chipped and the cleaning roller comes to show scars as the photosensitive member and the cleaning unit are subjected to such a heavy load. All in all, such measures come to apply an increased load onto the image-forming apparatus comprising the photosensitive member and the cleaning unit.

If such a chipped or scarred profile is not apparent, the affected member may show a change of profile that adversely affects the cleaning performance of the cleaning unit.

On the other hand, while a technique of controlling the cleaning operation by means of a magnetic material or a bias can improve the cleaning feasibility without increasing friction, some of the substances remaining on the surface of the photosensitive member may not be affected by Coulomb's force caused by magnetic force or electrostatic force if such substances are non-magnetic.

Additionally, such a technique requires the use of a permanent magnet or an electromagnetic that is accompanied by a power source to baffle the attempt of reducing the size and cost of the apparatus.

Thus, it is vital to clear the above problems in order to achieve a down-sized maintenance-free electrophotographic apparatus at low cost that can maintain its cleaning feasibility in a stable manner for a prolonged period of time.

While such an apparatus should have an improved configuration, it may be indispensably necessary to improve the controllability of the effect of cleaning the surface of the photosensitive member in order to realize such an apparatus.

In other words, in order to improve thus quality of the image produced by such an apparatus, the effect of cleaning the surface of the photosensitive member has to be rigorously controlled by controlling the adhesion of foreign matters and toner to the surface of the photosensitive member by means of a cleaning unit.

Japanese Patent Applications Laid-Open Nos. 60-22131, 60-22132 and 1-269945 and Japanese Patent Publication No. 4-62579 disclose techniques of defining the condition of the uppermost surface of a photosensitive member by way of the angle of contact with pure water, although none of these patent documents satisfactorily describes the contact of toner and foreign matters and the effect of wetting foreign matters such as toner nor their correlation with the cleaning feasibility.

It is highly desirably that the cleaning feasiblity can be measured in a simple manner and the results obtained by the measurement are used to define an optimal combination of the photosensitive member and toner in order to make the electrophotographic apparatus stably produce high quality images.

Such an arrangement will be particularly effective and beneficial to small electrophotographic apparatus that are to be popularly used such as laser printers, small copying machines and facsimile machines.

SUMMARY OF THE INVENTION

In view of the above identified problems it is therefore an object of the present invention to provide a photosensitive member to be used for an image-forming apparatus that shows an improved cleaning feasibility of the surface of the photosensitive member so as to prolong the service life of the photosensitive member as well as an image-forming apparatus comprising such a photosensitive member.

Another object of the invention is to provide a photosensitive member to be used for an image-forming apparatus that is down-sized particularly in terms of its cleaning unit including a cleaning blade so as to reduce the load of the cleaning unit and prolong the servicing cycle period as well as an image-forming apparatus comprising such a photosensitive member.

Still another object of the present invention is to provide a photosensitive member to be used for an image-forming apparatus that comprises a down-sized energy-saving drive motor so as to eliminate the use of an annexed device of drum heater in order to make the entire apparatus small and lightweight and hence consume less power as well as an image-forming apparatus comprising such a photosensitive member.

A further object of the invention is to provide a photosensitive member to be used for an image-forming apparatus that is adapted to be housed in a cartridge as well as an image-forming apparatus comprising such a photosensitive member.

According to the invention, there is provided a photosensitive member to be used for an image-forming apparatus that is adapted to repeatedly form an image by following an image-forming process comprising steps of forming a latent image by electrostatically charging the photosensitive member and exposing it to light, forming a toner image, transferring the toner image onto transfer medium and cleaning the surface of the photosensitive member, the surface free energy (γ) on the uppermost surface of the photosensitive member being between 35 and 65 mN/m.

The surface free energy (γ) of an photosensitive member can be derived from the Forkes's extension theory, and γ represents the wettability of the surface of the photosensitive member relative to foreign matters such as toner adhered to the surface of the photosensitive member. The work load for removing foreign matters such as toner during the cleaning step can be reduced by appropriately controlling the value of γ.

Preferably, in a photosensitive member to be used for an image-forming apparatus according to the invention, the variation (Δγ) of the surface free energy (γ) in use is less than 25 mN/m.

By defining and controlling the variation (Δγ) in the wettability of the surface of the photosensitive member relative to foreign matters adhered to the surface, it is possible to maintain the load necessary for cleaning the surface of the photosensitive member by separating it from foreign matters such as toner to a constant level.

Additionally, the performance of the cleaning unit and that of the photosensitive member can be maintained for a prolonged period of time by reducing the cleaning load.

Consequently, it is possible to maintain the accuracy and reliability of the latent and visible image forming steps and other image-forming steps for a long time so that the apparatus can stably provide high quality images.

DESCRIPTION OF THE PREFERRED EMBODIMENTS

Now, the present invention will be described in greater detail by referring, whenever necessary, to the accompanying drawings.

While image-forming apparatus comprising an a-Si type photosensitive member may be provided with a heater for heating the photosensitive member, the heater is preferably a small capacity heater or completely eliminated from the energy saving point of view.

The latitude of the photosensitive member relative to fused toner will be broadened as the surface temperature of the photosensitive member falls.

It may be needless to say that the operating characteristics of the photosensitive member including the bearability of electrostatic charge do not change with a temperature fall if a small capacity heater is used or no heater is used.

An a-Si type photosensitive member to be used for the purpose of the invention preferably shows improved operating characteristics. Such an a-Si type photosensitive member preferably comprises a photoconductive layer containing hydrogen by 10 to 30 atomic % that shows a characteristic energy level of 50 to 60 meV at the exponential Urbach's tail of the photoabsorption spectrum and a localized state density of $1\times10^{14}$ to $1\times10^{16}$ $cm^{-3}$.

The advantages of the present invention will be enhanced by using an a-Si type photosensitive member having an improved temperature characteristic in terms of change of the electric charge bearability, with temperature as combined with the above effect.

Figure 1:
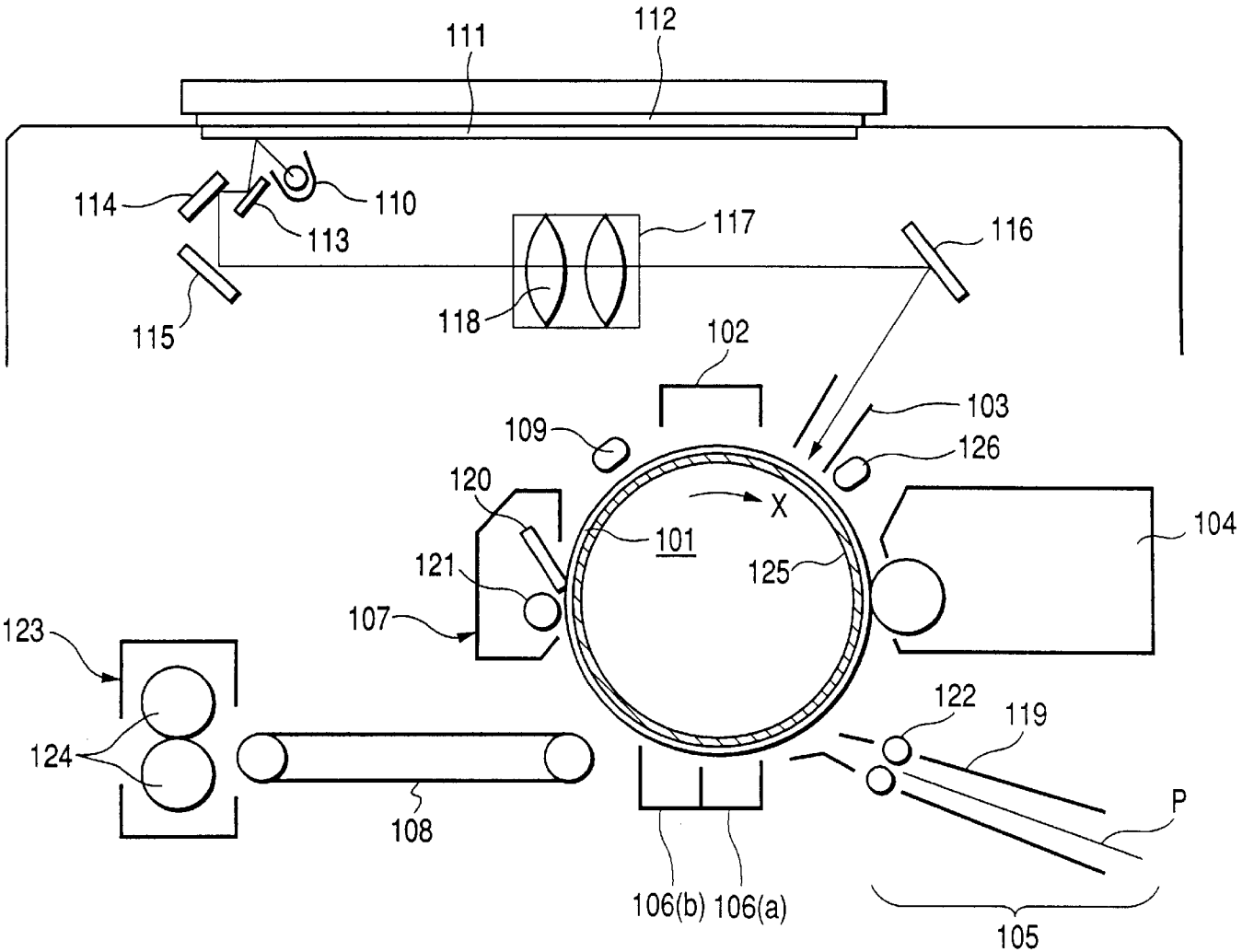
FIG. 1 is a schematic view of an image-forming apparatus using an electrophotography system, illustrating its configuration.

Now, the overall process of electrophotography and the cleaning unit used in the process will De described by referring to FIG. 1 that illustrates a schematic illustration of an image-forming apparatus.

In FIG. 1, the photosensitive member 101 adapted to rotate in the sense of arrow X is surrounded by a principal charging unit 102, an electrostatic latent image forming site 103, a developing unit 104, a transfer paper feeding system 105, a transfer charging unit 106(*a*), a separation charging unit 106(*b*), a cleaner unit 107, a delivery system 108 and a conditioning light source 109. If necessary, the photosensitive member 101 may be provided with a circumferential internal surface heater 125 for controlling the temperature of the photosensitive member 101.

In the image-forming process, the surface of the photosensitive member 101 is uniformly and electrostatically charged by the principal charging unit 102 to which a high voltage of +5 to 10 kV is applied by a voltage applying means (not shown). In operation, light is emitted from a lamp 110 and reflected by an original 112 placed on an original glass mount 111 and further by mirrors 113, 114, 115 before it is focused by a lens 118 in a lens unit 117 and reflected by a mirror 116 to expose the electrostatic latent image forming site of the photosensitive member and form an electrostatic latent image thereon.

As the latent image is fed with negative polarity toner (to be referred to as "negative toner" hereinafter) from the developing unit 104 to which a predetermined ac (alternating current) or ac+dc (direct current) voltage is applied to turn into a toner image.

Meanwhile, transfer meidum P is fed as it is guided by a copy paper guide 119 and its leading edge is regulated by register rollers 122, and the toner image formed on the surface of the photosensitive member 101 is transferred onto the transfer medium P by means of the application of an electric field with the polarity opposite to that of toner generated between the transfer charging unit 106(*a*) to which a high voltage of 7 to 8 kV is applied and the photosensitive member 101 in the rear.

Then, the transfer medium P is separated from the photosensitive member 101 by means of the separation charging unit 106(*b*) on which a high AC voltage of 1.2 to 1.4 kV having a frequency of 300 to 600 HZ is applied and/or a separation means such as a separation pawl (not shown) and moved to a fixing unit 123 by way of a transfer paper delivery system 108, where the toner image is fixed by fixing rollers 124 arranged in the fixing unit 123 before it is delivered to the outside of the image-forming apparatus.

The residual toner on the photosensitive member 101 is scraped off by cleaning blade 120 arranged in the cleaning unit 107. The cleaning unit 107 may additionally comprise a cleaning roller. After the cleaning operation, the electrostatic latent image remaining on the surface of the photosensitive member is erased by a conditioning light source 109.

Note that the image-forming apparatus of FIG. 1 is an analog image-forming apparatus, where the photosensitive member is positively electrified and negatively electrified toner is used.

In the case of a digital image-forming apparatus, light reflected by the original is transformed into a signal. The light to be used may be coherent light such as a laser beam having a predetermined wavelength depending on the photosensitivity and other characteristics of the photosensitive member.

The polarity of the electrostatic charge, the polarity of toner, the process of electrostatic charging and the process of development as well as the process of transfer and the voltages to be used may be altered depending on the circumstances.

[Cleaning Means]

Figure 2:
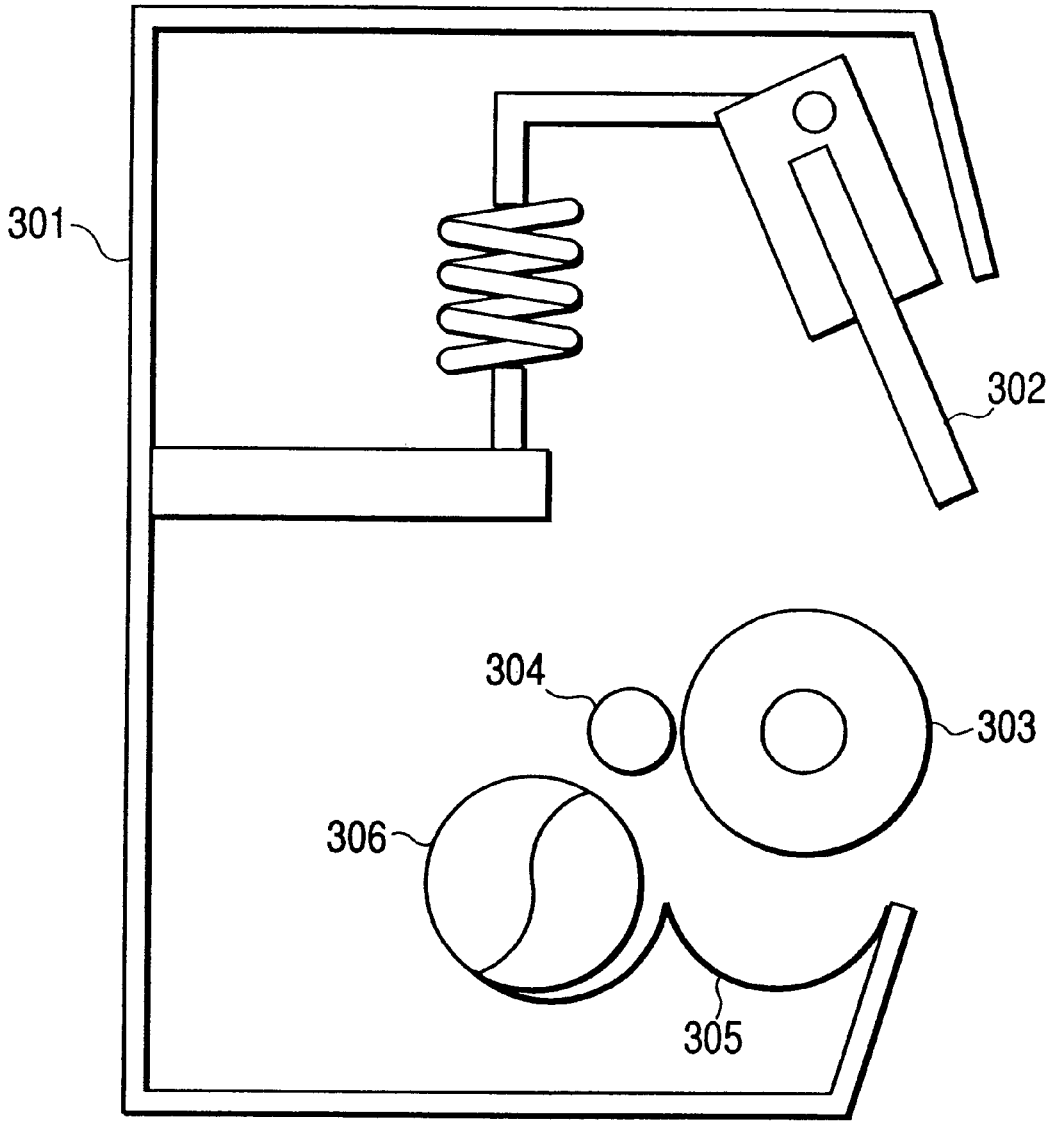
FIG. 2 is a schematic view of a cleaning unit that can be used for an image-forming apparatus, illustrating its configuration.
Figure 3A:
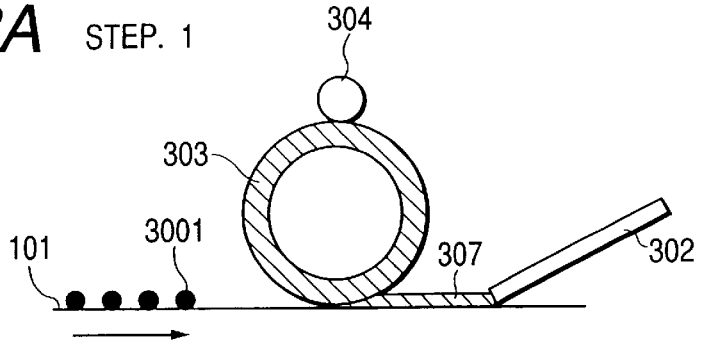
FIGS. 3A, 3B, 3C and 3D are schematic lateral views of a cleaning unit, illustrating a cleaning operation.
Figure 3B:
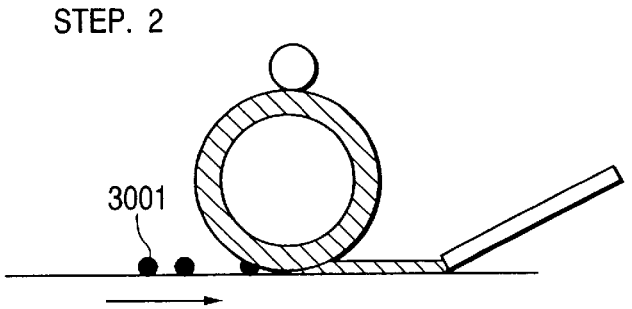
Figure 3C:
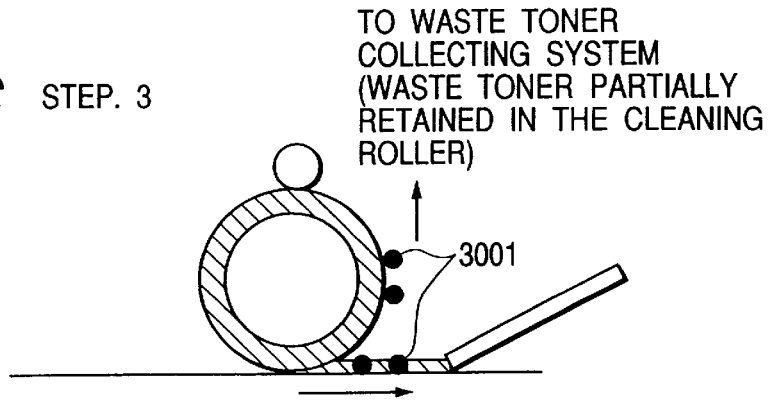
Figure 3D:
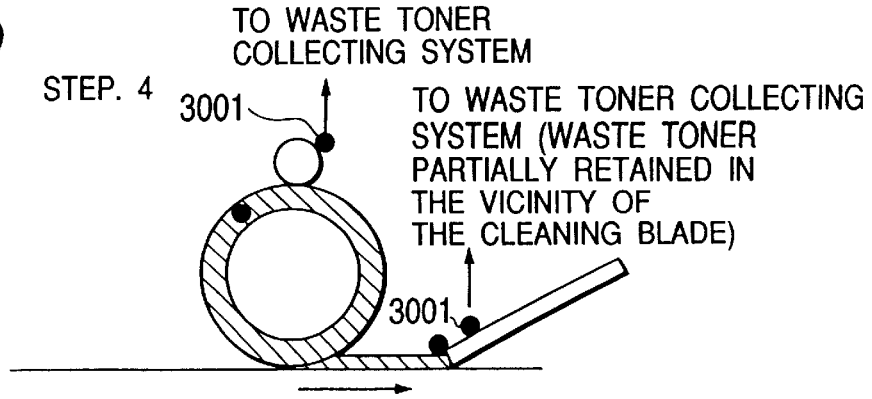

FIG. 2 schematically illustrates a cleaning unit that can be used for the purpose of the invention.

The cleaning unit 107 of FIG. 2 comprises a cleaning blade 302 typically made of urethane rubber, a cleaning roller 303 made of silicon rubber, sponge or a magnetic material, a doctor roller 304, a waste toner pool 305 and a waste toner delivery system 306. The doctor roller (or doctor blade) is arranged if necessary.

Note that the cleaning unit 107 may be replaced by a similar cleaning unit comprising some of the above listed components and/or some other components.

The cleaning blade 302 is arranged so as to uniformly abut the surface of the photosensitive member under appropriate abutment pressure or with an appropriate extent of intrusion. The cleaning blade 302 may be provided, if necessary, with an equalizing or shifting mechanism so as to improve the evenness of abutment between itself of and the surface of the photosensitive member.

Additionally, if necessary, a cleaning roller 303 is arranged in the proximity of the cleaning blade 302. The cleaning roller 303 is made of an elastic material such as silicon rubber, a spongy material or a magnetic material and/or subjected to bias with the polarity opposite to that of toner. The cleaning roller 303 is made to abut the photosensitive member directly or indirectly by way of magnetic powder such as toner made to adhere to the surface of the photosensitive member by magnetic force.

Additionally, a cleaning brush made of resin fiber or metal fiber may be used independently or in combination with a cleaning roller made of resin or a magnetic material.

Then, friction arises as the cleaning means such as the cleaning blade 302 made of urethane rubber within the cleaning unit 301 is moved relative to the surface of the photosensitive member.

The adherers on the surface of the photosensitive member is scrubbed under the effect of the generated frictional force and scraped off. The scraped and collected toner (collected toner) is partly removed from the cleaning roller 303 by the doctor roller (or scraper) 304 and delivered to a waste toner storage container (not shown) by way of the waste toner pool 305 of the cleaning unit and the waste toner deliver system 306.

As pointed out above, a considerable load typically in the form of frictional force is required to scrub and remove the foreign matters on the surface of the photosensitive member.

Figure 4:
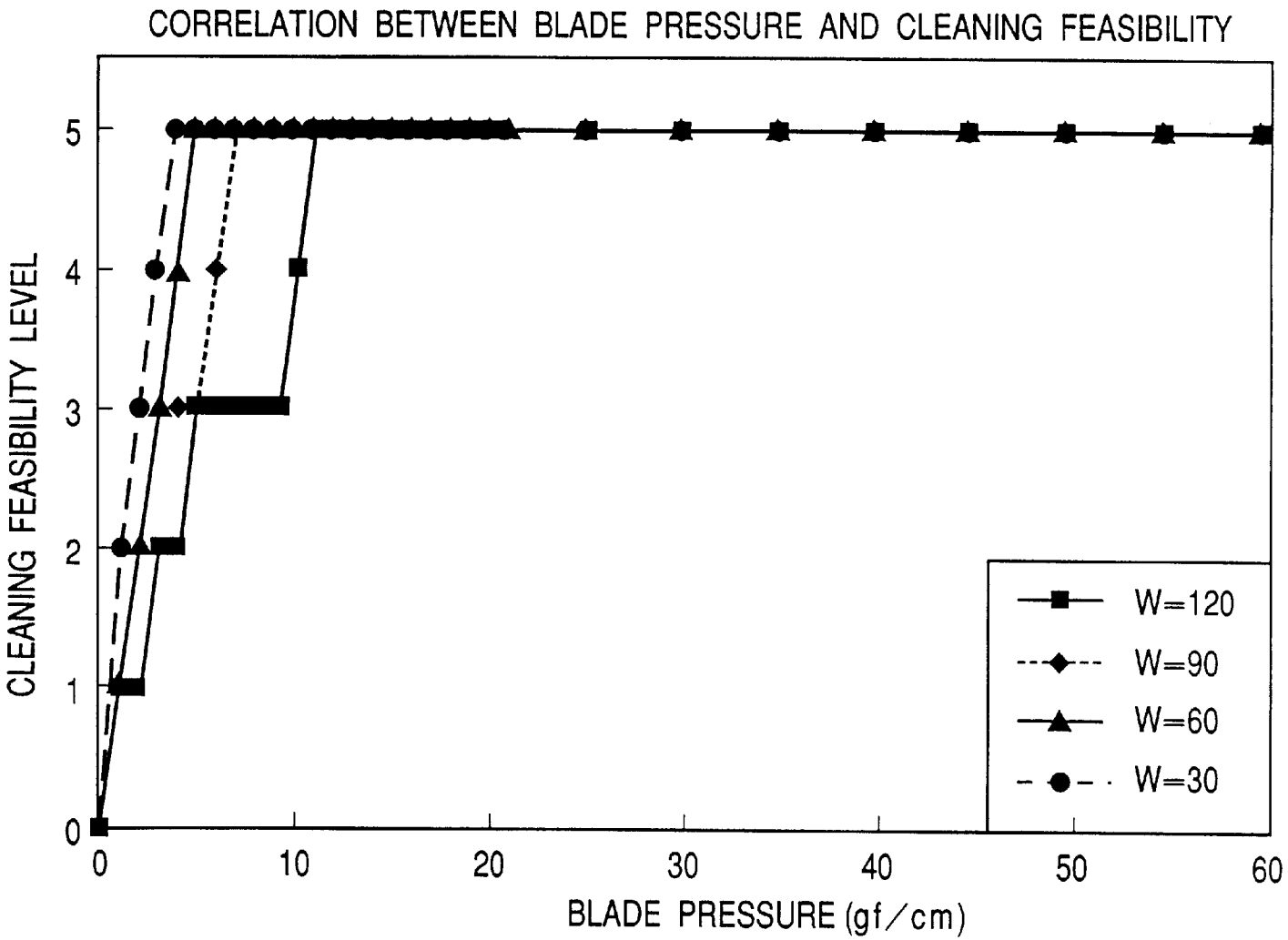
FIG. 4 is a graph illustrating the relationship between the linear pressure of a cleaning blade and the cleaning feasibility thereof.
Figure 5:
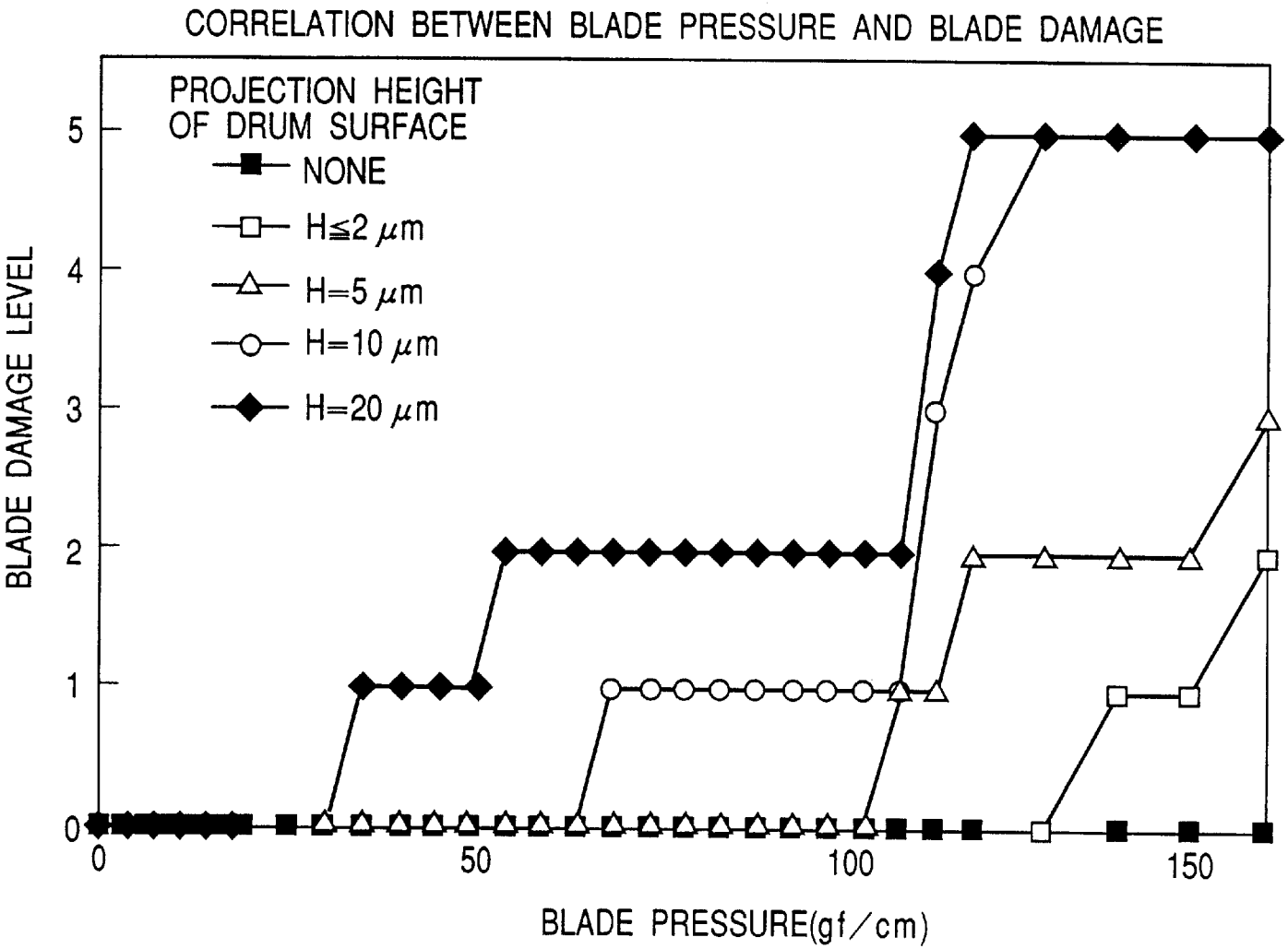
FIG. 5 is a graph illustrating the relationship between the linear pressure of a cleaning blade and the chipped state thereof.

The abutting pressure of the cleaning blade 302, or the pressure of the cleaning blade to be more simple, is preferably between 2 and 100 gf/cm, more preferably between 5 and 50 gf/cm, as seen from FIGS. 4 and 5 illustrating the relationship between the cleaning feasibility and the chipped state of the blade. FIG. 4 shows a graph illustrating the relationship between the linear pressure of a cleaning blade and the cleaning feasibility thereof (which will be described hereinafter in terms of evaluation thereof) when the nip width (W) is varied between 30 and 120 $\mu$m. FIG. 5 is a graph illustrating the relationship between the linear pressure of a cleaning blade and the chipped state thereof (which will be described hereinafter in terms of evaluation thereof) when the height of the projections on the surface of the photosensitive member is varied between 0 and 20 $\mu$m.

Thus, the abutting pressure of the cleaning blade is selected within the above range depending on the material of the photosensitive member, the profile of the surface including projections and the relative speed of the surface of the photosensitive member.

On the other hand, the cleaning roller 303 is driven to rotate at a predetermined speed relative to the surface of the photosensitive member as it is held in direct or indirect abutment with the surface of the photosensitive member.

As described above, the cleaning roller 303 is arranged within the cleaning unit 301 with a doctor roller (or scraper) 304 held in abutment with it.

The cleaning 303 is driven to rotate in such a way that its surface moves at a predetermined speed relative to the surface of the photosensitive member so that its surface is made to scrub the surface of the photosensitive member.

The moving speed of the cleaning roller is expressed as positive (+) when it moves in the sense of movement of the photosensitive member (to be referred to as "forwardly" hereinafter). The moving speed is the relative speed with regard to the photosensitive member.

In order to eliminate uneven cleaning and local streaks, the relative speed is held greater than +100%, between +5% and +100% or between −4% and −80%.

Now, the relative speed will be described and defined.

"+100%" as used herein refers to a state where the cleaning roller is rotating forwardly at a speed same as the moving speed of the surface of the photosensitive member.

"−100%" as used herein refers to a state where the cleaning roller is rotating backwardly, or reversely, at a speed same as the moving speed of the surface of the cleaning roller.

When the cleaning roller is completely at a stand-still, the relative speed is "0%".

When the cleaning roller is made to rotate backwardly relative to the surface of the photosensitive member at the abutting site, it can produce a good cleaning effect with a low rate of revolution if compared with a state where it is made to rotate forwardly.

This is significant when taking the drive motor of the cleaning roller 303 into consideration. However, a satisfactory cleaning effect may be obtained by driving the cleaning roller forwardly at an appropriate relative speed.

Additionally, the cleaning roller may be driven in any direction so long as it can scrub the surface of the photosensitive member.

For example, it may be moved not in the sense of rotation of the photosensitive member (in parallel with the sheet of FIGS. 4 or 5) but in the sense of the axis of revolution of the photosensitive member (perpendicularly relative to the sheet of FIGS. 4 or 5). Moreover, it may be moved in a direction obtained by appropriately combining the above two directions.

In any case, the relative speed should not be substantially equal to 0% and, preferably, it should be found out of the range from −4% to +4%.

Furthermore, the cleaning roller 303 may be provided with a mechanism for regulating the distance between itself and the surface of the photosensitive member or the nip width and the abutting pressure.

On the other hand, a cleaning device utilizing magnetic force or Coulomb's force, the adherers on the surface of the photosensitive member are attracted and removed therefrom by the magnetic force or the Coulomb's force of the unit.

The cleaning device is preferably driven to move at a proper speed, as well as the cleaning roller scrubbing the surface of the photosensitive member, in order to remove the foreign matters on the surface of the photosensitive member including the residual toner with force greater than the force with which they are adhering to the surface.

Thus, the load of the cleaning operation can be reduced when the surface of the photosensitive member has a low wettability.

The adhesiveness of the surface of the photosensitive member can be detected in the form of surface free energy (synonym of surface tension).

[Surface Free Energy]

Now, surface free energy will be described below.

Foreign matters including the residual toner are made to adhere to the surface of the photosensitive member by intermolecular force (van der Waals force) that produces physical bonds.

Intermolecular force causes a phenomenon of surface free energy ($\gamma$) on the uppermost surface of an object.

An object is wetted roughly in any of three ways.

They are "adhesion wetting" with which object 1 adheres to object 2, "spread wetting" with which object 1 spreads over object 2 and "dip wetting" with which object 1 dips or sinks into object 2.

Concerning "adhesion wetting", as for surface free energy ($\gamma$) and wettability, the relationship between object 1 and object 2 is expressed by equation (1) obtained from Young's equation.

$$\gamma_1=\gamma_2 \cos \theta_{12}+\gamma_{12}. \quad (1)$$

where $\gamma_1$: surface free energy of the surface of object 1, $\gamma_2$: surface free energy of object 2, $\gamma_{12}$: interfacial free energy of object 1/object 2 and $\theta_{12}$: angle of contact of object 1/object 2.

In the above equation, object 1 represents the photosensitive member and object 2 represents foreign matters when describing the adhesion of foreign matters and moisture to the surface of the photosensitive member within an image-forming apparatus.

From equation (1) it will be seen that the wettability can be reduced to increase the value of $\theta_{12}$ by increasing the surface free energy $\gamma_1$ on the surface of the photosensitive member where toner is wetted by the photosensitive member and reducing both $\gamma_2$ and $\gamma_{12}$.

Thus, in the cleaning operation of an electrophotographing apparatus, the adhering condition of the right side of equation (1) can be controlled by controlling the surface free energy $\gamma_1$ of the photosensitive member.

When considering the durability of the apparatus, it may be safe to assume that foreign matters including toner are supplied from time to time, whereas $\gamma_2$ is held to a constant value. On the other hand, the surface free energy $\gamma_1$ of the photosensitive member varies with use. When $\gamma_1$ is varied by $\Delta\gamma_1$, the value of the right side of equation (1) will be varied. In other words, the adhering condition of foreign matters on the surface of the photosensitive member changes to a consequently change the cleaning feasibility and the load on the cleaning system.

Differently stated, the cleaning feasibility, or easiness of being cleaned, of the photosensitive member can be held at a constant level by controlling $\Delta\gamma_1$.

When a solid object is wetted by liquid, their contact angle $\theta_{12}$ can be directly measured. However, when a solid object is wetted by another solid object as in the case of a photosensitive member and toner, it is impossible to directly measure their contact angle $\theta_{12}$.

Since a photosensitive member according to the invention and toner are both solid, it will be appreciated that their contact angle cannot be measured directly either.

Y. Kitazawa and T. Hata et al. reported in "Annual Report of Japan Association of Adhesion 8 (3)", pp.131–141 (1972) that the Forkes's theory on non-polar intermolecular force can be extended to components of polar or hydrogen bond type intermolecular force from the viewpoint of surface free energy (synonym of surface tension).

Then, on the basis of the extended Forkes's theory, surface free energy can be determined for different objects in terms of two or three components. A theory of adhesion wetting will be described below in terms of three components. This theory is based on the following assumption.

1. Rule of Additivity of Surface Free Energy ($\gamma$)

$$\gamma=\gamma^d+\gamma^p+\gamma^h \quad (2)$$

where $\gamma^d$: bipolar component (wetting due to polarity=adhesion), $\gamma^p$: dispersive component (non-polar wetting=adhesion) and $\gamma^h$: hydrogen bond component (wetting due to hydrogen bond=adhesion.

By applying this rule to the Forkes's theory, interface free energy $\gamma_{12}$ of two objects can be expressed by formulas (3) and (4) below.

$$\gamma_{12}=\gamma_1+\gamma_2-2\cdot(\gamma_1^d\gamma_2^d)^{1/2}-2\cdot(\gamma_1^p\gamma_2^p)^{1/2}-2\cdot(\gamma_1^h\gamma_2^h)^{1/2} \quad (3)$$

$$\gamma_{12}=\left\{\sqrt{(\gamma_1^d)}-\sqrt{(\gamma_2^d)}\right\}^2+\left\{\sqrt{(\gamma_1^p)}-\sqrt{(\gamma_2^p)}\right\}^2-\left\{\sqrt{(\gamma_1^h)}-\sqrt{(\gamma_2^h)}\right\}^2 \quad (4)$$

Thus, the surface free energy can be determined by using agents whose components p, d and h of surface free energy are known and measuring the adhesion of each of the agents.

In an example, pure water, methylene iodide and α-bromonaphthalene were selected for the agents, their respective contact angles on the surface of a photosensitive member were measured by means of contact angle gauge CA-S ROLL (tradename, available from Kyowa Kaimen) and then the surface free energy γ was determined by means of computer software EG-11 for analyzing surface free energy (tradename, available from Kyowa Kaimen).

Any other agents of which the components of p, d and h can be appropriately combined may also be used for the purpose of the invention. Likewise, any other generally applicable gauging technique such as Wilhelmy method and De Noui method may be used for the purpose of the invention.

As pointed out above, there are more than one types of "wetting". However, from the viewpoint of observing the adhesion or fusion/adhesion of toner onto the surface of a photosensitive member, the residual toner on the surface of the photosensitive member adheres to the photosensitive member and, as the latter is subjected to cleaning and electrostatically charging processes repeatedly, the toner spreads over the surface of the photosensitive member to become like film and firmly sticks thereto to give rise to a wetting phenomenon. Thus, "adhesion wetting" takes a vital role for the residual toner to adhere to the surface of a photosensitive member.

Additionally, foreign matters such as debris of paper, resin and talc as adhered to the surface of the photosensitive member eventually enlarge the area of contact with the photosensitive member (hereinafter referred to as "interface") to become strongly wetted.

When the foreign matters that have adhered to the surface of the photosensitive member can become literally "wetted" by moisture sitting directly on the surface of the photosensitive member to make the image on the surface of the photosensitive member fainted, which is a phenomenon referred to as "high humidity smudging". In the image-forming process of electrophotography, various substances including toner come to adhere, if temporarily, to the surface of the photosensitive member.

Of these substances, the toner that has not been transferred to the trasfer medium, or so-called "residual toner" and other foreign matters have to be cleaned and removed within a given period of time.

A given period of time as used herein refers to a period of time from the time when various substances adhere, if temporarily, to the surface of the photosensitive member to the time when the adherers are repeatedly subjected to a spread and/or further adhesion cycle to increase the interface between them and the surface of the photosensitive member.

When the photosensitive member is cleaned under such conditions, the "adhesion wetting" and the "spread wetting" of foreign matters vitally affect the cleaning feasibility of the photosensitive member as well as the service life of the cleaning unit and that of the photosensitive member.

Therefore, the inventors of the present invention came to believe that an electrophotographing apparatus can be made durable and produce high quality images by controlling the surface free energy of the photosensitive member and, as a result of intensive research efforts, succeeded in inventing such an electrophotographing apparatus.

In particular, object 2 that represents foreign matters includes various objects of different types such as toner, debris of paper, moisture and silicon oil as well as many other substances.

For the purpose of the invention, the surface free energy $\gamma_1$ of object 1 that represents the surface of the photosensitive member of an electrophotographing apparatus and to which foreign matters adhere is controlled.

As pointed out above, while object 2 is supplied from time to time in the image-forming process, object 1, or the surface of the photosensitive member, changes its $\gamma_1$ as the image-forming process is repeated. Thus, it is desirably to control the variation $\Delta\gamma_1$ of surface free energy in order to improve the durability of an electrophotographing apparatus.

[Control]

As described above, the cleaning feasibility of the photosensitive member, the load of cleaning the photosensitive member in particular, should be controlled to provide high quality images on a stable basis.

As a result of intensive research efforts, the inventors of the present invention came to find that an excellent cleaning feasibility of a photosensitive member can be obtained with a small load by controlling the surface free energy γ of the photosensitive member so as to be confined between 35 and 65 mN/m, preferably between 40 and 60 mN/m.

Additionally, it was found that variations of the load on both the photosensitive member and the cleaning unit can be suppressed and the cleaning feasibility of the photosensitive member can be made stable for a long period by confining the variation Δγ of the surface free energy due to the use of the photosensitive member to less than 25 mN/m, preferably less than 15 mN/m.

Figure 6:
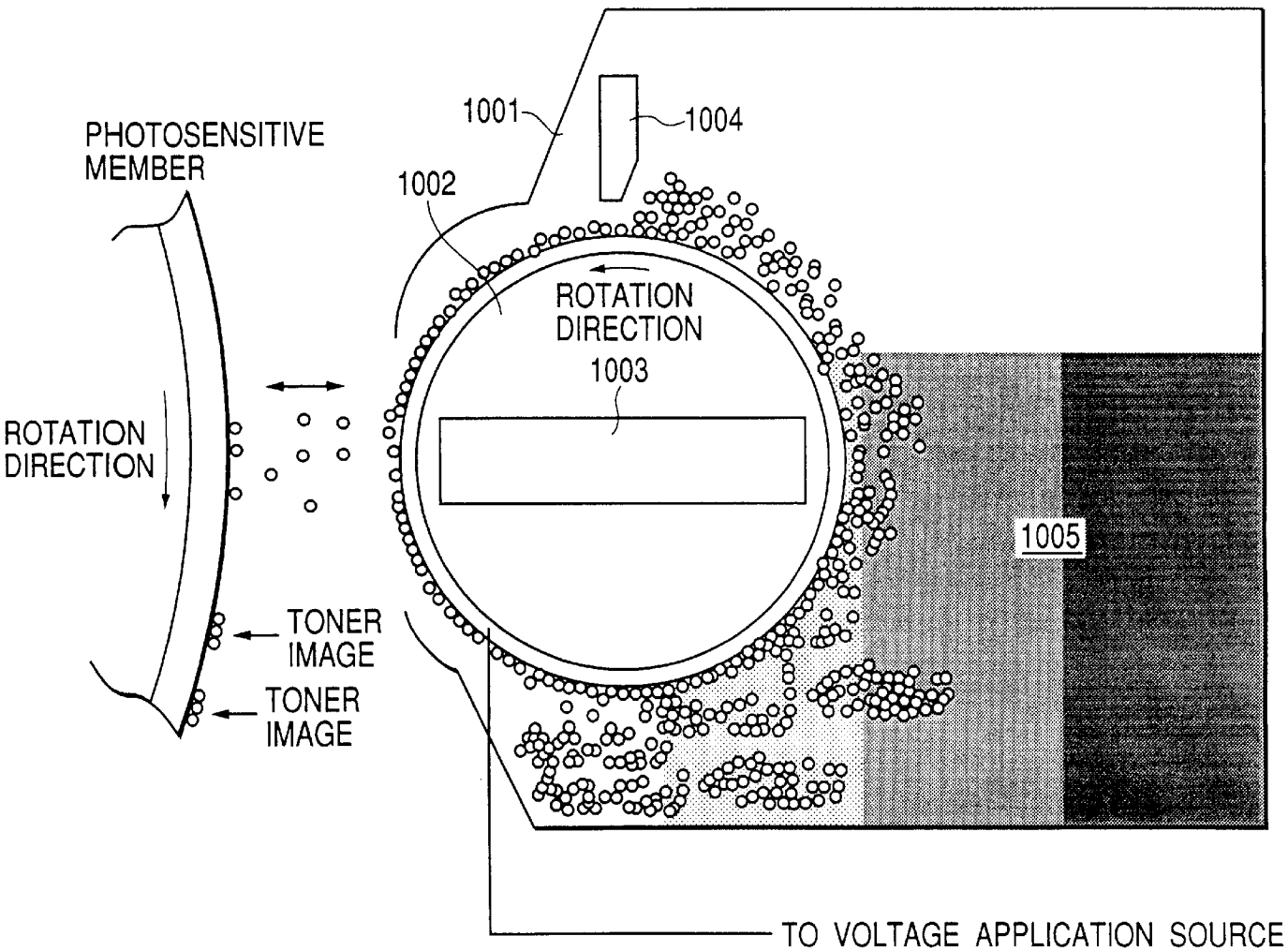
FIGS. 6 and 7 are schematic views of a developing unit and the behavior of toner.
Figure 7:
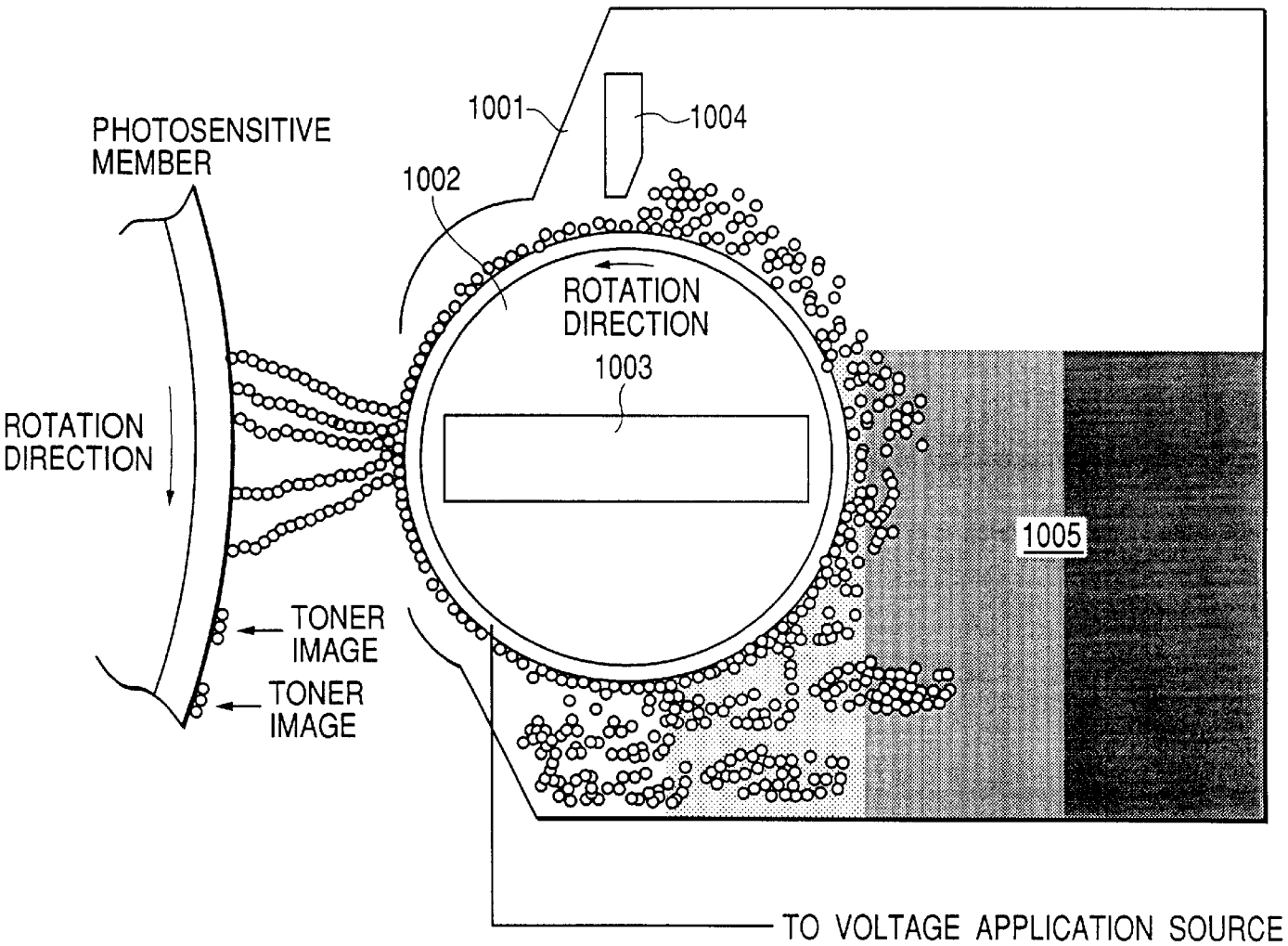

FIGS. 6 and 7 schematically illustrate the construction of a developing unit and the behavior of toner.

The developing unit 1001 in FIGS. 6 and 7 contains a magnetic material 1003 therein and comprises a developing sleeve 1002 for moving toner close to the surface of the photosensitive member, a doctor blade 1004 for controlling the amount of toner coated on the cylinder of the developing unit 1001, a voltage application means (not shown) for applying a developing bias voltage to the developing sleeve 1002 and a toner pool 1005 for storing toner.

[Toner, Development]

A developing bias voltage (ac+dc) is applied to the developing sleeve 1002 in the developing unit 1001 for a development process.

There are two types of toner, 1-component toner (magnetic toner) and 2-component toner (toner+carrier). Toner behaves differently between the developing sleeve 1002 and the photosensitive member depending on the composition of the toner.

In the case of 1-component toner, as shown in FIG. 6, toner reciprocates at high speed between. the developing sleeve 1002 and the photosensitive member, constantly jumping, as a function of the correlation of the developing bias, its ac component in particular, and the magnetic material 1003 in the developing unit 1001.

Then, the toner is developed on the surface of the photosensitive member as a function of the correlation of the developing bias, its dc component in particular, the electric potential of the surface of the photosensitive member and the magnetic force of the magnetic material 1003 in the developing unit 1001.

In the case of 2-component toner, as shown in FIG. 7, toner extends from the developing sleeve 1002 to the surface of the photosensitive member, taking the form of chains, and makes contact with the surface in a manner like a magnetic brush. The toner is developed on the surface of the photosensitive member as a function of the correlation between the developing bias, its dc component in particular, and the electric potential of the surface of the photosensitive member, and the magnetic force of the magnetic material 1003 in the developing unit 1001.

It is desirable to appropriately regulate the developing conditions including the developing bias and select suitable toner according to the type and the permittivity of the photosensitive member, the processing speed and other factors.

Generally, toner contains an additive added to the surface of the particles of the classified product (hereinafter referred to as outer additive) and, in the case of 2-component type toner, a material referred to as carrier is further added thereto.

The outer additive is normally supplied in the form of fine particles with a diameter between several tens of angstroms and several thousand angstroms (Å) that is smaller than the diameter of particles of the classified product and that of particles of the carrier.

In an experiment, the particle diameter and the diameter distribution of toner were observed by means of laser diffraction type particle size distribution gauge HEROS (tradename, available from JEOL). In the actual measurement, the range between 0.05 μm and 200 μm was put into 32 logarithmic divisions and 50% average particle diameter was used as average particle diameter. Unless noted otherwise, the toner particle diameter as used herein refers to the particle diameter of the classified product and the carrier, the outer additive being excepted.

For the overall average particle diameter, alternatively, more than 100 particle specimens may be randomly picked up using an optical microscope or a scanning electron microscope and the largest horizontal chordal length may be used as an average particle diameter.

While the average particle diameter is preferably as small as possible from the viewpoint of image quality, it is preferably between 1 and 50 μm from the viewpoint of cleaning feasibility and ease of manufacturing. More preferably, the average particle diameter is between 2 and 20 μm.

For the purpose of the invention, a plurality of classified toner products and/or a plurality of carriers may be mixed for use if they show an average particle diameter found within the above defined range.

For the purpose of the invention, toner particles are not necessarily spherical and may show surface undulations so long as they show an average particle diameter found within the above defined range.

Preferably, the distance between the surface of the photosensitive member and the sleeve (hereinafter referred to as "SD gap") is made small from the viewpoint of jumping motion of toner, contact points of chains of toner and prevention of scattering of toner within the developing unit.

If the SD gap is too small, on the other hand, electric discharges can occur between the photosensitive member and the developing means such as toner and the developing sleeve to adversely affect the latent image and additionally the free motion of toner can be obstructed to damage the photosensitive member and the developing means.

Therefore, for the purpose of the invention, the SD gap is held generally between 50 and 1000 μm, preferably 100 and 600 μm.

[Photosensitive Member]

For the purpose of the invention, the photosensitive member of an electrophotographing apparatus is preferably an inorganic photosensitive member, an amorphous silicon type photosensitive member (hereinafter referred to as "a-Si photosensitive member") prepared by using amorphous silicon as principal material in particular, or an organic photosensitive member (OPC) made of an organic semiconductor material.

A-Si photosensitive members are suitably used in medium for high speed copying machines and operate stably with a long service life if used very frequently.

For image-forming apparatus comprising such an electrophotographic photosensitive member heaving a long service life, the cleaning step in the electrophotographing process takes a very significant role for realizing a high efficiency and a prolonged service life for the apparatus.

On the other hand, OPCs are mostly and suitably used in cartridges such as LBPs and low to medium speed copying machines.

An OPC is a photosensitive member that can provide high quality images. An OPC does not have a surface as hard as that of an a-Si type photosensitive member.

Therefore, the film thickness of the photosensitive layer of the OPC can be reduced to limit the service life of the photosensitive member and hence that of the cartridge containing it as the surface is scrubbed by a cleaning blade.

However, as pointed out above, the service life of the photosensitive member can be prolonged by reducing the load including the linear pressure of the cleaning blade to reduce the rate of decrease of the film thickness of the photosensitive member.

[a-Si type photosensitive member]

While an a-Si type photosensitive member to be used for the purpose of the invention may be that of a known ordinary type comprising an electroconductive substrate and a photosensitive layer including a photoconductive layer made of a non-single-crystal material containing silicon atoms as a base component, to which, when necessary, hydrogen (H) or halogen (X) will be added (may be referred to as "a-Si: H, X" hereinafter), the performance of the photosensitive member will be improved by appropriate means whenever necessary. If necessary, the photosensitive layer may comprise a surface layer and a charge-injection impeding layer (barrier layer) in addition to the photoconductive layer.

In an a-Si type photosensitive member showing an improved performance for the purpose of the invention, the photoconductive layer preferably contains hydrogen by 10 to 30 atomic % and shows a characteristic energy level of 50 to 60 meV at the exponential Urbach's tail of the photoabsorption spectrum and a density of localized condition of $1\times10^{14}$ to $1\times10^{16}$ $cm^{-3}$.

A photosensitive member to be used for an image-forming apparatus that is configured in the above described manner shows excellent properties in terms of electric, optical and photoconductive performance, image quality, durability and environmental adaptability, including temperature dependence of the bearability of its electrostatic charge.

Now, the photoconductive member to be used for the purpose of the invention will be discussed in greater detail by referring to the related drawings.

FIGS. 8A through 8F are schematic cross sectional views of photosensitive members that can be used for an image-forming apparatus according to the invention.

Figure 8A:
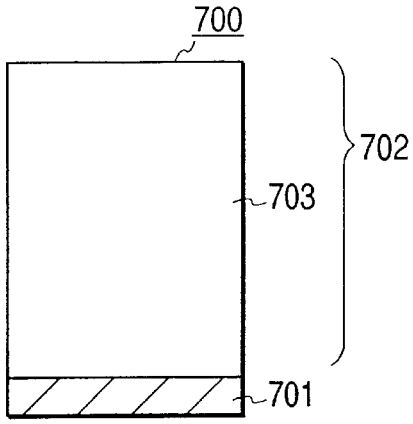
FIGS. 8A, 8B, 8C, 8D, 8E and 8F are schematic cross sectional views of photosensitive members, illustrating the layered structure thereof.

The photosensitive member 700 to be used for an image-forming apparatus as shown in FIG. 8A comprises a photosensitive layer 702 arranged on a substrate 701 operating for the photosensitive member. The photosensitive layer 702 comprises a photoconductive layer 703 made of a-Si: H, X.

Figure 8B:
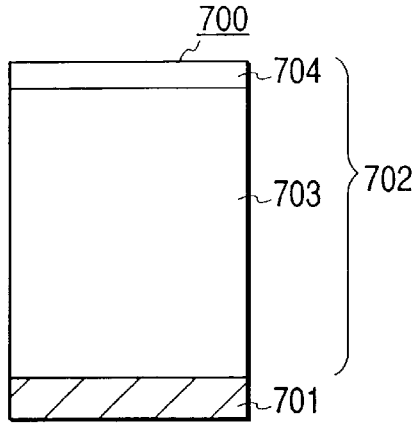

The photosensitive member 700 to be used for an image-forming apparatus as shown in FIG. 8B also comprises a photosensitive layer 702 arranged on a substrate 701 operating for the photosensitive member. The photosensitive layer 702 comprises a photoconductive layer made of a-Si: H, X and an amorphous silicon type (or amorphous carbon type) surface layer 704.

Figure 8C:
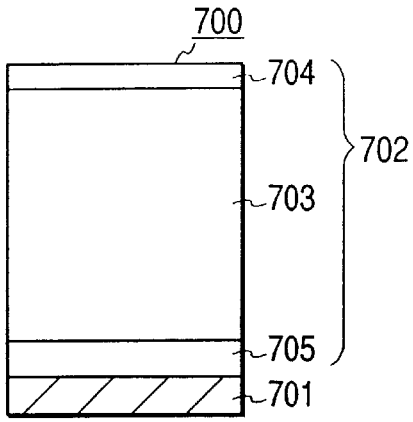

The photosensitive member 700 to be used for an image-forming apparatus as shown in FIG. 8C also comprises a photosensitive layer 702 arranged on a substrate 701 operating for the photosensitive member. The photosensitive layer 702 comprises a photoconductive layer made of a-Si: H, X, an amorphous silicon type (or amorphous carbon type) surface layer 704 and an amorphous silicon type charge-injection impeding layer 705.

Figure 8D:
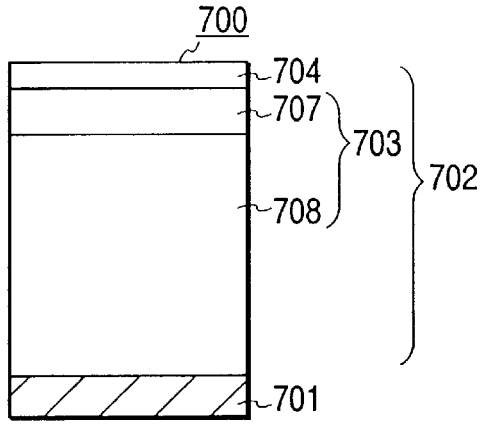
Figure 8E:
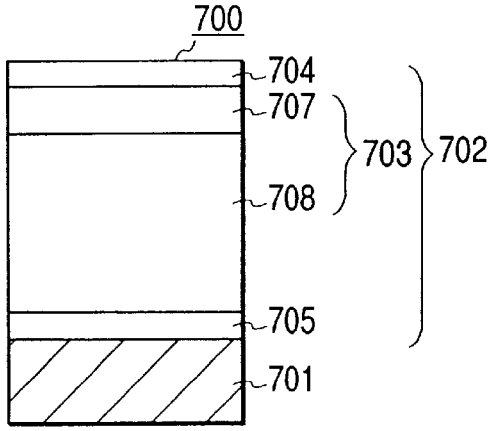

Both of the photosensitive members 700 to be used for an image-forming apparatus as shown in FIGS. 8D and 8E also comprise a photosensitive layer 702 arranged on a substrate 701 operating for the photosensitive member. The photosensitive layer 702 comprises a charge-generating layer 707 made of a-Si: H, X, a charge-transporting layer 708, said charge-generating layer 707 and said charge-transporting layer 708 constituting a photoconductive layer 703, and an amorphous silicon type (or amorphous carbon type) surface layer 704. The photosensitive member 700 for an image-forming apparatus as shown in FIG. 8E additionally comprises an amorphous silicon type charge-injection impeding layer 705 sandwiched by the charge-transport layer 708 and the substrate 701.

Figure 8F:
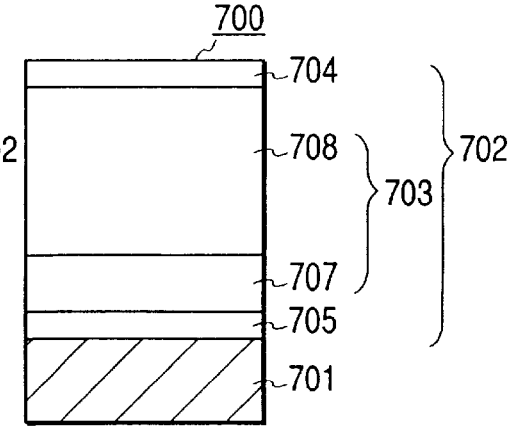

The photosensitive member 700 to be used for an image-forming apparatus as shown in FIG. 8F differs from its counterpart of FIG. 8E in terms of order of arrangement of the charge-generating layer 707 and the charge-transporting layer 708 as viewed from the substrate 701. Thus, in the photosensitive member of FIG. 8E, the charge-generating layer 707 and the charge-transporting layer 708 are sequentially laid on the amorphous silicon type charge-injection impeding layer 705 in the above mentioned order.

[Support Member 701]

The substrate may be electroconductive or electrically insulating. If it is electroconductive, materials that can be used for preparing it include metals such as Al, Cr, Mo, Au, In, Nb, Te, V, Ti, Pt, Pd and Fe and alloys of any of them such as stainless steel. An electrically insulating substrate made of a film or a sheet of synthetic resin such as polyester, polyethylene, polycarbonate, cellulose acetate, polypropylene, polyvinylchloride, polystyrene or polyamide, glass or ceramic and having a surface treated for electroconductivity at least on the side for forming a photosensitive layer may alternatively be used.

The substrate 701 may take a cylindrical shape or the shape of an endless belt with a smooth or undulated surface. While its thickness may be so selected as to produce a photosensitive member 700 that can appropriately be used for an image-forming apparatus, it is normally greater than 10 $\mu$m from the viewpoint of convenience of manufacturing and handling and that of mechanical strength.

Particularly if the photosensitive member is used for recording images by means of coherent light such as a laser beam, the substrate 701 may carry undulations on the surface within a limit that does not substantially reduce the number of photogenerating carriers in order to effectively eliminate the possibility of producing defective images due to interference fringes that appear on visible images. Japanese Patent Applications Laid-Open Nos. 60-168156, 60-178457, 60-225854 and 61-231561 describe known methods for producing undulations on a substrate 701 that can be used for the purpose of the invention.

As an alternative technique for effectively eliminating the possibility of producing defective images due to interference fringes that can appear when coherent light such as a laser beam is sued, a light absorbing layer or an anti-interference layer or region may be formed in or under the photosensitive layer 702.

The fineness/coarseness of the surface of the photosensitive member can be controlled by forming fine scars on the surface of the substrate. Such scars can be formed by means of a polishing material or by way of chemical etching, dry etching to be conducted in plasma or sputtering. The depth and size of the scars may be such that it does not substantially reduce the number of photogenerating carriers.

[Photoconductive Layer 703]

For the purpose of the invention, the photoconductive layer 703 is formed as part of the photosensitive layer 702 on the substrate 701 with, if necessary, an underlayer (not shown) interposed therebetween typicality by means of a vacuum deposition film forming technique with parameter values appropriately selected for obtaining desired characteristics. Specific thin film deposition techniques that can be used for the purpose of invention include glow discharge techniques (AC discharge CVD techniques such as low frequency CVD, high frequency CVD and microwave CVD as well as DC discharge CVD techniques), sputtering, vacuum evaporation, ion plating, photo assisted CVD and thermal CVD.

While an appropriate one will be selected from the above listed thin film deposition techniques depending on the manufacturing conditions, the capital investment, the manufacturing scale, the characteristics expected to the products of photosensitive members to be used for image-forming apparatus and other factors, the use of a glow discharge technique, particularly a high frequency glow discharge technique using a supply frequency found in the RF band, the $\mu$W band or the VHF band is. preferable because of the ease of controlling the manufacturing condition.

For preparing a non-single-crystal silicon photoconductive layer 703 by means of a glow discharge technique, a source gas adapted to supplying Si in the form of silicon atoms (Si), a source gas adapted to supplying H in the form of hydrogen atoms (H) and/or a source gas adapted to supplying X in the form of halogen atoms (X) are introduced into a reaction vessel whose internal pressure can be reduced with a desired gaseous state in order to give rise to a glow discharge within the reaction vessel. A layer of a-Si: H, X is thus formed on the substrate 701 arranged in a predetermined position in the reaction vessel.

It is necessary for the photoconductive layer 703 to contain hydrogen atoms and/or halogen atoms in order to compensate the unbound arms of silicon atoms and improve the quality of the layer particularly in terms of photoconductivity and charge bearing performance. From this point of view, the content of hydrogen atoms and halogen atoms, or the sum of the amount of hydrogen atoms and that of halogen atoms, is preferably 10 to 30 atomic %, more preferably 15 to 25 atomic %, relative to the sum of the amount of silicon atoms and that of hydrogen atoms and/or halogen atoms.

Additionally, it is preferable to form the photoconductive layer by adding to gas of a silicon compound also containing $H_2$ and/or He or hydrogen atoms to a desired ratio to the above gases so that hydrogen atoms may be structurally introduced into the photoconductive layer 703 being formed in order to improve the controllability of the content of introduced hydrogen atoms and obtain the desired film characteristics for the purpose of the invention. The above listed gases may be used either independently or as a mixture that shows a desired mixing ratio.

Source gas for supplying halogen atoms that can be used for the purpose of the invention may be halogen gas, one or more than one gaseous halogen compounds, one or more than one gaseous interhalogen compounds containing halogen or one or more than one gaseous or gasifiable halogen compounds of halogen-substituted silane derivatives. Additionally, one or more than one gaseous or gasifiable hydrogenated silicates containing silicon atoms and halogen atoms as component elements may also be used. Specific examples of halogen compounds that can be used for the purpose of the invention includes fluorine gas ($F_2$) and interhalogen compounds such as BrF, ClF, $ClF_3$, $BrF_3$, $BrF_5$, $IF_3$ and $IF_7$.

Specific examples of silicates containing halogen atoms and halogen-substituted silane derivatives includes silicon fluoride such as $SiF_4$ and $Si_2F_6$.

For the purpose of the invention, the content of hydrogen atoms and/or halogen atoms contained in the photoconductive layer 703 can be controlled by controlling the temperature of the substrate 701, the rate at which the source material to be used for containing hydrogen atoms and/or halogen atoms is introduced into the reaction vessel and/or the rate of supply of discharge power.

For the purpose of the invention, if necessary, the photoconductive 703 is made to contain atoms adapted to controlling the conductivity. Atoms to be used for controlling the conductivity may be evenly and uniformly distributed in the photoconductive layer 703 or partly unevenly distributed in the direction of the film thickness.

Atoms that can be used for controlling the conductivity may be those of so-called impurity elements that are used in the technological field of semiconductors such as those of the IIIa group of the periodic table showing the p conductivity type (hereinafter referred to as "IIIa group atoms" ) and those of the Va group of the periodic table: showing the n conductivity type (hereinafter referred to as "Va group atoms"). Specific examples of IIIa group atoms include atoms of boron (B), aluminum (Al), gallium (Ga), indium (In) and thallium (Tl), of which B, Al and Ga, particularly B, may most suitably be used. Specific examples of Va group atoms include atoms of phosphor (P), arsenic (As), antimony (Sb) and bismuth (Bi), of which P and As may most suitably be used.

The content of atoms contained in the photoconductive layer 703 for controlling the conductivity is preferably between $1\times10^{-2}$ and $1\times10^{4}$ atoms ppm, more preferably between $5\times10^{-2}$ and $5\times10^{3}$ atoms ppm, most preferably between $1\times10^{-1}$ and $1\times10^{3}$ atoms ppm.

IIIa group atoms or Va group atoms can. be structurally introduced to control the conductivity for the purpose of the invention by introducing a source material adapted to introduce IIIa group atoms or Va group atoms into the reaction vessel with a. gaseous state along with other gases for forming the photoconductive layer 703 in the step of forming the layer. It is preferable that the source material adapted to introduce IIIa group atoms or Va. group atoms takes the form of gas at room temperature under the atmospheric pressure or can easily be gasified at least under the layer-forming conditions.

Specific examples of source materials adapted to be used for introducing IIIa group atoms include hydrogenated borons such as $B_2H_6$, $B_4H_{10}$, $B_5H_9$, $B_5H_{11}$, $B_6H_{10}$, $B_6H_{12}$ and $B_6H_{14}$ and halogenated borons such as $BF_3$, $BCl_3$ and $BBr_3$ as well as $AlCl_3$, $GaCl_3$, $Ga(CH_3)_3$, $InCl_3$ and $TlCl_3$.

Specific examples of source materials adapted to be used for introducing Va group atoms include hydrogenated phosphors such as $PH_3$ and $P_2H_4$ for introducing phosphor atoms and halogenated phosphors such as $PH_4I$, $PF_3$, $PF_5$, $PCl_5$, $PBr_3$, $PBr_5$ and $PI_3$. Additionally, compounds such as $AsH_3$, $AsF_3$, $AsCl_3$, $AsBr_3$, $AsF_5$, $SbH_3$, $SbF_3$, $SbF_5$, $SbCl_3$, $SbCl_5$, $BiH_3$, $BiCl_3$ and $BrBr_3$ may also be used as starting materials for introducing Va group atoms.

Any of the above listed source materials for introducing atoms in order to control the conductivity may be diluted by $H_2$ and/or He for use.

For the purpose of the invention, it is effective to make the photoconductive layer 703 contain carbon atoms and/or oxygen atoms and/or nitrogen atoms. The content of carbon atoms and/or oxygen atoms and/or nitrogen atoms relative to the sum of silicon atoms, carbon atoms, oxygen atoms and nitrogen atoms is preferably between $1\times10^{-5}$ to 10 atomic %, more preferably between $1\times10^{-4}$ to 8 atomic %, most preferably between $1\times10^{-3}$ to 5 atomic %. The carbon atoms and/or oxygen atoms and/or nitrogen atoms may be evenly and uniformly distributed in the photoconductive layer 703 or partly unevenly distributed varying the content in the direction of the film thickness.

For the purpose of the invention, the thickness of the photoconductive layer 703 is appropriately determined by taking the effect on the electrophotographic performance and the electric capacity under the operating conditions as defined above and the economic feasibility into consideration, and thus it is preferably between 20 and 50 $\mu$m, more preferably between 23 and 45 $\mu$m, most preferably between 25 and 40 $\mu$m. While the temperature of the substrate 701 in the operation of forming the photoconductive layer may be selected appropriately within an optimal range as defined in the design phase, it is preferably between 200 and 350° C., more preferably between 230 and 330° C., most preferably between 250 and 310° C.

It should be noted that the temperature of the substrate and the gas pressure during the operation of forming the photoconductive layer are normally determined not independently but by taking the mutual and organic relations into consideration so that the produced photosensitive member may show intended characteristics.

[Surface Layer 704]

For the purpose of the invention, a surface layer 704 is preferably formed on the photoconductive layer 703 that is formed on the substrate 701 in a manner as described above. The surface layer 704 has a free surface and is used to provide appropriate characteristics to the produced photosensitive member particularly in terms of moisture resistance, adaptability to continuously repeated use, withstand voltage, adaptability to harsh operating conditions and durability. It is preferably made of a highly hard material such as an amorphous silicon type material that shows appropriate electric and optical characteristics.

While the surface layer 704 may be made of any amorphous silicon type material, the material is preferably selected from amorphous silicon materials containing hydrogen atoms (H) and/or halogen atoms (X) and additionally carbon atoms (hereinafter referred to as "a-SiC: H, X"), amorphous silicon materials containing hydrogen atoms (H) and/or halogen atoms (X) and additionally oxygen atoms (hereinafter referred to as "a-SiO: H, X"), amorphous silicon materials containing hydrogen atoms (H) and/or halogen atoms (X) and additionally nitrogen atoms (hereinafter referred to as "a-SiN: H, X") and amorphous silicon materials containing hydrogen atoms (H) and/or halogen atoms (X) and additionally carbon atoms, oxygen atoms and/or nitrogen atoms (hereinafter referred to as "a-Si (C, O, N): H, X".

Specific thin film deposition techniques that can be used for forming the surface layer 704 include glow discharge techniques (AC discharge CVD techniques such as low frequency CVD, high frequency CVD and microwave CVD as well as DC discharge CVD techniques), sputtering, vacuum evaporation, ion plating, photo assisted CVD and thermal CVD. While an appropriate one will be selected from the above listed thin film deposition techniques depending on the manufacturing conditions, the capital investment, the manufacturing scale, the characteristics expected to the products of photosensitive members to be used for image-forming apparatus and other factors, the use of the deposition technique same as the one used for forming the photoconductive layer is preferable from the viewpoint of productivity of manufacturing photosensitive members.

For preparing a surface layer 704 of a-SiC: H, X by means of a glow discharge technique, a source gas adapted to supplying Si in the form of silicon atoms (Si), a source gas adapted to supplying C in form of carbon atoms (C), a source gas adapted to supplying H in form of hydrogen atoms (H) and/or a source gas adapted to supplying X in the form of halogen atoms (X) are introduced into a reaction vessel whose internal pressure can be reduced with a desired gaseous state in order to give rise to a glow discharge within the reaction vessel. A layer of a-SiC: H, X is thus formed on the substrate 701 carrying the photoconductive layer 703 thereon arranged in a predetermined position in the reaction vessel. While halogen atoms (X) used for the photoconductive layer may also be used for the surface layer, the use of fluorine atoms is a preferable choice.

The carbon content of the surface layer is preferably between 30 and 90% relative to the sum of the silicon content and the carbon content when the layer is made of a material containing a-SiC as principal ingredient.

A very hard surface layer will be produced and the electric characteristics and the adaptability for high speed continuous operation of the produced photosensitive member will be remarkably improved by limiting the hydrogen content of the surface layer between 30 and 70 atomic %.

The hydrogen content of the surface layer can be controlled by controlling the flow rate of $H_2$ gas, the temperature of the substrate, the discharge power and the gas pressure.

For the purpose of the invention, the content of hydrogen atoms and/or halogen atoms contained in the surface layer 704 can be controlled by controlling the temperature of the substrate 701, the rate at which the source material to be used for containing hydrogen atoms and/or halogen atoms is introduced into the reaction vessel and/or the rate of supply of discharge power.

Carbon atoms and/or oxygen atoms and/or nitrogen atoms may be evenly and uniformly distributed in the surface layer or partly unevenly distributed varying the content in the direction of the film thickness.

For the purpose of the invention, if necessary, the surface layer 704 may contain atoms adapted to controlling the conductivity. Atoms to be used for controlling the conductivity may be evenly and uniformly distributed in the surface layer 704 or partly unevenly distributed in the direction of the film thickness.

Atoms that can be used for controlling the conductivity may be those of so-called impurity elements that are used in the technological field of semiconductors such as "IIIa group atoms" and "Va group atoms".

Any of the above listed source materials for introducing atoms in order to control the conductivity may be diluted by gas such as $H_2$, He, Ar and/or Ne for use.

For the purpose of the invention, the film thickness of the surface layer 704 is preferably between 0.01 and 3 $\mu$m, more preferably between 0.05 and 2 $\mu$m, most preferably between 0.1 and 1 $\mu$m. If the film thickness is less than 0.01 $\mu$m, the surface layer can eventually be abraded and become lost while the photosensitive member is in use. If, on the other hand, the film thickness is more than 3 $\mu$m, the electrophotographing characteristics of the photosensitive member can become degraded by an increased residual potential.

Alternatively, the surface layer may be made of amorphous carbon film containing carbon as. principal ingredient (hereinafter referred to as "a-C: H") or amorphous carbon film containing a-C: H as principle ingredient and having bonds with fluorine in the inside and/or on the uppermost surface (hereinafter refered to as "a-C: H: F").

An a-C: H or a-C: H: F surface layer has a hardness equal to or greater than a-SiC and shows high water-resistance and low friction. It can effectively prevent smeared images in a highly humid environment if an environment protection heater is not provided. It also can protect the photosensitive member against damages due to mechanical friction caused by toner particles.

A surface layer 704 made of a-C: H: F will be described below in greater detail. Hydrogen carbide is used as source gas and will be decomposed by glow discharge using a high frequency power. Since the surface protection layer should be made highly transparent in order to avoid any loss of photosensitivity, hydrogen gas, helium gas or argon gas is appropriately mixed with the source gas. The substrate temperature will be regulated appropriately between room temperature and 350° C.

Substances that can supply carbon for the purpose of the invention include gaseous or gasifiable substances that can effectively provide hydrogen carbide for used such as $CH_4$, $C_2H_6$, $C_3H_8$ and $C_4H_{10}$ as well as $CH_4$, $C_2H_6$, which are advantageous in terms of easy handling during the process of forming the layer and the efficiency of supplying carbon. Any of the above listed source materials for supplying carbon may be diluted, if necessary, by gas such as $H_2$, He, Ar and/or Ne for use.

While high frequency power of the above process is preferably as strong as possible from the viewpoint of thoroughly decomposing hydrogen carbide, abnormal discharges can occur to degrade the performance of the produced electrophotographing photosensitive member if power is too strong. Therefore, the level of power should be selected so as not to give rise to abnormal discharges. Specifically, the level of power is preferably more than 10 W/cc for source gas containing hydrogen carbide.

The pressure of the space where electric discharges are conducted is preferably less than 15 Pa, more preferably less than 6.5 Pa, most preferably less than 1.5 Pa. The lower limit of the pressure will be such that electric discharges are produced stably under the pressure.

To produce a region where fluorine atoms are bound to the film, after forming a surface protection layer typically made of a-C: H, fluorine-containing gas may be introduced to generate plasma by means of appropriate high frequency power and etch the surface protection layer. With this process, the surface protection layer comes to contain fluorine atoms in it. The level of power to be used for this process may be somewhere between 10 W and 5,000 W depending on the etching rate. Similarly, the level of pressure may be selected as a function of the etching rate within a range between 0.1 Pa and several Pa.

Fluorine type gases that can be used for the purpose of the invention include $CF_4$, $CHF_3$, $C_2F_6$, $ClF_3$, $CHClF_2$, $F_2$, $C_3F_8$, $C_4F_{10}$ and other fluorine-containing gases.

The depth by which the film is etched is at least 20 Å for the purpose of the invention. The reproducibility and the uniformity will be advantageously improved when the film is etched by more than 100 Å. While the etching depth may be more than 20 Å, preferably more than 100 Å, for the purpose of the invention, an etching depth between 1,000 Å and 5,000 Å will be highly advantageous from the viewpoint of controllability of the process and industrial productivity.

When forming an a-C: H surface layer 704, the above described process should be conducted without using fluorine and source gas for supplying fluorine.

For preparing a surface layer 704 that performs satisfactorily for the purpose of the invention, the temperature of the substrate 701 and the gas, pressure within the reaction vessel have to be selected appropriately.

It should be noted that the temperature of the substrate and the gas pressure during the operation of forming the surface layer are normally determined not independently but by taking the mutual organic relations into consideration so that the produced surface layer may show intended characteristics.

For the purpose of the invention, the charge bearability of the photosensitive member can be improved by arranging a blocking layer (lower surface layer) containing carbon atoms, oxygen atoms and nitrogen atoms to a lesser extent than the surface layer between the photoconductive layer and the surface layer.

Additionally, there may be arranged regions between the surface layer 704 and the photoconductive layer 703 where the content of carbon atoms and/or oxygen atoms and/or nitrogen atoms decreases towards the photoconductive layer 703. With such an arrangement, the adhesion of the surface layer and the photoconductive layer can be improved to reduce the influence of interference of light reflected by the interface of the two layers.

[Charge-Injection Impeding Layer 705]

The performance of a photosensitive member to be used for an image-forming apparatus according to the invention can be effectively improved by arranging a charge-injection impeding layer 705 adapted to block the electric charge injected from the side of the electroconductive substrate 701 between the electroconductive substrate 701 and the photoconductive layer 703. Such a charge-injection impeding layer 705 effectively blocks the electric charge injected from the side of the substrate 701 towards the side of the photoconductive 703 when the free surface of the photosensitive layer 702 is subjected to an electrostatically charging process with a given polarity but does not block the charge when the photosensitive layer 702 is subjected to an electrostatically charging process with the opposite polarity. In other words the charge-injection impeding layer 705 shows polarity dependency. In order to provide the charge-injection impeding layer 705 with polarity dependency, it is made to contain conductivity controlling atoms to a greater extent than the photoconductive layer 703.

Atoms to be used for controlling the conductivity in the charge-injection impeding layer 705 may be evenly and uniformly distributed in the surface layer 704 or partly unevenly distributed in the direction of the film thickness. If the layer shows an uneven distribution pattern, atoms preferably be distributed more densely in areas closer to the substrate. In any case, it is necessary to achieve a uniform distribution pattern in any plane parallel to the surface of the substrate in order to obtain uniform intra-planar characteristics.

Atoms that can be used for controlling the conductivity in the charge-injection impeding layer 705 may be those of so-called impurity elements that are used in the technological field of semiconductors such as "IIIa group atoms" and "Va group atoms".

For the purpose of the invention, the film thickness of the charge-injection impeding layer 705 is preferably between 0.1 and 5 $\mu$m, more preferably between 0.3 and 4 $\mu$m, most preferably between 0.5 and 3 $\mu$m from the economic point of view.

For the purpose of the invention, the mixing ratio of dilution gases, the gas pressure, the discharge power and the temperature of the substrate to be used for forming the charge-injection impeding layer 705 may be appropriately selected from the respective ranges of values as cited above, these factors for forming the layer are normally determined not independently but by taking the mutual organic relations into consideration so that the produced surface layer may show intended characteristics.

Additionally, in a photosensitive member to be used for an image-forming apparatus according to the invention, an adhesion layer made of an amorphous material containing $Si_3N_4$, $SiO_2$, SiO or silicon as a base component and additionally hydrogen atoms and/or halogen atoms and carbon atoms and/or oxygen atoms and/or nitrogen atoms may be formed between. the substrate 701 and the photoconductive layer 703 or the charge-injection impeding layer 705 in order to improve the adhesion of the layers. Still additionally, a light absorption layer may be provided to prevent appearance of interference fringes due to light reflected by the substrate.

Figure 9:
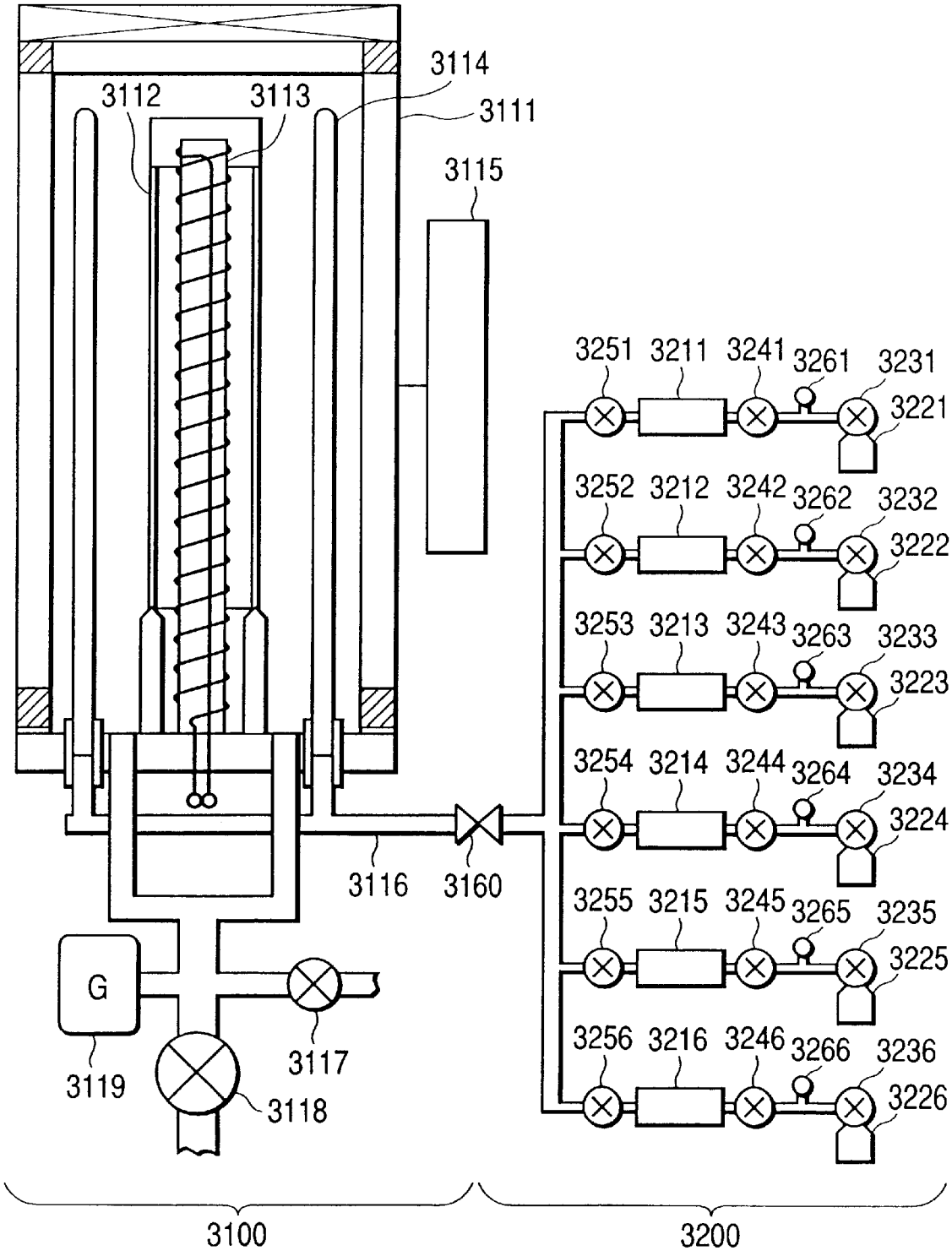
FIG. 9 is a schematic view of an apparatus for manufacturing a photosensitive member to be used for an image-forming apparatus.

The above layers are formed by means of a known apparatus as shown in FIG. 9 and a known film-forming method.

FIG. 9 shows a schematic view of an apparatus that can be used for manufacturing a photosensitive member to be used for an image-forming apparatus by means of high frequency plasma CVD using an RF band for power supply frequency (hereinafter referred to as "RF-PCVD).

The apparatus roughly comprises a deposition unit (3100), a source gas supply unit (3200) and an exhaust system (not shown) for reducing the pressure inside the reaction vessel (3111). The reaction vessel (3111) located inside the deposition unit (3100) is provided with a cylindrical substrate (3112), a substrate heater (3113) and a source gas inlet pipe (3114) arranged within the reaction vessel and is connected to a high frequency matching box (3115).

The source gas supply unit (3200) includes source gas cylinders (3221 through 3226) containing respective source gases such as $SiH_4$, $GeH_4$, $H_2$, $CH_4$, $B_2H_6$ and $PH_3$, valves (3231 through 3236, 3241 through 3246, 3251 through 3256) and mass flow controllers (3211 through 3216) and the cylinders of respective source gases are connected to the gas inlet pipe (3114) within the reaction vessel (3111) by way of a valve (3160) and a piping system (3116).

Figure 10:
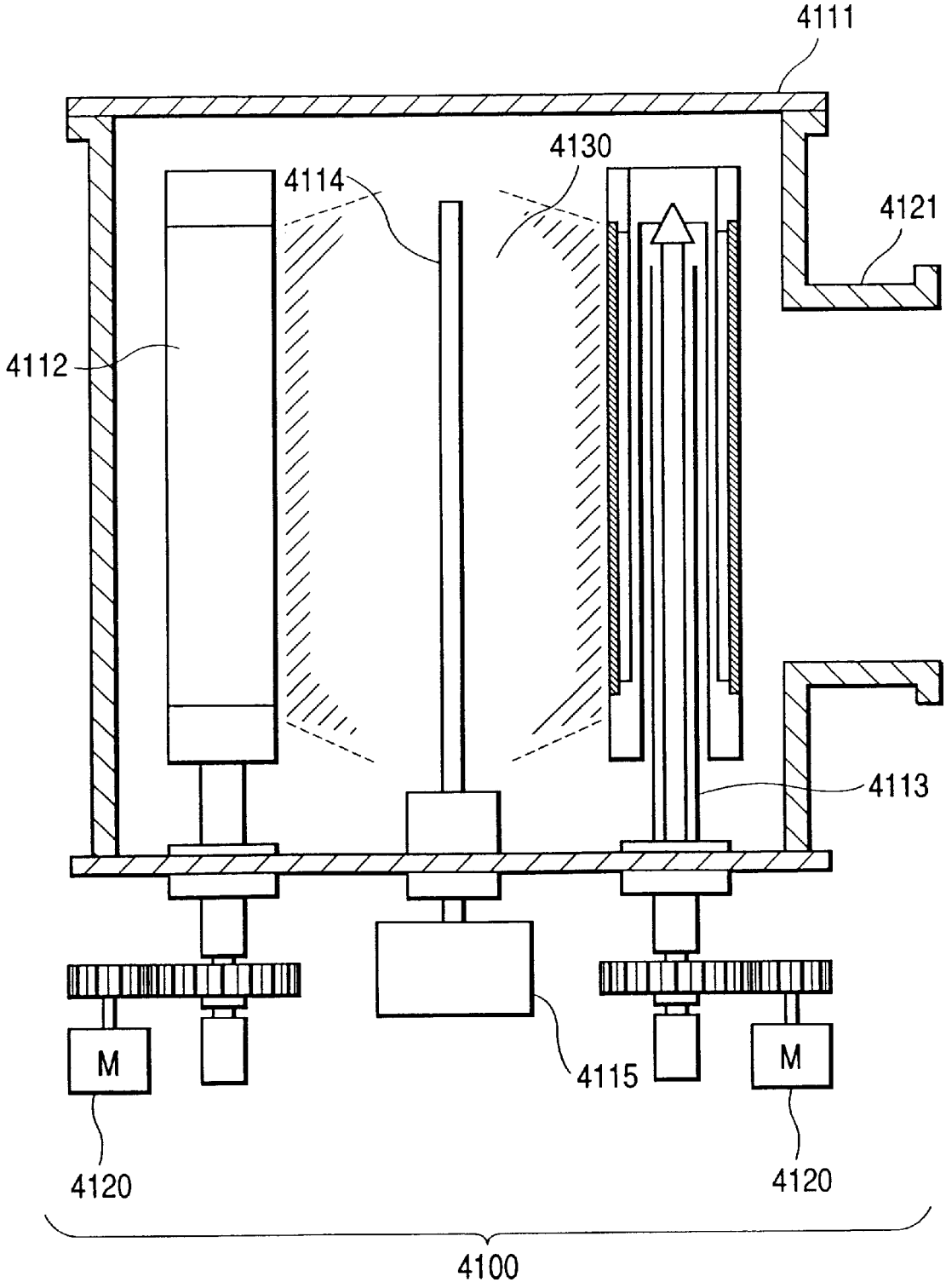
FIG. 10 is a schematic view of another apparatus for manufacturing a photosensitive member to be used for an image-forming apparatus.

An apparatus that can be used for manufacturing a photosensitive member to be used for an image-forming apparatus by means of high frequency plasma CVD using a VHF band for power supply frequency (hereinafter referred to as "VHF-PCVD) can be obtained by replacing the deposition unit (3100) of the apparatus of FIG. 9 adapted to RF-PCVD with a deposition unit (4100) as shown in FIG. 10 and connecting it to the gas supply unit (3200).

The obtained apparatus roughly comprises a reaction vessel (4111), a source gas supply unit (3200) and an exhaust system (not shown) for reducing the pressure inside the reaction vessel (3111). The reaction vessel (4111) is provided in the inside thereof with a cylindrical substrate (4112), a substrate heater (4113) and an electrode (4114) operating also as source gas inlet pipe arranged and connected to a high frequency matching box (4115). The reaction vessel (4111) is connected to a diffusion pump (not shown) be way of a exhaust valve (4121).

The source gas supply unit (3200) includes source gas cylinders (3221 through 3226) containing respective source gases such as $SiH_4$, $GeH_4$, $H_2$, $CH_4$, $B_2H_6$ and $PH_3$, valves (3231 through 3236, 3241 through 3246, 3251 through 3256) and mass flow controllers (3211 through 3216) and the cylinders of respective source gases are connected to the gas inlet pipe (4115) within the reaction vessel (4111) by way of a valve (3160). The space (4130) surrounded by the cylindrical substrate (4112) provides a discharge space.

[Organic Photosensitive Member (OPC)]

Figure 11:
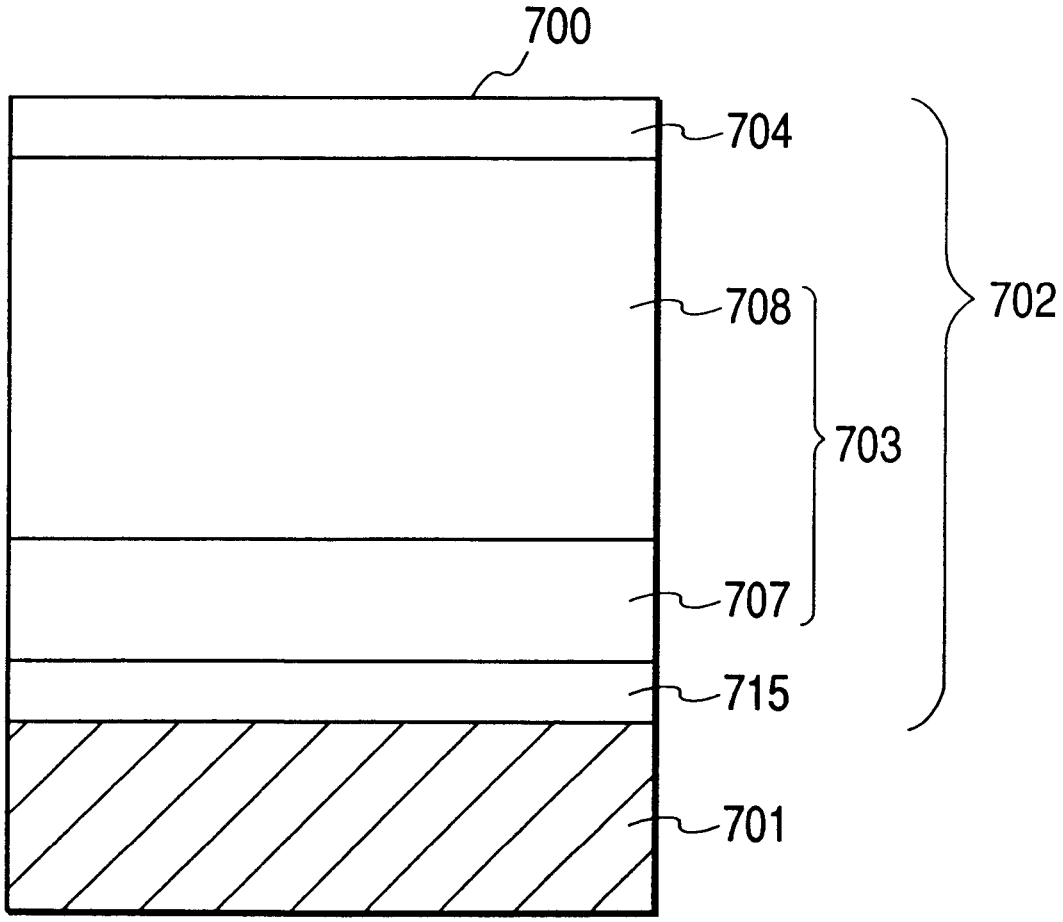
FIG. 11 is a schematic cross sectional view of a photosensitive member, illustrating the layered structure thereof.

Now, an OPC photosensitive member which is one of preferable examples of photosensitive member according to the invention will be discussed. FIG. 11 is a schematic cross sectional view of an OPC photosensitive member to be used for an image-forming apparatus according to the invention, illustrating the layered structure thereof.

The OPC photosensitive member 700 of FIG. 11 comprises a photosensitive layer 702 arranged on a substrate 701 operating for the photosensitive member. The photosensitive layer 702 comprises a charge-generating layer 707 and a charge-transporting layer 708. When necessary, it also comprises a protective layer or surface layer 704 and an intermediate layer 715 between appropriate layers such as between the support layer 701 and the charge-generating layer 707. In terms of the OPC photosensitive member of the invention such as the surface layer, the photoconductive layer and the intermediate layer 715 which is provided if necessary, the surface layer may be formed in a known manner, although it may be mixed or coated with a fluorine containing material such as polytetrafluoroethylene (hereinafter referred to as PTFE) in order to improve the durability.

While a photosensitive member having a surface not containing and/or coated with fluorine atoms may be free from problems in terms of water-repellency and cleaning feasibility, the surface layer containing and/or coated with fluorine atoms is advantageous over a surface without fluorine atoms because it is more water-repellent, smooth and durable.

[Example of Resin]

An example of resin that can be used for forming the surface layer, the photoconductive layer, the charge-transporting layer and the charge-generating layer of a electrophotographing photosensitive member for the purpose of the invention will be discussed below.

Polyester is a coupled polymer of an acid component and an alcohol component that can be obtained by condensing dicalbonic acid and glycol or the hydroxy group of hydroxybenzoic acid and a compound having a carboxy group.

Acids that can be used for the acid component include aromatic dicarboxylic acids such as terephthalic acid, isophthalic acid and naphthalenedicarboxylic acid, aliphatic dicarboxylic acids such as dicarboxylic acid, succinic acid, adipic acid and sebacic acid, alicyclic dicarboxylic acids such as hexahydroterephthalic acid and oxycarboxylic acids such as hydroxyethoxybenzoic acid.

Glycols that can be used for the glycol component include etheyleneglycol, trimethyleneglycol, tetramethyleneglycol, hexamethyleneglycol, cyclohexadimethylol, polyethyleneglycol and polypropyleneglycol.

Within the extent to which polyester resin is substantially linear, a multifunctional compound selected from a group including pentaerythritol, trimethylolpropane, pyromellitic acid and their ester-forming derivatives may be copolymerized.

For the purpose of the invention, high melting point polyester resin will be used.

High melting point polyester resin that can be used for the purpose of the invention shows a intrinsic viscosity preferably greater than 0.4 dl/g, more preferably greater than 0.5 dl/g, most preferably greater than 0.65 d/g when measured in orthochlorophenol at 36° C.

High melting point polyester resin that can be advantageously be used for the purpose of the invention is polyalkyleneterephthalate type resin. Polyalkyleneterephthalate type resin principally comprises terephthalic acid as acid component and alkyleneglycol as glycol component.

Specific examples of such resin include polyethyleneterephthalate (PET) principally comprising terephtalic acid and ethyleneglycol as components, polybutyleneterephthalate (PBT) principally comprising terephthalic acid and 1,4-tetramethyleneglycol(1,4-butyleneglycol) and polycyclohexyldimethyleneterephthalate (PCT) principally comprising terephthalic acid and cyclohexanedimethylol.

Another example of high molecular polyester resin that can advantageously be used for the purpose of the invention is polyalkylenenaphthalate type resin. Polyalkylenenphthalate type resin comprises naphthalenedicarboxylic acid as acid compornent and alkyleneglycol as glycol component. Specific examples include polyethylenenaphthalate (PEN) principally comprising naphthalanedicarboxylic acid and. ethyleneglycol.

High melting point polyester resin that can be used for the purpose of the invention shows a melting point preferably higher than 160° C., more preferably higher than 200° C.

For the purpose of the invention, acrylic resin may be used in place of polyester resin. Additionally, di-functional acryl, hexa-functional acryl or phosphazene may be used as binder.

Such resins show a relatively high crystallinity and presumably hardening resin polymer chains and high melting point polymer chains are mutually entangled in the resin to produce a uniform, dense and durable surface layer. Since low melting point polyester resin shows a relatively low crystallinity, presumably the entanglement of hardening resin polymer chains takes place only highly unevenly to make the surface poorly durable.

For the purpose of the invention, resin is used to have a selected extent of dispersion and controlled for charge bearability and photosensitivity as a function of operating conditions.

Note that the surface of the photosensitive member may be coated with PTFE resin or not.

[Toner/Inorganic Fine Powder]

Toner to be used for the purpose of the invention has a polarity and other characteristics adapted to the surface potential of the photosensitive member and the polarity and the electric field used in the developing process.

For the purpose of the invention, any known toner may be used.

Toner is typically prepared by using resin and acid anhydrate as described below.

200 phr of toluene is put into a reaction vessel and heated to reflux temperature. Then, a mixture of 77 phr of styrene monomer, 13 phr of n-butyl acrylate, 10 phr or monobutyl maleate and 6 phr of di-tert-butylperoxide is dropped into the refluxed toluene for 4 hours.

Polymerization is made to complete in the refluxed toluene (120 to 130° C.) and the toluene is removed to obtain styrene-type copolymer.

Then, 30 phr of the styrene-type copolymer is dissolved into the following monomer mixture to prepare a mixture thereof.

42 phr of styrene monomer, 12 phr of n-butyl acrylate, 12 phr of n-butyl methacrylate, 4 phr of monobutyl maleate, 0.4 phr of divinylbenzene and 1.6 phr of benzoyl peroxide are mixed and 170 phr of water containing 0.1 weigh portions of partially saponified polyvinylalcohol is added to the mixture to produce a dispersed suspension.

The above dispersed suspension is punt into the nitrogen-replaced reaction vessel containing 15 phr of water to cause a suspension polymerizing reaction to take place at reaction temperature between 70 and 95° C. for 6 hours. After the reaction and a subsequent filtration/dehydration/drying operation, a resin composition is obtained.

As for the molecular weight distribution of the obtained resin composition, the main peak of molecular weight is at 7500 and a shoulder is found at molecular weight of 35000, while Tg is 60° C. and JIS acid value is 22.0.

Toner is prepared by using such resin, a magnetic substance such as ferrite, appropriate oil, a finely powdery inorganic substance such as finely powdery silica processed for hydrophobicity and an appropriate outer additive.

The particle diameter and the composition of toner is then regulated by taking account of the operating conditions of the image-forming apparatus with which it is used.

For instance, the developing agent (toner) to be used may be made to contain wax by means of a known technique.

Additionally, the hydrocarbon type wax and the particle diameter of the finely particulate resin may be regulated by means of a technique as described in Japanese Patent Application Laid-Open No. 09-068822 and particles of the resin may be surface-treated also by means of a technique described in the patent document.

Still additionally, appropriate transfer means and/or separation means for efficiently transferring the developed toner onto transfer medium as well as a preliminary process for improving the transfer efficiency such as a process of applying an. electric field to the toner prior to the transfer may be introduced for the purpose of the invention.

It has been found that the heater of the photosensitive member of an image-forming apparatus can be replaced by a heater with a reduced capacity or totally eliminated and any possible fusion of toner can be prevented when a photosensitive member, an a-Si type photosensitive member in particular, having improved temperature characteristics and an improved surface condition is used.

Thus, the cleaning feasibility of the photosensitive member and the durability of the cleaning unit and the surface of the photosensitive member can be improved by using any of the above described means and effects of solving the problems of existing photosensitive members independently or in combination. Then, the cleaning unit and hence the image-forming apparatus can be down-sized.

The nip width of the photosensitive member and the cleaning roller or the cleaning brush should be held to a predetermined level in order to keep the cleaning feasibility to a constant level and prevent problems such as an excessive local abutment of the photosensitive member and the cleaning roller or brush and an abraded photosensitive member.

The mechanism for holding the abutment of the photosensitive member and the cleaning roller or the cleaning brush may comprise rollers. Alternatively, the cleaning roller may simply be pressed against the photosensitive member under pressure of a predetermined level. The thickness of the toner coat can be regulated by using a cleaning roller of a magnetic material.

The developing bias and the intensity of light of exposure are preferably regulated depending on the photosensitive member and the toner.

[Experiments and Examples]

Now, the present invention will be further described non-limitatively by way of experiments and examples.

EXPERIMENT 1

In this experiment, a film forming apparatus adapted to use an RF-PCVD technique as shown in FIG. 9 was used to prepare a photosensitive member to be used for an image-forming apparatus. Firstly, an aluminum cylinder with a diameter of ϕ80 that had been mirror-polished and another aluminum cylinder also with a diameter of 80 but whose surface had been processed to produced undulations by the above described known technique were used. Then, a charge-injection impeding layer, a photoconductive layer and a surface layer were formed on each of the cylinders under the conditions listed in Table 1 below.

The prepared specimens of photosensitive member were mounted on respective image-forming apparatus (NP6750: tradename, available from Canon Inc.; modified for the test) and tested for the temperature dependence of the charge bearability (temperature characteristics), the optical memory and defective images.

For each specimen, the surface potential of the photosensitive member was observed by arranging the drum surface potential sensor contained in the Canon's NP6750 on the developing unit of the image-forming apparatus in the test of evaluating the electric characteristics of each specimen without actually forming an image, and the sensor was placed at a position between the charging unit and the developing unit in the sense of rotation of the photosensitive member that is not practically affected by electric discharges and does not affect the process of exposure when forming an image. The distance between the sensor and the surface of the photosensitive member was made equal to the SD gap.

After arranging the potential sensor, the characteristic values were observed at the middle of the axis the photosensitive member. The average peripheral potential was used as reference surface potential Vd of the photosensitive member.

After exposing the specimen to conditioning light from the conditioning light source 109, a given voltage was applied by means of the charging unit end the charging current, the charging voltage and the surface potential of the photosensitive member were observed, while idly rotating the photosensitive member without feeding transfer paper. The electric characteristics of the photosensitive member were measured before and after a long running test for observing the durability.

[Unevenness of Potential]

In this experiment, the unevenness of potential in the peripheral direction of the photosensitive member was expressed as $\Delta V_{d_rot}$; and the potential Vd was observed at five positions including the axial middle position, the opposite ends of the copy paper and two intermediary positions their between and the largest difference among the observed values was used as the unevenness of potential in the direction of generating line and expressed by $\Delta V_{d_ax}$.

Of the specimens of photosensitive member, those whose $\Delta V_{d_rot}$ and $\Delta V_{d_ax}$ were both less than 20V were used for the following evaluations.

[Temperature Characteristic]

The temperature dependence of the charge bearability (hereinafter referred to as "temperature characteristic") was evaluated by measuring the surface potential of the photosensitive member (darkness potential: Vd) when no image exposure signal was irradiated onto the surface of the photosensitive member, while changing the surface temperature of the photosensitive member from room temperature to 45° C., to see the variation of Vd per 1° C. Specimens with 2V/deg or less were judged as good.

[Imaging Conditions]

Various properties were evaluated by an imaging test using toner specified for Canon's NP6750.

Imaging effect was evaluated by a continuous imaging test conducted under the following conditions.

environment of 35±2° C., 85±10% RH (hereinafter referred to environment H/H)

environment of 25±2° C., 45±5% RH (hereinafter referred to environment N/N)

environment of 25±2° C., 10±5% RH (hereinafter referred to environment N/L)

environment of 15±2° C., 10±5% RH (hereinafter referred to environment L/L)

[Optical Memory]

A half tone chart (Test Chart FY9-9042-000 or FY9-9098-000: tradename, available from Canon Inc.) and a ghost chart (FY9-9040-000: tradename, available from Canon Inc.) were used to evaluate the optical memory.

As for optical memory, the quantum of optical memory was determined by observing the image in various different environments by means of a reflection densitometer (available from Macbeth) and then, after forming an image, the average reflection density of the a half tone section was subtracted from the average reflection density of the optical memory section on the half tone (Dm-Dr). The obtained results were regulated by visual observation and rated as follows.

1. excellent
2. good
3. permissible
4. usable
5. poorly usable

The standards used for the rating of optical memory were as follows.

1. quantum of optical memory: less than 0.05 and visually unrecognizable (excellent)
2. quantum of optical memory: not less than 0.05 and less than 0.10; no difference of density visually observable (good)
3. quantum of optical memory: not less than 0.10 and less than 0.15; difference of density visually slightly observable (permissible)
4. quantum of optical memory: not less than 0.15 and less than 0.20; difference of density observable (usable)
5. quantum of optical memory: not less than 0.35; difference of density visually observable

[Smeared Image]

To evaluate the extent of smear of images formed by each of the specimens, the image-forming apparatus carrying the specimen of photosensitive member and toner was left in an H/H environment for an appropriate period exceeding 72 hours to make the inside of the apparatus sufficiently and stably matched to the environment. Thereafter, a running durability test operation was conducted by using 50,000 sheets of copy paper. Then, the power was turned off and the apparatus was left idle. Subsequently, an imaging test was conducted continuously on 100 sheets of copy paper by using the charts listed below and the produced images were evaluated.

While the apparatus may have an environment protection heater (drum heater) depending on the type thereof, the experiment was conducted without using the heater.

The following imaging charts were used:

ABC Chart (FY9-9058-000: tradename, available from Canon Inc.) and

NA-7 Chart (FY9-9060-000: tradename, available from Canon Inc.).

The extent of smear of the images were evaluated by visual observation including observation through a microscope and rated by using the following rating system.

1. excellent
2. good
3. permissible
4. usable
5. poorly usable

The standards used for the rating of smeared image were as follows.

1. Extent of blurred gaps separating fine lines not less than 9.0 and visually unrecognizable (excellent)
2. Extent of blurred gaps separating fine lines: not less than 7.1 and visually substantially unrecognizable (good)
3. Extent of blurred gaps separating fine lines: not less than 5.0 and visually substantially unrecognizable (permissible)
4. Extent of blurred gaps separating fine lines: not less than 4.5 and visually recognizable (usable)
5. Extent of blurred gaps separating fine lines: less than 4.0 and visually recognizable (poorly usable)

[Coarseness of Image]

To evaluate the coarseness of images formed by each of the specimens, the image-forming apparatus carrying the specimen of photosensitive member and toner was left in an appropriate environment for an appropriate period exceeding 72 hours to make the inside of the apparatus sufficiently and stably matched to the environment. Thereafter, a running durability test operation was conducted by using 50,000 sheets of copy paper. Then, the power was turned off and the apparatus was left idle. Subsequently, an imaging test was conducted continuously on 100 sheets of copy paper by using the charts listed below and the produced images were evaluated.

While the apparatus may have an environment protection heater (drum heater) depending on the type thereof, the experiment was conducted without using the heater.

The following imaging charts were used:

Half Tone Test Chart (FY-9-9042-000: tradename, available from Canon Inc.)

NA-7 Chart (FY9-9060-000: tradename, available from Canon Inc.).

The extent of smear of the images were evaluated by visual observation including observation through a microscope and rated by using the following rating system.

1. excellent
2. good
3. permissible
4. usable
5. poorly usable

The standards used for the rating of coarse image were as follows.

1. Extent of gaps separating broken fine lines: not less than 9.0 and visually unrecognizable (excellent)
2. Extent of gaps separating broken fine lines: not less than 7.1 and visually substantially unrecognizable (good)
3. Extent of gaps separating broken fine lines: not less than 5.0 and visually substantially unrecognizable (permissible)
4. Extent of gaps separating broken fine lines: not less than 4.5 and visually recognizable (usable)
5. Extent of gaps separating broken fine lines: less than 4.0 and visually recognizable (poorly usable)

[Spot Level]

Additionally, the obtained images were evaluated for white spots and black spots as well as other defects. More specifically, the size and the number of the spots were determined by using:

Solid Black Test Chart (FY-9-9073-000: tradename, available from Canon Inc.),

Half Tone Test Chart (FY-9-9042-000: tradename, available from Canon Inc.) and

White Paper (transfer medium).

[D. O. S., Eu]

On the other hand, a 1 $\mu$m thick a-Si film was formed by deposition on a glass substrate (705: tradename, available from Coning) and an Si wafer arranged in a cylindrical holder under the conditions of preparing a photoconductive layer. Then, a comb-shaped Al electrode was formed by evaporation on the deposition film of the glass substrate and the characteristic energy at the exponential Urbach's tail (Eu) and the localized level density (D. O. S.) were observed by means of CPM, whereas the hydrogen content of the deposition film on the Si wafer was measured by means of FT-IR (Fourier transform infra-red absorption).

Figure 12:
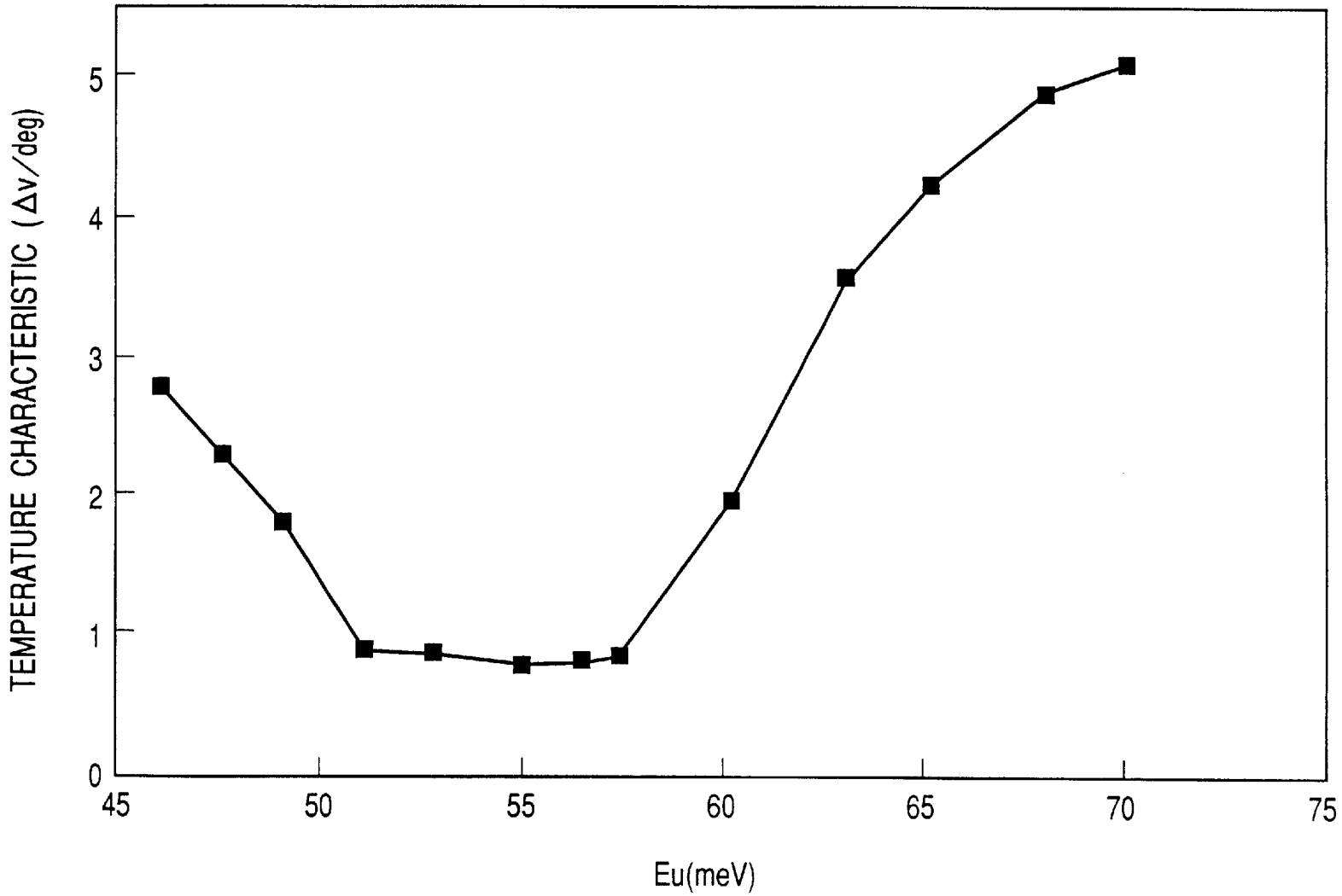
FIG. 12 is a graph illustrating the relationship between Eu and the temperature characteristic of a photosensitive member.
Figure 13:
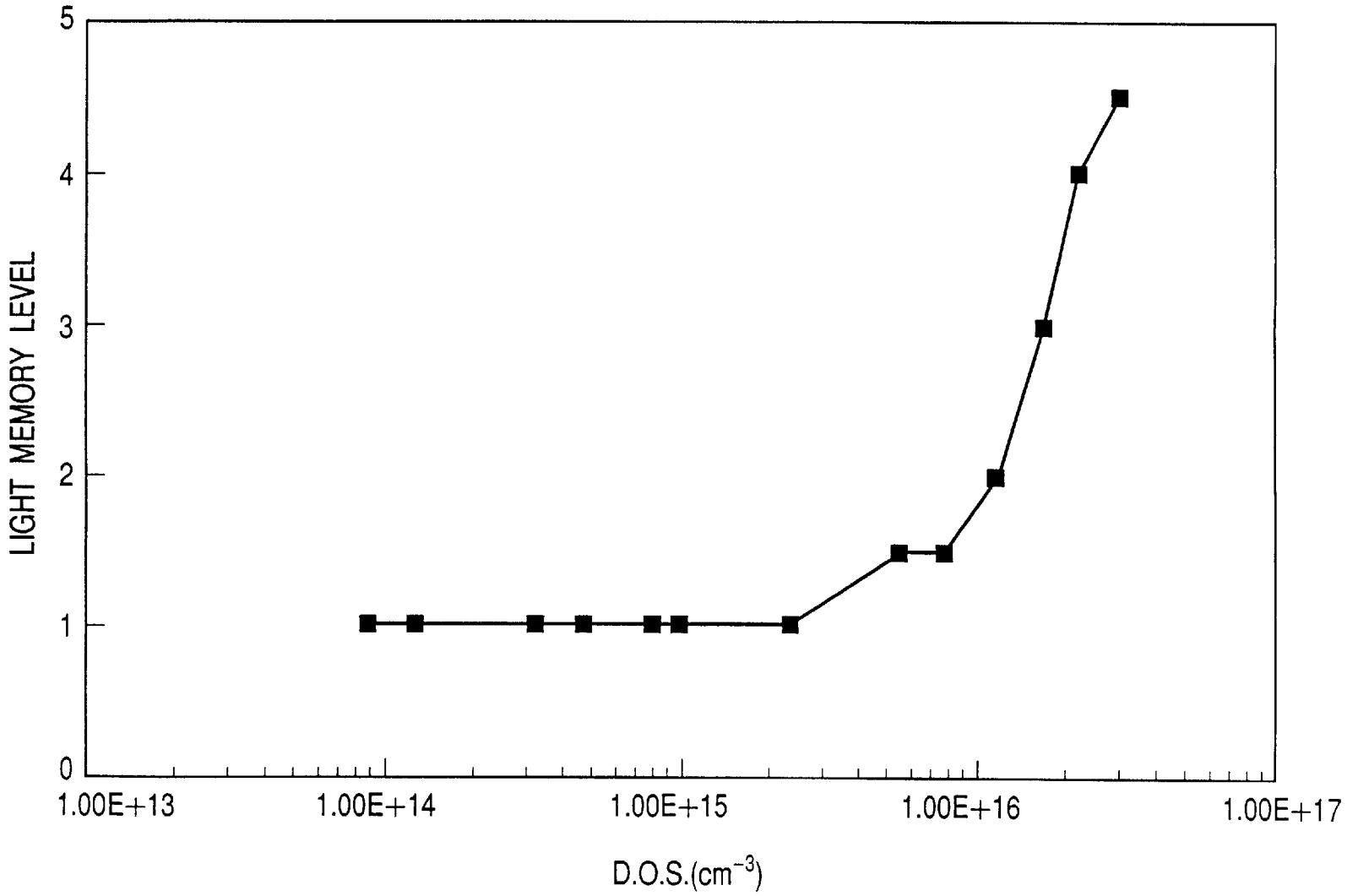
FIG. 13 is a graph illustrating the relationship between D.O.S. and the optical memory level of a photosensitive member.
Figure 14:
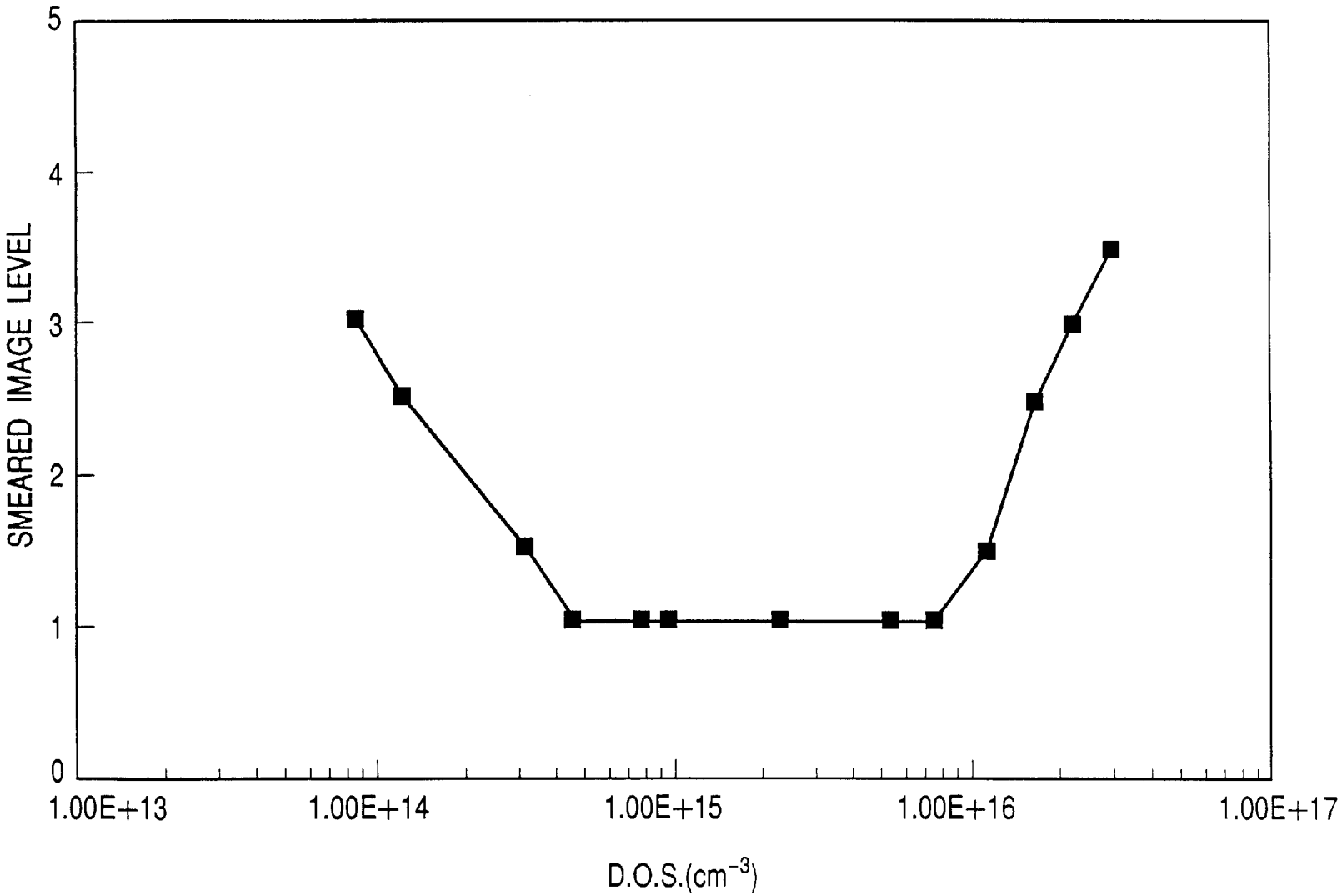
FIG. 14 is a graph illustrating the relationship between D.O.S. and the smeared image level of a photosensitive member.
Figure 15:
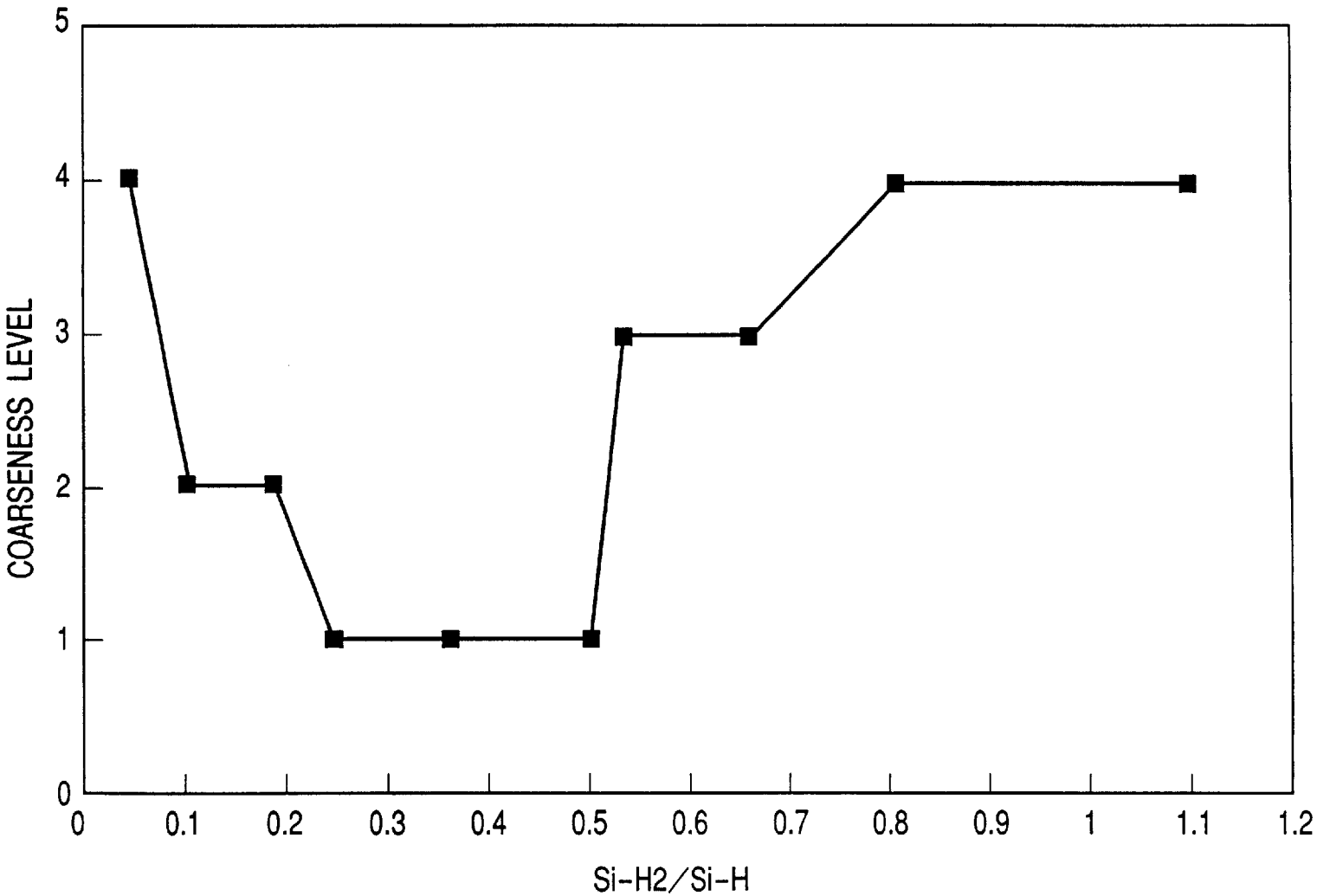
FIG. 15 is a graph illustrating the relationship between Si—$H_2$/Si—H (hydrogen bond level) and the coarse image level of a photosensitive member.

FIG. 12 shows the relationship between Eu and the temperature characteristic and FIGS. 13 and 14 show the relationships between D. O. S. and the optical memory level and the smeared image level respectively. FIG. 15 shows the relationship between the ratio of Si—$H_2$/Si—H and the coarse image level. The hydrogen contents of all the specimens were found between 10 and 30 atomic %.

As seen from FIGS. 12 through 15, it was found that excellent electrophotographs can be obtained when the characteristic energy (Eu) at the exponential Urbach's tail is between 50 and 60 meV as obtained from the subband gap light absorption spectrum and the D. O. S under the conduction band is between $1\times10^{14}$ and $1\times10^{16}$ $cm^{-3}$, while the hydrogen bond ratio (ratio of Si—$H_2$/Si—H) is between 0.2 and 0.5.

[Electric Resistivity]

Samples of surface layers were prepared in the same way and the electric resistance was measured by using a comb-shaped electrode.

The electric resistance was measured within a range of applied voltage between 250V and 1 kV by means of an MΩ tester available from HIOKI.

Meanwhile, specimens of photosensitive members carrying a surface layer same as the above samples were prepared and mounted in respective image-forming apparatus, which were then left respectively in the above listed environments for an appropriate period exceeding 72 hours to make the inside of the apparatus sufficiently and stably matched to the environment.

Thereafter, the electric characteristics of each of the photosensitive members was evaluated by means of the above potential sensor.

Additionally, a developing unit was installed and a running durability test operation was conducted by using 50,000 sheets of copy paper. Then, an imaging test was conducted continuously on 100 sheets of copy paper using a flat black chart, a half tone chart and a sheet of transfer medium as originals and the obtained images were evaluated for the generation of pin-hole leaks from the fine defects on the surface of the photosensitive member.

Figure 16:
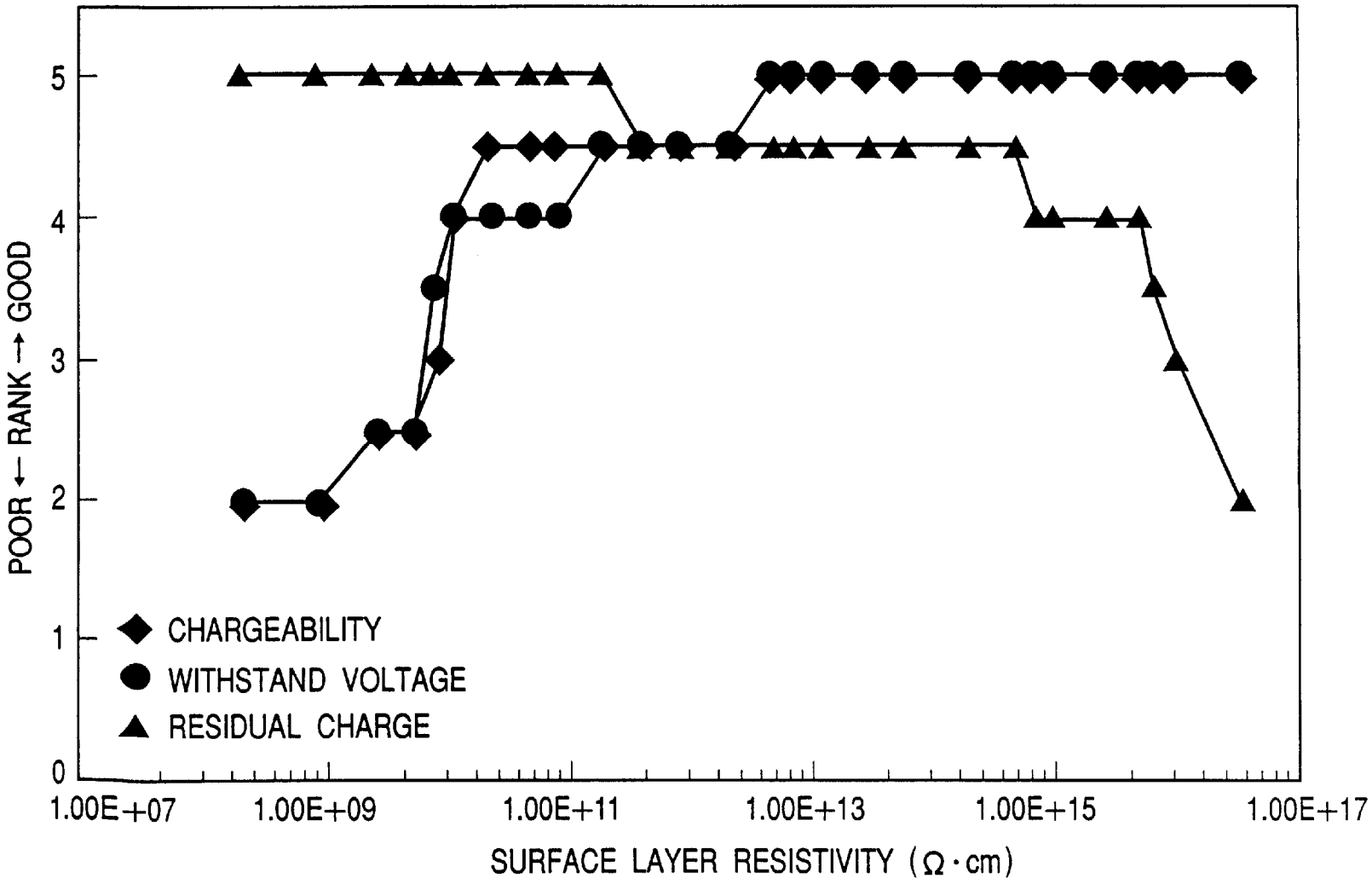
FIG. 16 is a graph illustrating the relationship between the surface resistivity and the rank of a photosensitive member.

As seen from FIG. 16 showing the results obtained from the samples of deposition film and photosensitive member, the electric resistance of the surface of the photosensitive member is preferably between. $1\times10^{10}$ and $5\times10^{15}$, more preferably between $5\times10^{12}$ and $5\times10^{14}$ in order to achieve excellent electric characteristics in terms of charge bearability, electrostatic charging efficiency and residual electric charge and prevent pin-hole leaks that can damage the surface layer as voltage is applied thereto.

Then, a potential sensor was installed in each of the image-forming apparatus after removing the developing unit and the cleaning unit for another test session to be conducted in the same environments for the same test items.

The above rating systems were used except for development and cleaning, and a non-paper running durability test operation was conducted for the same amount of copy paper to see the changes in the electric characteristics of the photosensitive member before and after the running durability test.

The environment protection heater was kept off during the running durability test operation.

The running durability test operation was conducted while monitoring the surface potential of the photosensitive member by means of a potential gauge arranged at a position other than that of the developing unit.

The electric characteristics of the photosensitive members after the running durability test without using copy paper were found unchanged as they are found within a tolerance of ±5%.

EXPERIMENT 2

In this experiment, a film forming apparatus adapted to use an VHF-PCVD technique as shown in FIG. 10 was used to prepare a photosensitive member to be used for an image-forming apparatus. Firstly, an aluminum cylinder with a diameter of ϕ80 that had been mirror-polished and another aluminum cylinder also with a diameter of ϕ80 but whose surface had been processed to produce undulations by the above described known technique were used. Then, a charge-injection impeding layer, a photoconductive layer and a surface layer were formed on each of the cylinders under the conditions listed in Table 2 below.

Additionally, various photosensitive members were prepared by changing the mixing ratio of $SiH_4$ and $H_2$ of the photoconductive layer and the discharge power.

Whenever necessary, the surface of the obtained specimens were polished to remove the undulations and the coarseness by means of SiC powder and diamond powder.

$CF_4$ was replaced by a-C: H for the surface layer of some of the specimens.

Meanwhile, as in Experiment 1, a 1 $\mu$m thick a-Si film was formed by deposition on a glass substrate (705: tradename, available from Coning) and an Si wafer arranged in a cylindrical holder under the conditions of preparing a photoconductive layer. Then, a comb-shaped Al electrode was formed by evaporation on the deposition film of the glass substrate and the characteristic energy at the exponential Urbach's tail (Eu) and the localized level density (D. O. S.) were observed by means of CPM, whereas the hydrogen content of the deposition film on the Si wafer was measured by means of FT-IR (Fourier transform infra-red absorption).

As in Experiment 1, it was found that excellent electrophotographs can be obtained when the characteristic energy (Eu) at the exponential Urpach's tail is between 50 and 60 meV as obtained from the subband gap light absorption spectrum, and the D. O. C. under the conduction band is between $1\times10^4$ and $1\times10^{16}$ $cm^{-3}$, while the hydrogen bond ratio (ratio of Si—$H_2$/Si—H) is between 0.2 and 0.5.

As in the case of Experiment 1, the electric resistance of the surface of the photosensitive member is preferably between $1\times10^{10}$ and $5\times10^{15}$, more preferably between $5\times10^{12}$ and $5\times10^{14}$ in order to achieve excellent electric characteristics in terms of charge bearability, electrostatic charging efficiency and residual electric charge and prevent pin-hole leaks that can damage the surface layer as voltage is applied thereto.

Now, the present invention will be described further by way of examples.

However, the present invention is by no means limited by the examples and any other configurations may be used for the purpose of the invention so long as such configurations provide the effects and the advantages of the present invention.

In the following examples, photosensitive members having an photoconductive layer with excellent values in terms of Eu, D. O. S and a surface layer with an excellent resistivity were used.

EXAMPLE 1

A film forming apparatus adapted to use an RF-PCVD technique as shown in FIG. 9 was used to prepare a photosensitive member to be used for an image-forming apparatus that comprises a charge-injection impeding layer, a photoconductive layer and a surface layer as in Experiment 1.

Identical photoconductive layers were prepared for the specimens of photosensitive members in such a way that they showed excellent values for D. O. S and Eu.

The photosensitive members had an outer diameter of ϕ80 as in Experiment 1.

The image-forming apparatus and the toner used in this example for evaluation were respectively modified NP6750 apparatus and NP6750 toner available from Canon Inc. as in the above experiments.

The surface layers of the specimens were differentiated by regulating the mixing ratio of the source gases and the discharge power. The prepared photosensitive members were polished to remove the undulations and the coarseness by means of SiC powder and diamond powder to see the surface free energy (γ) and other characteristic values.

The obtained characteristic values of photosensitive members A1 through F1 of this example and photosensitive members G1 through J1 of Comparative Example 1 as will be described hereinafter are listed in Table 3 below.

The surface free energy was determined for each specimen by means of contact angle gauge CA-S ROLL and computer software EG-11 as cited earlier (tradenames, available from Kyowa Kaimen).

The surface coarseness Rz was determined by means of surf coder SE-30D (tradename, available from Kosaka Research).

The photosensitive members were mounted in respective image-forming apparatus and operated to evaluate for optical memory, smeared image and image defects such as white spots and black spots in three different environments of N/N (25° C., 45% RH), H/H (35° C., 85% RH) and N/L (25° C., 10% RH).

For a running durability test operation, 20,000 sheets of copy paper were used with TC-Al Test Chart (FY9-9045-000: tradename, available from Canon Inc.) for each specimen.

The surface of the photosensitive member was tested for defective cleaning and surface free energy before and after the test and each time after running several thousand sheets.

In this example, the abutment pressure of applying the cleaning blade of the cleaning unit to the photosensitive member was regulated to 5 to 50 gf/cm as cited earlier.

[Defective Cleaning]

To evaluate the defective cleaning by checking out the presence or absence of "fog" produced on flat white by toner by means of Tricolor [black/half tone/white] Test Chart (FY-9-9017-000: tradename, available from Canon Inc.) and NA-7 Test Chart (FY-9-9060-000: tradename, available from Canon Inc.).

If the produced images were differentiated due to the environmental difference, the image with the worst image quality was used for the evaluation.

More specifically, the tricolor chart was used for imaging in the different environments, and the obtained image was evaluated by checking out the clearness of the boundaries of different colors, the presence or absence of stripes of leaked toner running in the sense of rotation of the photosensitive member and fog.

The fog on the image was evaluated by using a reflection densitometer (Reflectometer Model TC-6DS: tradename, available from Tokyo Denshoku) and obtained the value of Ds-Dr, where Ds represents the worst reflected density of white of transfer medium after the imaging, and Dr represents the average reflected density of white of transfer medium before the imaging.

The following rating standards were used.

5. excellent in terms of fogging:
   Ds-Dr less than 1.0%
4. good in terms of fogging:
   Ds-Dr between 1.0 and 1.3%
3. permissible in terms of fogging:
   Ds-Dr between 1.3 and 1.7%
2. usable in terms of fogging:
   Ds-Dr between 1.7 and 2.0%
1. poorly usable in terms of fogging:
   Ds-Dr more than 2.0%

Then the cleaning unit was dismounted and the cleaning blade was checked for chipping by checking it out using a microscope and by measuring the density of the produced image.

The residual toner on the surface of the photosensitive member was also checked at the time of sampling the produced images.

The image density was determined by means of a SPI filter, using a Macbeth Density Meter RD-918 (tradename, available from Macbeth).

Firstly, the above chart was used for sampling the images and the presence or absence of black stripes was checked in the sense of rotation of the photosensitive member.

Secondly, a piece of adhesive such as sticky tape was applied to the surface of the photosensitive member at a position that had passed by the cleaning unit and the adhesive was made to stick to the copy paper. Then, the reflection density of the adhesive was measured by means of a reflection densitometer as in the case of fog evaluation. The average of the measured values is expressed by Dt.

On the other hand, the surface of the photosensitive member was cleaned by dry wiping or wet wiping using alcohol to remove the residual toner and a same test was conducted to evaluate the effect of the cleaning operation. The value obtained by the reflection densitometer is expressed by Dn.

As in the case of fog evaluation the cleaning was evaluated as defective when Dt-Dn is greater than 2.0% or when black stripes were produced on the image by toner and running in the sense of rotation of the photosensitive member.

The following rating standards were used to evaluate defective cleaning.

5. excellent in terms of defective cleaning
   (no black stripes due to the blade and Dt-Dn less than 1.0%)
4. good in terms of defective cleaning
   (no black stripes due to the blade and Dt-Dn between 1.0 and 1.3%)
3. permissible in terms of defective cleaning
   (more than three black stripes less than 1.5 mm-long and Dt-Dn between 1.3 and 1.7%)
2. usable in terms of defective cleaning
   (more than five black stripes less than 2.0 mm-long and Dt-Dn between 1.7 and 2.0%)
1. poorly usable in terms of defective cleaning
   (black stripes exceeding the above definition and Dt-Dn greater than 2.0%)

Figure 19:
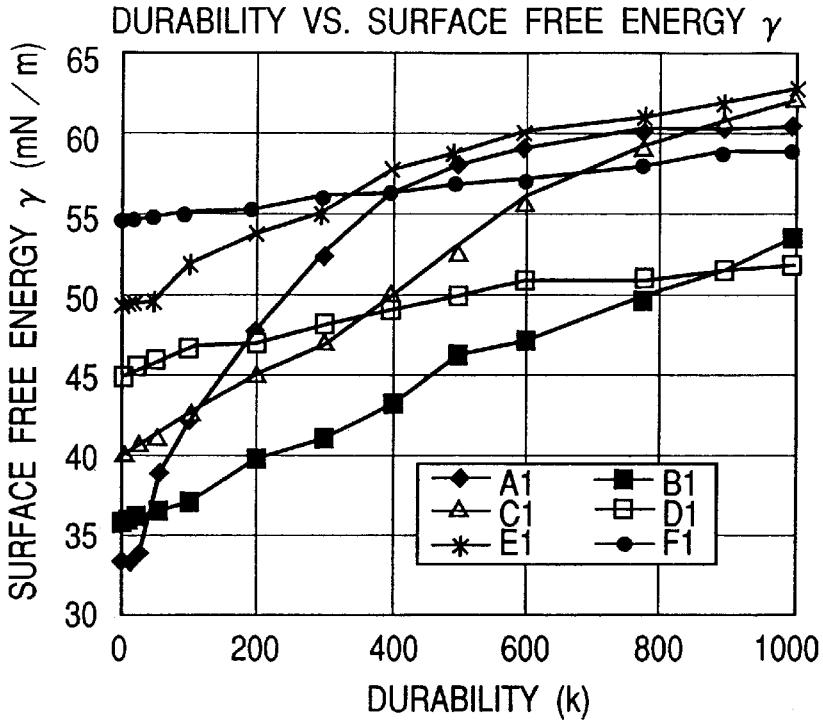
FIGS. 19, 21, 23, 25, 27, 29 and 31 are graphs illustrating the relationship between the running number of sheets (durability) and the surface free energy γ in respective durability tests.

Table 4 below and FIG. 19 show the surface free energy (γ[mN/m]) of the specimens of photosensitive members.

Figure 20:
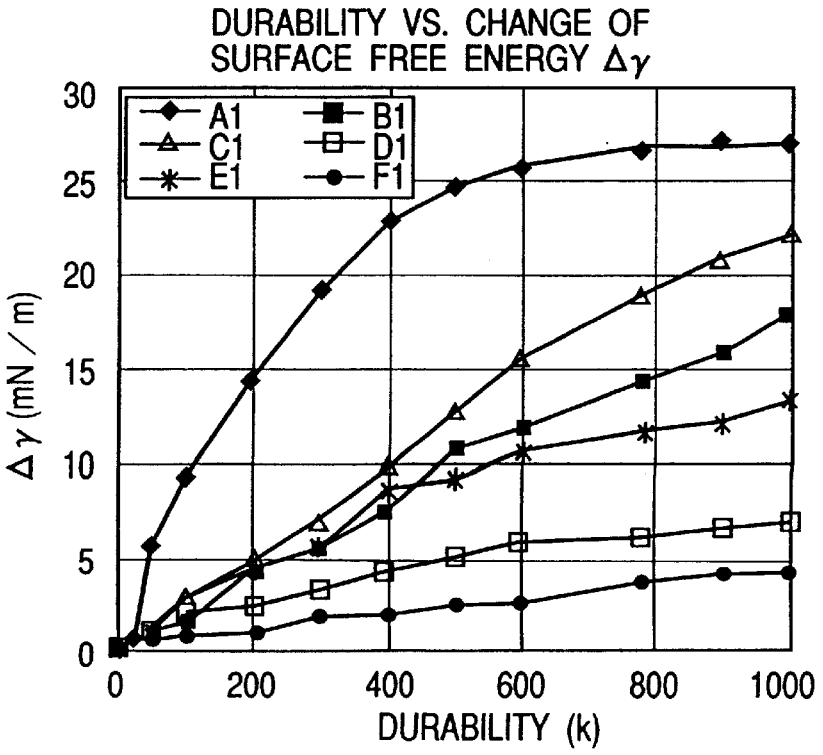
FIGS. 20, 22, 24, 26, 28, 30 and 32 are graphs illustrating the relationship between the running number of sheets (durability) and the variation (Δγ) of surface free energy in respective durability tests.

The variation Δγ designating the change in γ value from the initial one for each of the specimens is spotted in FIG. 20.

Table 5 below shows the results of evaluation conducted for the image quality, the cleaning unit and the photosensitive member before and after the running durability test. The rating symbols used in Table 5 are described below. "◎": excellent (excellent cleaning effect, no chipped blade, rating of 5 for defective cleaning including fogging on the image, no degradation of smeared image) "○": good (good cleaning effect than ever on the image, no chipped blade, rating of 5 for defective cleaning) "●": poor (cleaning effect as or worse than ever on the image, rating of 3, 2 or 1 for defective cleaning (depending on the degree of defective cleaning))

Figure 17:
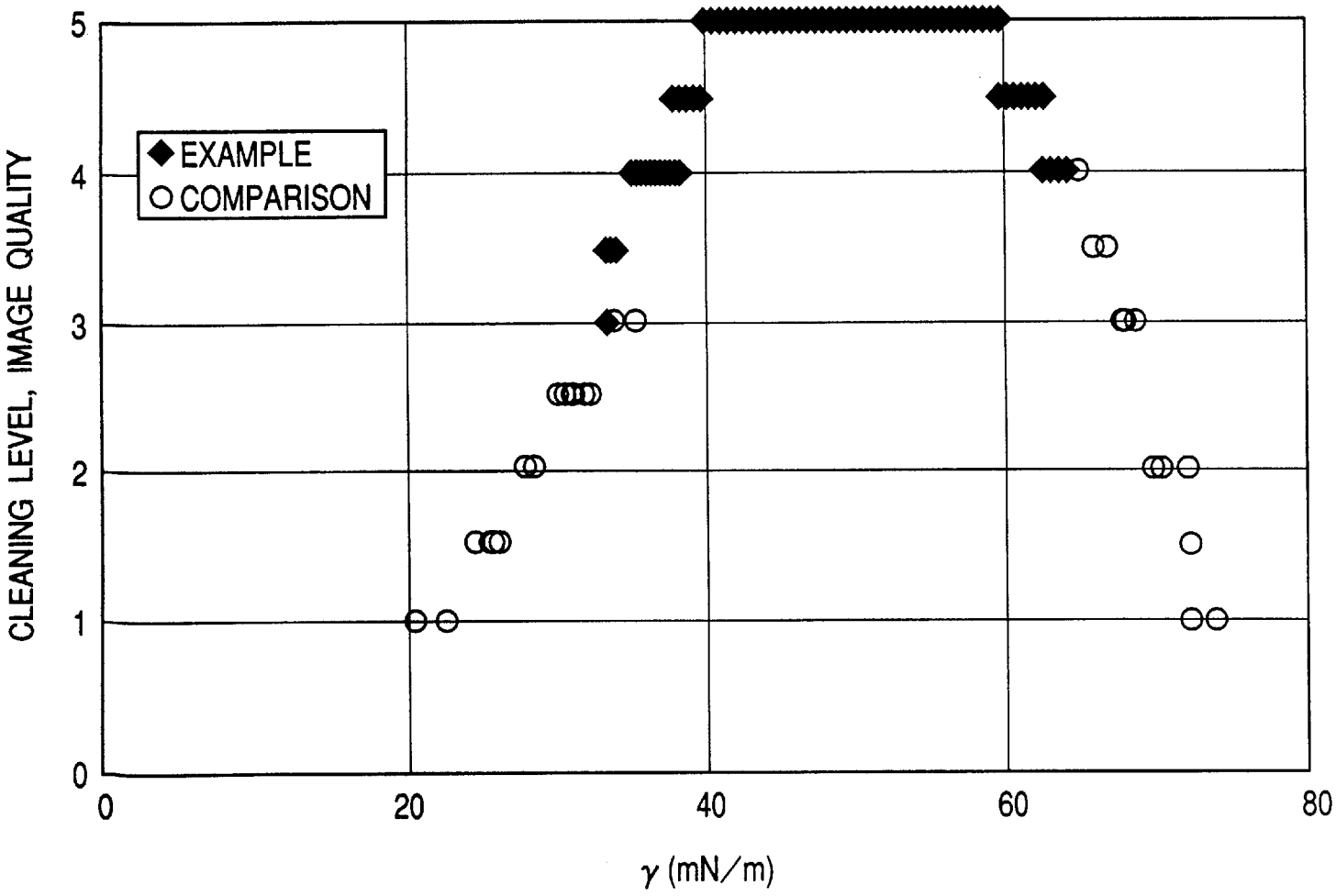
FIG. 17 is a graph illustrating the relationship between the surface free energy γ and the cleaning feasibility/image quality.
Figure 18:
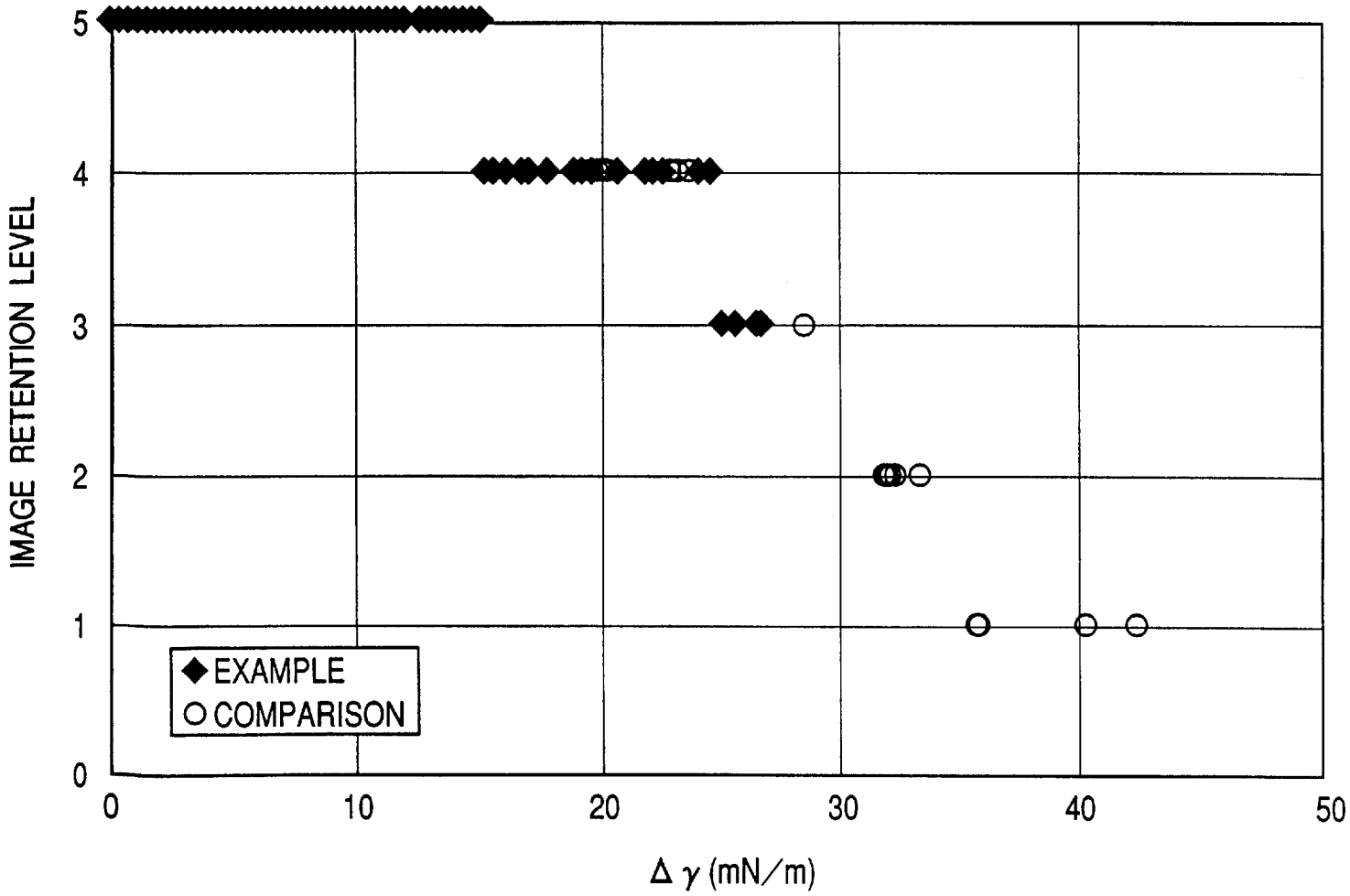
FIG. 18 is a graph illustrating the relationship between the variation Δγ of surface free energy γ and the image quality.

FIG. 17 shows the correlation between the surface free energy γ and the cleaning durability, and FIG. 18 shows the correlation between Δγ and the cleaning stability.

Table 6 below shows the results of evaluation conducted for the cleaning stability. The rating symbols used in Table 5 are described below. "◎": excellent (no change of rating for smeared image, the linear pressure of the cleaning blade required for cleaning being found within the initial range) "○": good (change of 1 to 2 in the rating for smeared image, the linear pressure of the cleaning blade required for cleaning being found within a safety range) "574 ": poor as or worse than ever on the image (change of 2 or more in the rating for smeared image, the linear pressure of the cleaning blade required for cleaning being found to be the conventional level)

As seen from FIGS. 17 through 20 and the above tables, a good cleaning feasibility was obtained without fusion when the value of γ was found between 35 and 65 mN/m, preferably between 40 and 60 mN/m.

The cleaning feasibility was found to be highly stable to provide an excellent latitude for the operating conditions of the cleaning unit when the value of γ was found in less than 25/m, preferably less than 150 mN/m.

EXAMPLE 2

A film forming apparatus adapted to use an VHF-PCVD technique as shown in FIG. 10 was used to prepare a photosensitive member to be used for an image-forming apparatus. Firstly, an aluminum cylinder that had been mirror-polished and another aluminum cylinder whose surface had been processed to produce undulations by the above described known technique were used. Then, photosensitive members having an outer diameter of ϕ80 and comprising a charge-injection impeding layer, a photoconductive layer and a surface layer were prepared under the conditions listed in Table 7 below.

Specimens A2 through F2 of photosensitive member listed below were prepared by regulating the source gases and the discharge power of the photoconductive layer and the surface layer.

Figure 21:
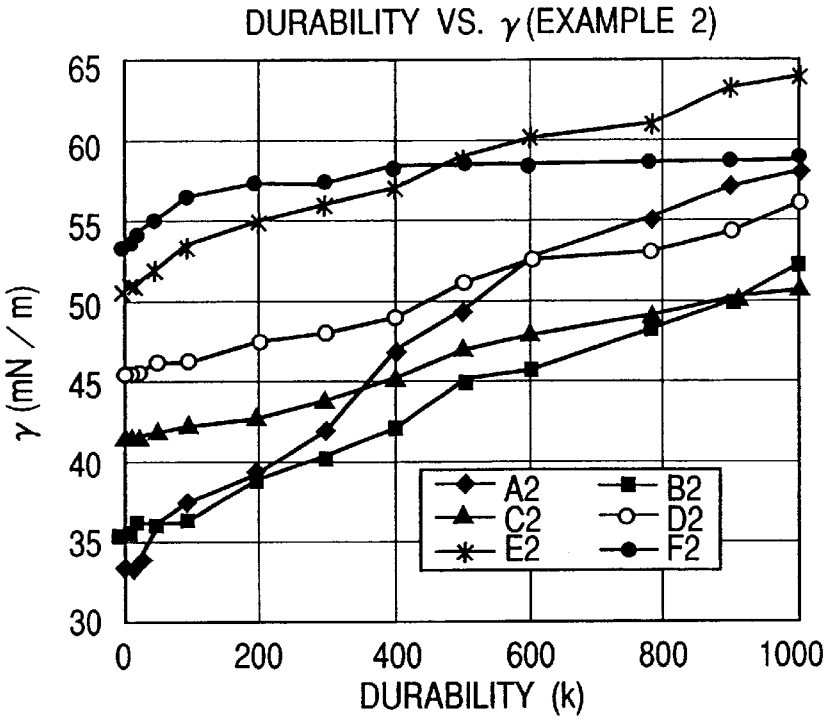
Figure 22:
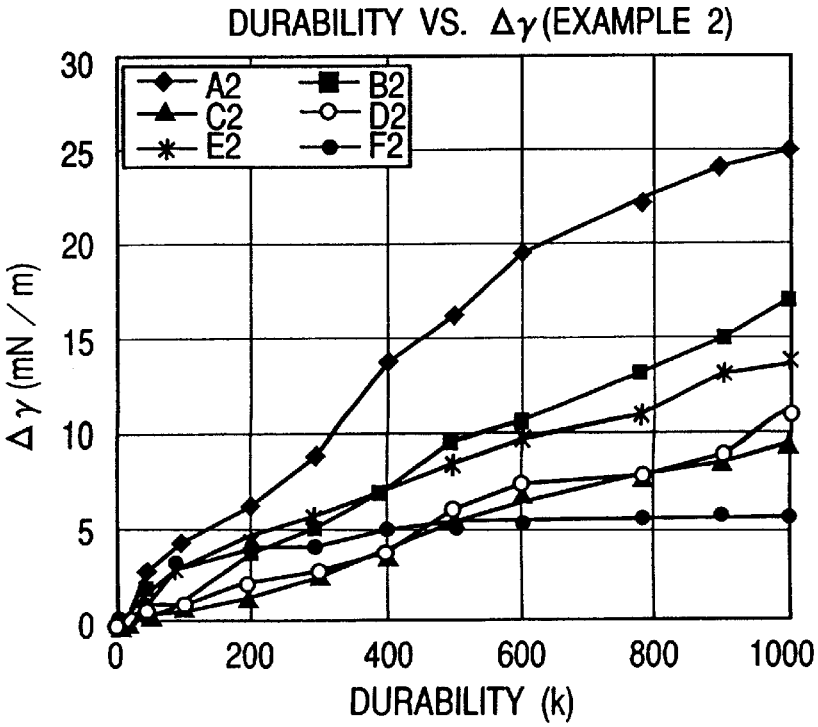

Table 8 below and FIG. 21 show the surface free energy (γ[mN/m]) of the photosensitive members and FIG. 22 shows the variation Δγ, change in γ compared to the initial value.

The prepared photosensitive member were mounted in respective image-forming apparatus depending on the outer diameter as in Example 1 above and tested for durability to obtain satisfactory results as in Example 1. Table 9 below show the obtained results of the durability test. The chipping of the blade due to the undulations of the surface of the photosensitive member was found to have been reduced or eliminated.

Table 10 below shows the results obtained for the cleaning stability of the specimens.

FIG. 17 shows the correlation between the surface free energy γ and the cleaning durability, and FIG. 18 shows the correlation between Δγ and the cleaning stability obtained on the basis of the rating system described above in Experiments 1 and 2.

As seen from FIGS. 17 through 20 and the above tables, a good cleaning feasibility was obtained when the value of γ was found between 35 and 65 mN/m, preferably between 40 and 60 mN/m.

The cleaning feasibility was found to be highly stable to provide an excellent latitude for the operating conditions of the cleaning unit when the value of Δγ was found in less than 25 mN/m, preferably less than 15 mN/m.

EXAMPLE 3

A film forming apparatus adapted to use an VHF-PCVD technique as shown in FIG. 10 and aluminum cylinders that had been mirror-polished to diameter of 30, 80 and 108 and those whose surface had been processed to produce undulations by the above described known technique were used said cylinders. Then, a charge-injection impeding layer, a photoconductive layer and a surface layer were formed on each of the cylinders under the conditions listed in Table 11 below.

Figure 23:
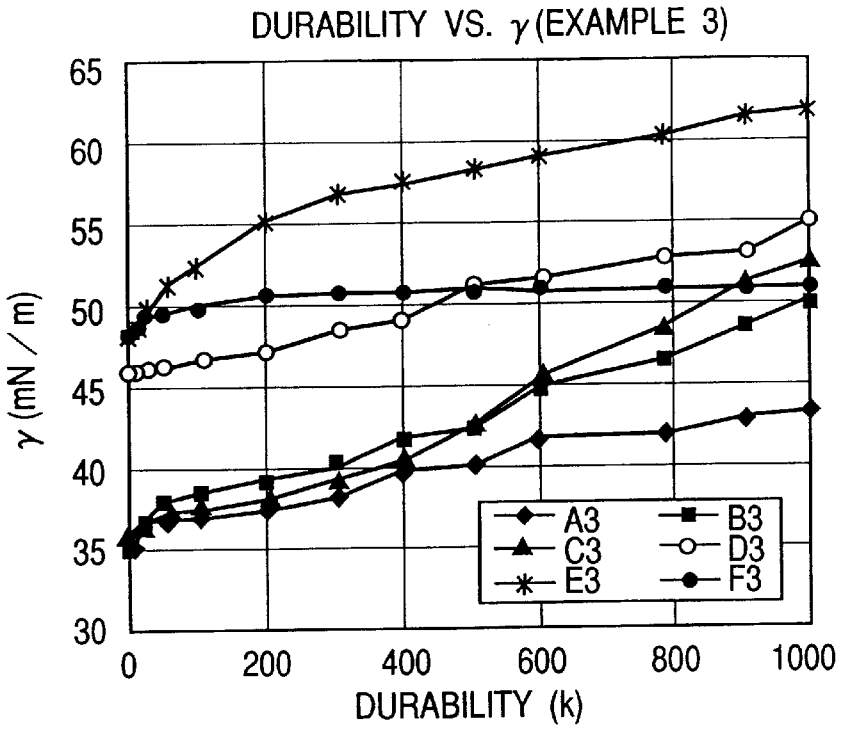
Figure 24:
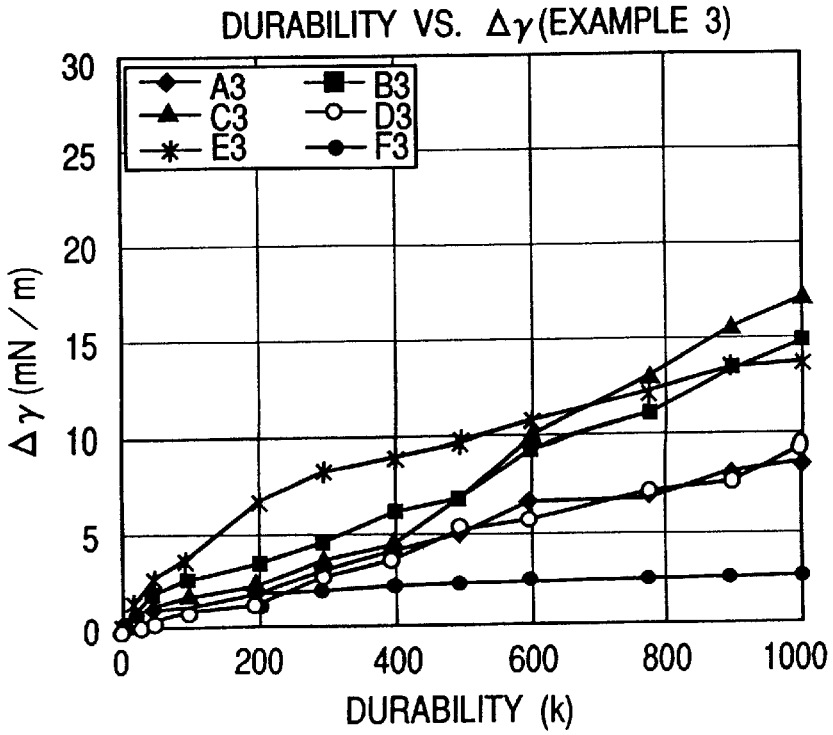

Specimens A3 through J3 of photosensitive member were prepared by regulating the source gases and the discharge power of the photoconductive layer and the surface layer. Table 12 below and FIG. 23 show the surface free energy (γ[mN/m]) of the photosensitive members and FIG. 24 shows the variation Δγ, change in γ compared relative to the initial value.

The prepared photosensitive members were mounted in a manner as described below. The photosensitive member with ϕ30 was mounted in image-forming apparatus A (GP5511: tradename, available from Canon Inc., modified for the test) The photosensitive member with ϕ80 was mounted in image-forming apparatus B (NP7750: tradename, available from Canon Inc., modified for the test)

The photosensitive member with ϕ108 was mounted in image-forming apparatus C (NP6085: tradename, available from Canon Inc., modified for the test)

The prepared photosensitive member showed excellent test results when γ was between 35 and 65 mN/m as in Example 1 and 2.

As a result of durability test, the specimen using a-C: F for the surface layer was found better than the one using a-C: H for the surface layer. No chipping of the blade due to the undulations of the surface of the photosensitive member was found as in Example 1.

Table 14 below shows the results obtained for the cleaning stability of the specimens.

FIG. 17 shows the correlation between the surface free energy γ and the cleaning durability, and FIG. 18 shows the correlation between Δγ and the cleaning stability obtained on the basis of the rating system described above in Experiments 1 and 2.

As seen from FIGS. 17 through 20 and the above tables, a good cleaning feasibility was obtained when the value of γ was found between 35 and 65 mN/m, preferably between 40 and 60 mN/m.

The cleaning feasibility was found to be highly stable to provide an excellent latitude for the operating conditions of the cleaning unit when the value of Δγ was found in less than 25/m, preferably less than 150 mN/m.

As seen from the results of Example 1 through 3, a photosensitive member having an a-SiC or a-C type surface layer is remarkably hard on the surface and highly durable.

A surface layer made of an a-Si type material such as a-SiC or an a-C type material is very head and durable to repeated use so that it can be effectively used for a high speed machine and enjoy a long service life.

A surface layer made of an a-C type material is also excellent in terms of lubricating effect and shows a high cleaning feasibility with a low load to consequently reduced the load of the cleaning unit and make the entire system to a prolonged service life.

A surface layer containing fluorine is highly water-repellent and operates effectively to prevent smeared images.

The improved cleaning feasibility achieved by the present invention reduces the frequency of replacement of the members surrounding the photosensitive member and, as a combined effect, a photosensitive member having a prolonged service life according to the invention can greatly improve the service life of the electrophotographing apparatus and reduce the consumption of resources by reducing the raise of producing wastes.

EXAMPLE 4

The OPC of this example comprises a substrate, a charge-generating layer and a charge-transporting layer as well as a surface layer and an intermediary layer provided whenever necessary.

Specimens of OPC photosensitive member having different surface conditions were prepared in this example.

In preparing the specimens, the surfaces free energy γ was regulated and the conditions for the preparation were selected so as to make the specimens have no substantial differences in terms of electric characteristics and surface hardness.

While a surface layer was not formed specifically on the specimens, the effects obtained in the example are not adversely affected if a surface layer is formed.

The photosensitive members were made to have an outer diameter of ϕ30 and mounted into respective image-forming apparatus (GP5511: tradename, available from Canon Inc., modified for the test). Toner adapted to GP5511 was used.

Figure 25:
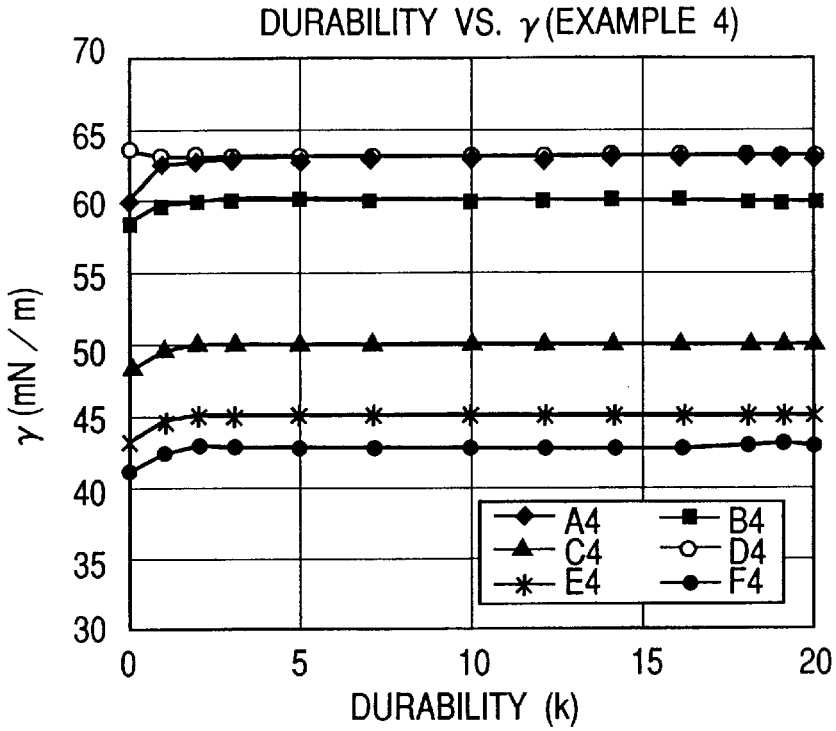
Figure 26:
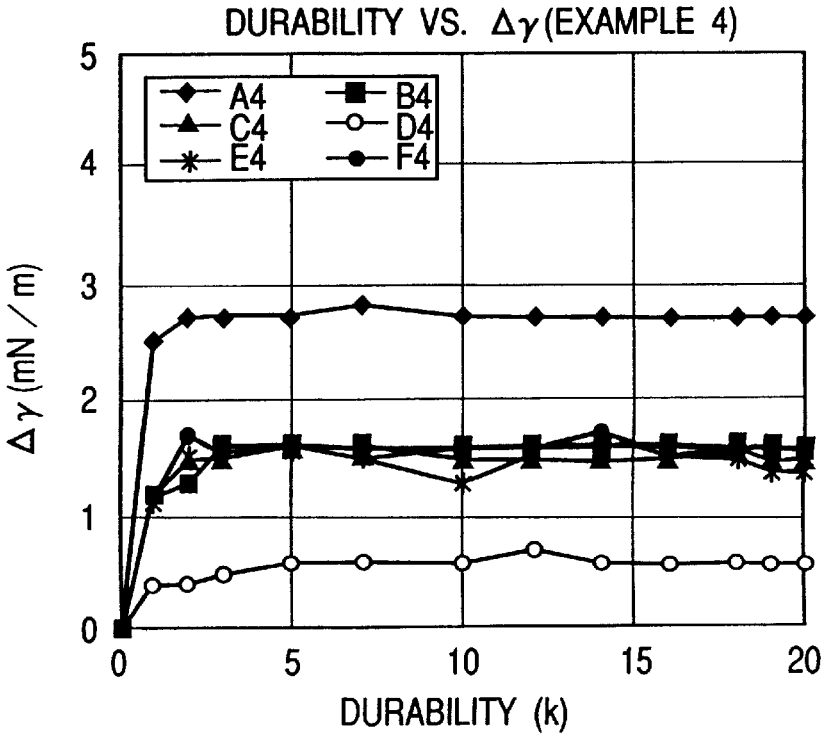

The surface free energy (γ) was measured on the photosensitive members A4 through F4. After mounting the photosensitive members on the respective apparatus, a running durability test was conducted as in Example 1 and evaluated for the performance. Tables 15 and 16 and FIGS. 25 and 26 show the obtained results.

In this example, the specimens maintained the initial performance level in terms of both cleaning feasibility and image quality.

The rate of scraping of any of the photosensitive members was reduced to prove that the use of OPC is effective to prolong the service life of a photosensitive member. No fusion of toner and no chipping of the blade were observed.

This may be because, the surface is constantly refreshed as it is scrubbed and scraped and, as a result, the surface condition becomes less fluctuating.

EXAMPLE 5

A surface layer was formed on the photosensitive members in Example 4.

The surface layer was made of a material containing fluorine such as polytetrafluorethylene (PTET, "Teflon").

As a result of preparing various photosensitive members with varied average particle size and content of PTFE, it was found that an excellent photosensitive member can be obtained in terms of image quality and surface hardness when the average particle diameter of fluorine resin is smaller than that of toner and preferably less than 3 μm, more preferably less than 1 μm, most preferably less than 0.5 μm.

The content of fluorine resin is preferably between 5 and 70 wt % based on the total weight of the surface layer from the viewpoint of surface free energy γ, charge bearability and surface durability.

While a photosensitive member having a surface without containing fluorine atoms and/or having a fluorine coat layer operates excellently in terms of water-repellency and cleaning feasibility, a surface layer containing fluorine atoms and/or having a fluorine coat shows an advantage of confining the surface free energy γ to an effective range and providing an excellent smoothness and an enhanced durability.

Figure 27:
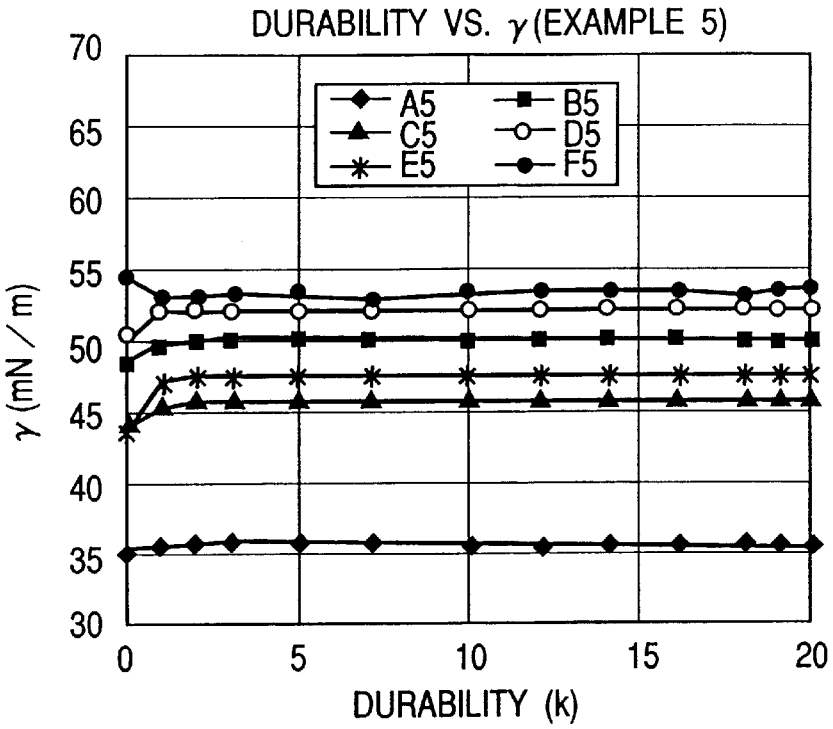
Figure 28:
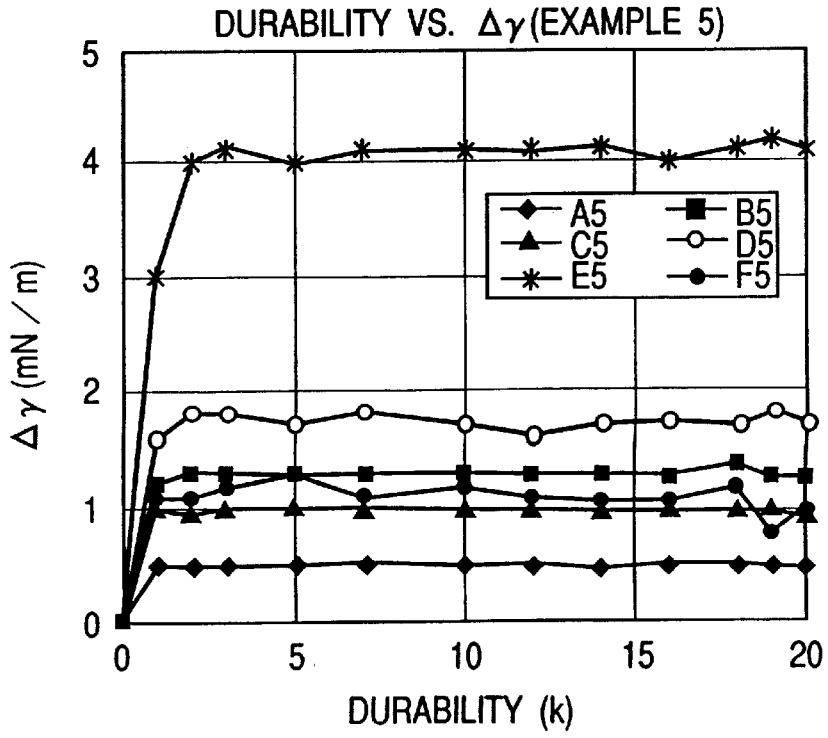

The photosensitive members A5 through J5 of this example were tested for surface free energy γ by using toner same as that in Example 4 and also for durability and cleaning feasibility as in Example 1. Tables 18 and 19 and FIGS. 27 and 28 show the obtained results.

The specimens of this example showed a level of surface free energy γ found in a desired range and also a good cleaning feasibility.

In the durability test, the specimens of this example having a fluorine coated surface layer performed better than the specimens of Example 3 having no fluorine coated surface layer. Particularly, the specimens of this example did not produce any abnormal vibration noise at the blade due to the friction of the blade and the photosensitive member when the operating speed and the environment for the durability test were made to change. Additionally, no chipping of blade was observed as in Example 4.

Table 20 below shows the stability of cleaning feasibility.

FIG. 17 shows the correlation between the surface free energy γ and the cleaning durability and FIG. 18 shows the correlation between Δγ and the cleaning stability obtained on the basis of the rating system described above in Experiments 1 and 2.

As seen from FIGS. 17 through 20 and the above tables, a good cleaning feasibility was obtained when the value of γ was found between 35 and 65 mN/m, preferably between 40 and 60 mN/m.

Additionally, Δγ was found to be less than 15 mN/m and the stability of cleaning feasibility was also found to be satisfactory.

This may be because, the surface is constantly refreshed as it is scrubbed and scraped and, as a result, the surface condition becomes less fluctuating.

As described above, the cleaning conditions including the cleaning blade pressure affect the service life of the entire system including the cleaning unit.

In this example, the cleaning feasibility was found to be highly stable to provide an excellent latitude for the operating conditions of the cleaning unit.

Additionally, it was found that a photosensitive member having a fluorine coated surface is highly water-repellent and shows an effect of eliminating smeared images.

While each of the photosensitive members was made to contain fluorine in a dispersed state in this embodiment, a photosensitive member may alternatively be made to have a fluorine-containing surface layer by applying a paint containing fluorine atoms.

The photosensitive members carrying a fluorine coat performed also satisfactorily. When the coat was totally removed by friction, they operated exactly same as OPC photosensitive members having no coat.

It is desirable to control the charge bearability and the sensitivity of the photosensitive member according to the operating conditions of the electrophotographing apparatus by using fluorine in a dispersed state or in a surface coat with a selected concentration. When the surface layer is coated with powdery fluorine resin, the fluorine concentration should be selected by taking the uniformity of charge bearability and the image quality into consideration.

Additionally, fluorine may be used in a dispersed state with an uppermost fluorine coat, although the above effects can be achieved if fluorine is used only in a dispersed state or as an uppermost coat.

The abutment pressure, or the cleaning blade pressure, under which the cleaning blade was made to abut the photosensitive member in the above examples was between 5 and 100 gf/cm.

Note that although an abutment pressure of 15 gf/cm was used for the above tables, equally excellent results were obtained with other abutment pressure by appropriately controlling γ and Δγ.

Now, a comparative example to be compared with the above example will be described.

COMPARATIVE EXAMPLE 1

[Photosensitive Member and Toner outside Specified Values]

Specimens G1 through J1 of a-Si photosensitive members were prepared in a manner as described in Example, varying the discharge power and the mixing ratio of source gases particularly when forming the surface layer.

Table 21 shows the surface free energy (γ[mN/m]) of each of the specimens.

Figure 29:
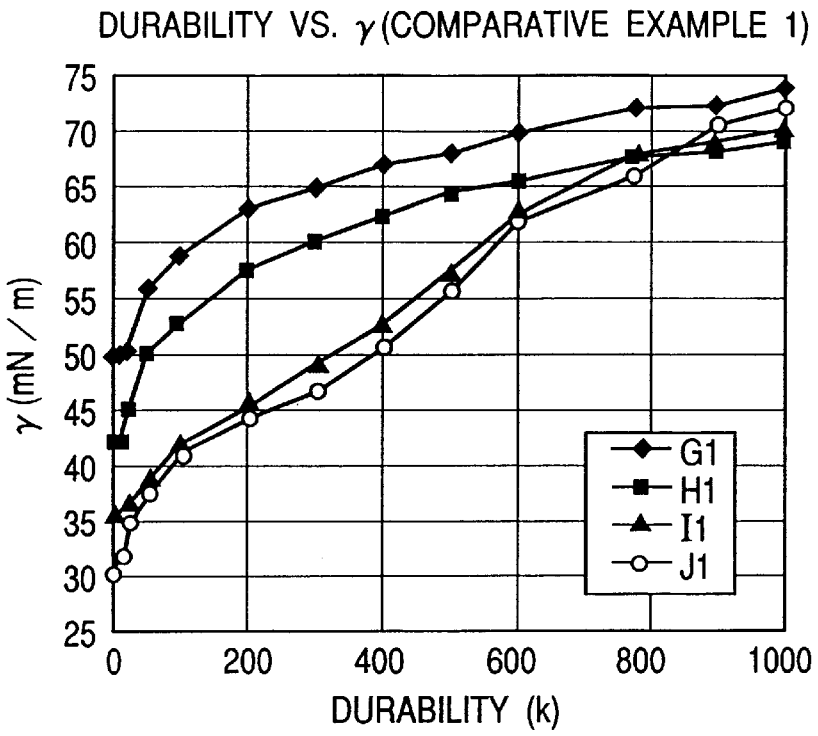
Figure 30:
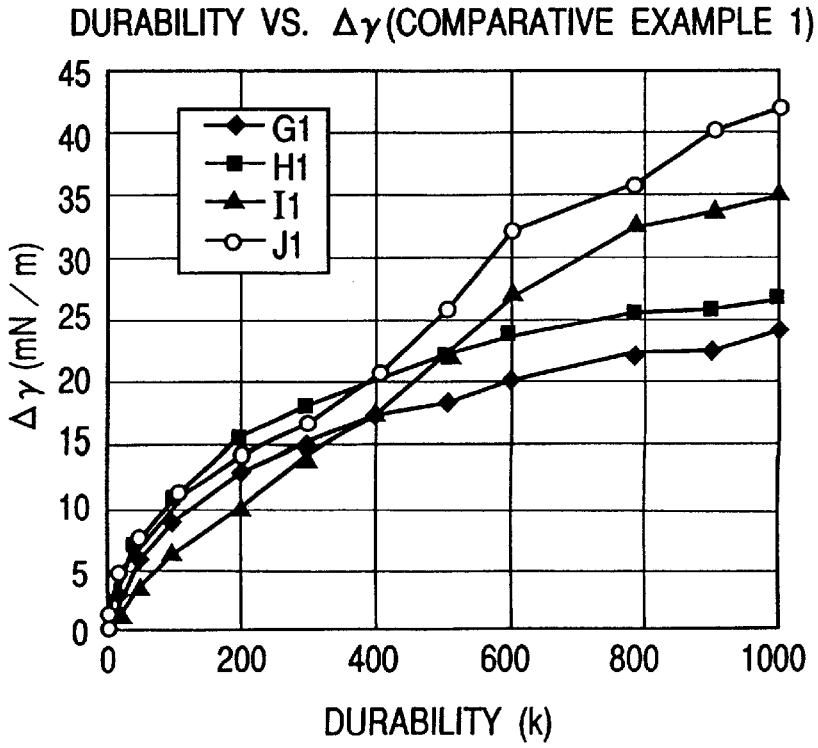

Tables 22 and 23 and FIGS. 29 and 30 show the performance before and after a durability test.

Fused toner frequently appeared and chipped and defective cleaning blades were observed frequently in this comparative example where the surface free energy (γ) exceeded 65 [mN/m] during the durability test.

In the case of Specimens H1 and J1 whose variation (Δγ) of surface free energy exceeded 25 [mN/m] during the durability test, the conditions required for the cleaning operation changed significantly and the operating conditions of the cleaning blade including the abutment pressure had to be modified in the final stages of the durability test.

COMPARATIVE EXAMPLE 2

OPCs (organic photosensitive members) G2 through I2 were prepared in this comparative example by varying the resin composition and the temperature as well as other conditions as in Example 5.

Figure 31:
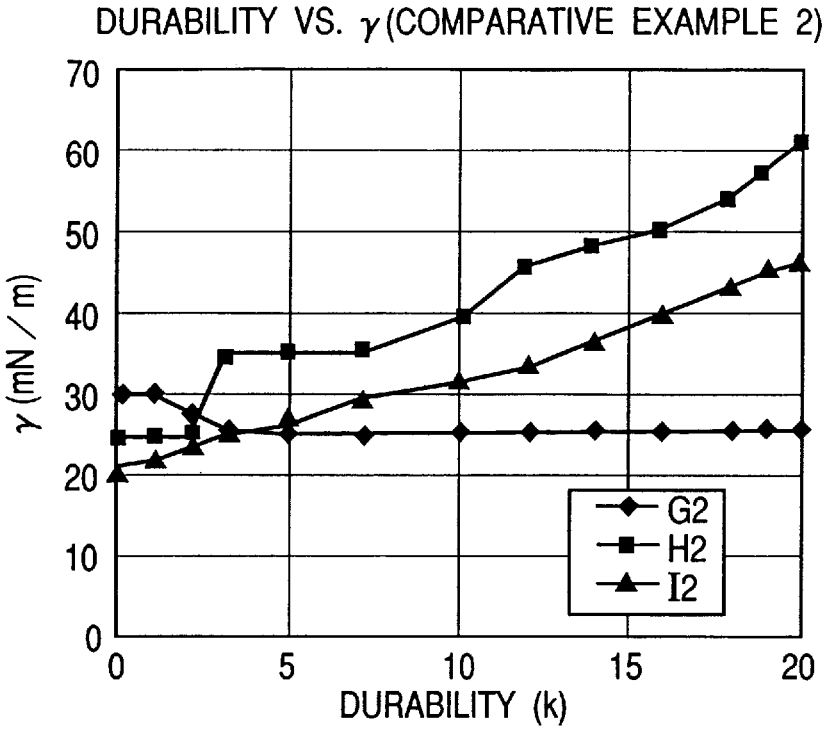
Figure 32:
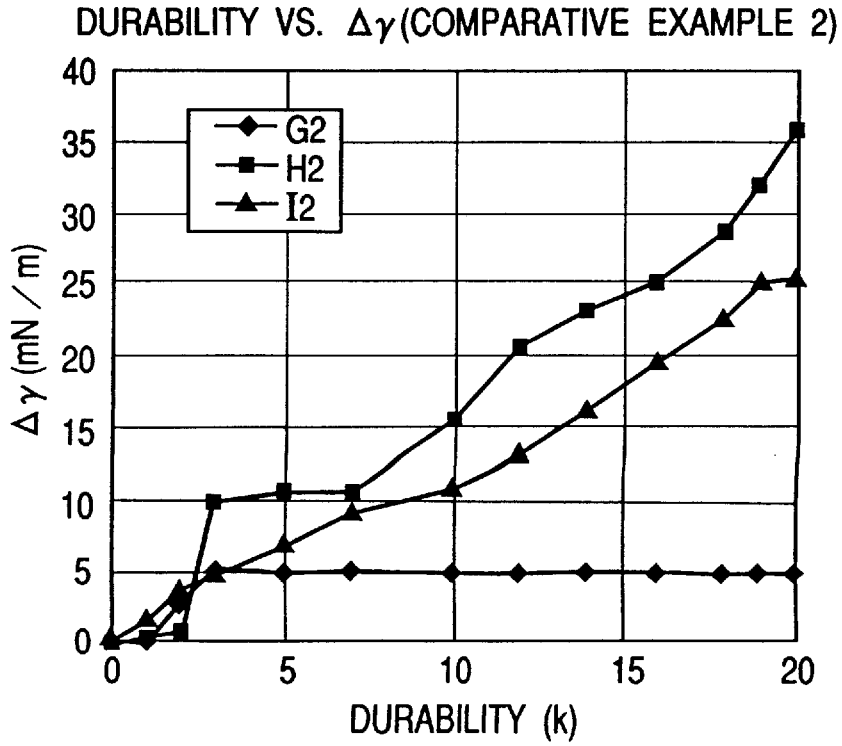

Tables 24 and 25 and FIGS. 31 and 32 show the surface free energy (γ[mN/m]) of each of the specimens G2 through I2.

Table 26 shows the stability of cleaning feasibility.

No fused toner nor chipped cleaning blades due to the projections and the fusion of toner on the surface of the photosensitive member were observed in this comparative example, where the surface free energy (γ) was lower than 35 [mN/m] during the durability test.

However, on the other hand, the volume of toner on the site of abutment of the cleaning blade and the surface of the photosensitive member was found to have been reduced in the durability test depending on the operating speed and the selected environment to produce defective phenomenons including burring, abnormal noise and filming on the part of the cleaning blade. Thus, the latitude for the operating conditions was reduced.

Additionally, the photosensitive member tended to be scrubbed unevenly to produce locally smeared images.

In the case of H2 and I2 with Δγ exceeding 25 mN/m, the conditions required for the cleaning operation including the abutment pressure of the cleaning blade were found to have been changed during the durability test.

Note that although an abutment pressure of 15 gf/cm was used for the above tables, equally excellent results were obtained with other abutment pressure by appropriately controlling γ and Δγ.

As described above in detail, the present invention can effectively dissolve the above pointed out problems of electrophotographing apparatus particularly those of digital electrophotographing apparatus.

1. The load of cleaning necessary for separating the photosensitive member and the foreign matters including toner on the surface of the photosensitive member can be reduced by confining the surface free energy (γ) of the surface of the photosensitive member, which is the wetting effect of the surface.

2. As the load of the photosensitive member is reduced, the service life of the photosensitive member is prolonged particularly in the case of an OPC or a photosensitive member carrying a surface coat of thin film.

3. As the load of the cleaning unit including the cleaning blade is reduced, the regular maintenance service of the cleaning blade can be conducted with extended intervals. This effect is particularly advantageous to reduce the labor cost and the cartridge cost and also to reduce the size of the cleaning unit and hence the image-forming apparatus itself.

4. The motor for driving the photosensitive member can be down-sized with the benefit of energy saving.

5. A good image quality can be achieved to broaden the latitude for fusion by using a photosensitive member showing good temperature characteristics and having no drum heater. Thus, the use of a photosensitive member without a drum heater provides the benefit of energy saving.

Additionally, an unexpected effect of reduction in the rate of production of waste toner was obtained.

This may be because the reduction in the wetting effect of the photosensitive member reduced the residual toner. Thus, the cartridge and other components may be further downsized.

Still additionally, any uneven scraping of the photosensitive member could be eliminated.

This may be because the foreign matters including toner located between the photosensitive member and toner were mobilized highly effectively.

The present invention is not limited to the above examples, which may be modified without departing from the scope of the invention.

TABLE 1

| | Charge-injection impeding layer | Photo-conductive layer | Surface layer |
|---|---|---|---|
| Content and flow rate of gases | | | |
| $SiH_4$[SCCM] | 100 | 200 | 10 |
| $H_2$[SCCM] | 300 | 800 | |
| $B_2H_6$[PPM] (vs. $SiH_4$) | 2000 | 2 | |
| NO[SCCM] | 50 | | |
| $CH_4$[SCCM] | | | 500 |
| Temperature of substrate [° C.] | 290 | 290 | 2 0 |
| Internal pressure [Pa] | 50 | 65 | 65 |
| Power [W] | 500 | 800 | 300 |
| Film thickness [μm] | 3 | 30 | 0.5 |

TABLE 2

| | Charge-injection impeding layer | Photo-conductive layer | Surface layer |
|---|---|---|---|
| Content and flow rate of gases | | | |
| $SiH_4$[SCCM] | 150 | 200 | |
| $SiF_4$[SCCM] | 5 | 3 | |
| $H_2$[SCCM] | 500 | 800 | 450 |
| $B_2H_6$[PPM] (vs. $SiH_4$) | 1500 | 3 | |
| NO[SCCM] | 10 | | |
| $CH_4$[SCCM] | 5 | | 0→200→200 |
| $CF_4$[SCCM] | | | (0→300→300) |
| Temperature of substrate [° C.] | 300 | 300 | 250 |
| Internal pressure [Pa] | 4 | 1.3 | 2.7 |
| Power [W] | 200 | 600 | 800 |
| Film thickness [μm] | 2 | 30 | 0.5 |

TABLE 3

| | D.O.S [$cm^{-3}$] | Eu [meV] | Surface resistance [Ω · cm] | Surface Rz [pm] | γ [mN/m] |
|---|---|---|---|---|---|
| A1 | $4 \times 10^{15}$ | 53 | $5.0 \times 10^{10}$ | 0.12 | 40.3 |
| B1 | | | $3.1 \times 10^{11}$ | 0.24 | 42.8 |
| C1 | | | $1.5 \times 10^{12}$ | 0.21 | 53.0 |
| D1 | | | $7.8 \times 10^{12}$ | 0.46 | 46.1 |
| E1 | | | $1.3 \times 10^{13}$ | 0.34 | 56.3 |

TABLE 3-continued

| | D.O.S [$cm^{-3}$] | Eu [meV] | Surface resistance [Ω · cm] | Surface Rz [pm] | γ [mN/m] |
|---|---|---|---|---|---|
| F1 | | | $5.1 \times 10^{13}$ | 0.10 | 43.3 |
| G1 | | | $8.8 \times 10^{13}$ | 0.40 | 60.0 |
| H1 | | | $1.4 \times 10^{14}$ | 0.35 | 58.2 |
| I1 | | | $9.8 \times 10^{14}$ | 0.28 | 47.5 |
| J1 | | | $3.1 \times 10^{15}$ | 0.30 | 43.9 |

TABLE 4

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A1 | 33.4 | 33.4 | 34.0 | 38.9 | 42.5 | 47.8 | 58.1 | 60.3 |
| B1 | 35.6 | 35.7 | 36.1 | 36.3 | 37.0 | 39.8 | 46.2 | 53.5 |
| C1 | 40.2 | 40.3 | 40.7 | 41.2 | 42.9 | 45.1 | 52.9 | 62.3 |
| D1 | 45.0 | 45.12 | 45.7 | 46.0 | 46.8 | 47.2 | 50.0 | 52.0 |
| E1 | 49.5 | 49.5 | 49.67 | 49.78 | 52.0 | 53.8 | 58.6 | 62.5 |
| F1 | 54.5 | 54.6 | 54.7 | 54.8 | 55.0 | 55.3 | 56.8 | 58.7 |

TABLE 5

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A1 | ○ ~● | ○ ~ ● | ○ ~ ● | ⊙ ~ ○ | ⊙ | ⊙ | ⊙ | ⊙ ~ ○ |
| B1 | ○ | ○ | ○ | ○ | ○ | ⊙ ~ ○ | ⊙ | ⊙ |
| C1 | ⊙ | ⊙ | ⊙ | ⊙ | ⊙ | ⊙ | ⊙ | ⊙ ~ ○ |
| D1 | ⊙ | ⊙ | ⊙ | ⊙ | ⊙ | ⊙ | ⊙ | ⊙ |
| E1 | ⊙ | ⊙ | ⊙ | ⊙ | ⊙ | ⊙ | ⊙ | ○ |
| F1 | ⊙ | ⊙ | ⊙ | ⊙ | ⊙ | ⊙ | ⊙ | ⊙ |

TABLE 6

Stability of Cleaning Feastibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A1 | — | ⊙ | ⊙ | ⊙ | ⊙ | ⊙ | ⊙ ~ ○ | ○ ~ ● |
| B1 | — | ⊙ | ⊙ | ⊙ | ⊙ | ⊙ | ⊙ | ⊙ ~ ○ |
| C1 | — | ⊙ | ⊙ | ⊙ | ⊙ | ⊙ | ⊙ | ○ |
| D1 | — | ⊙ | ⊙ | ⊙ | ⊙ | ⊙ | ⊙ | ⊙ |
| E1 | — | ⊙ | ⊙ | ⊙ | ⊙ | ⊙ | ⊙ | ⊙ |
| F1 | — | ⊙ | ⊙ | ⊙ | ⊙ | ⊙ | ⊙ | ⊙ |

TABLE 7

| | Charge-injection impeding layer | Photo-conductive layer | Surface layer |
|---|---|---|---|
| Content and flow rate of gases | | | |
| $SiH_4$[SCCM] | 150 | 200 | |
| $SiF_4$[SCCM] | 5 | 3 | |

TABLE 7-continued

| | Charge-injection impeding layer | Photo-conductive layer | Surface layer |
|---|---|---|---|
| $H_2$[SCCM] | 500 | 800 | 450 |
| $B_2H_6$[PPM] (vs. $SiH_4$) | 1500 | 3 | |
| NO[SCCM] | 10 | | |
| $CH_4$[SCCM] | 5 | | 0→200→200 |
| Temperature of substrate [° C.] | 300 | 300 | 250 |
| Internal pressure [Pa] | 4 | 1.3 | 2.7 |
| Power [W] | 200 | 600 | 800 |
| Film thickness [μm] | 2 | 30 | 0.5 |

TABLE 8

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A2 | 32.9 | 32.9 | 33.5 | 35.6 | 37.1 | 39.1 | 49.1 | 58.1 |
| B2 | 35.0 | 35.1 | 35.7 | 35.8 | 36.0 | 38.5 | 44.7 | 52.1 |
| C2 | 41.2 | 41.2 | 41.3 | 41.5 | 42.0 | 42.5 | 46.8 | 50.8 |
| D2 | 45.1 | 45.1 | 45.4 | 45.9 | 46.0 | 47.2 | 51.0 | 56.1 |
| E2 | 50.2 | 503 | 50.5 | 51.7 | 53.1 | 54.7 | 58.7 | 64.0 |
| F2 | 53.0 | 53.2 | 53.7 | 54.8 | 56.2 | 57.0 | 58.2 | 58.7 |

TABLE 9

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A2 | ○(~●) | ○(~●) | ○(~●) | ○ | ◎ | ◎ | ◎ | ◎ |
| B2 | ○ | ○ | ○ | ○ | ○ | ◎~○ | ◎ | ◎ |
| C2 | ◎ | ◎ | ◎ | ◎ | ◎ | ◎ | ◎ | ◎ |
| D2 | ◎ | ◎ | ◎ | ◎ | ◎ | ◎ | ◎ | ◎ |
| E2 | ◎ | ◎ | ◎ | ◎ | ◎ | ◎ | ◎ | ○ |
| F2 | ◎ | ◎ | ◎ | ◎ | ◎ | ◎ | ◎ | ◎ |

TABLE 10

Stability of Cleaning Feastibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A2 | — | ◎ | ◎ | ◎ | ◎ | ◎ | ◎~○ | ○(~●) |
| B2 | — | ◎ | ◎ | ◎ | ◎ | ◎ | ◎ | ◎~○ |
| C2 | — | ◎ | ◎ | ◎ | ◎ | ◎ | ◎ | ○ |
| D2 | — | ◎ | ◎ | ◎ | ◎ | ◎ | ◎ | ◎ |
| E2 | — | ◎ | ◎ | ◎ | ◎ | ◎ | ◎ | ◎ |
| F2 | — | ◎ | ◎ | ◎ | ◎ | ◎ | ◎ | ◎ |

TABLE 11

| | Charge-injection impeding layer | Photo-conductive layer | Surface layer |
|---|---|---|---|
| Content and flow rate of gases | | | |
| $SiH_4$[SCCM] | 150 | 200 | |
| $SiF_4$[SCCM] | 5 | 3 | |
| $H_2$[SCCM] | 500 | 800 | 450 |
| $B_2H_6$[PPM] (vs. $SiH_4$) | 1500 | 3 | |
| NO[SCCM] | 10 | | |
| $CH_4$[SCCM] | 5 | | 0→50→30 |
| $CF_4$[SCCM] | | | 0→100→170 |
| Temperature of substrate [° C.] | 300 | 300 | 250 |
| Internal pressure [Pa] | 4 | 1.3 | 2.7 |
| Power [W] | 200 | 600 | 800 |
| Film thickness [μm] | 2 | 30 | 0.5 |

TABLE 12

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A3 | 35.1 | 35.1 | 36.2 | 36.5 | 36.7 | 37.3 | 40.1 | 43.6 |
| B3 | 35.5 | 35.6 | 36.4 | 37.7 | 38.2 | 39.1 | 42.3 | 50.1 |
| C3 | 35.7 | 35.8 | 36.0 | 36.8 | 37.5 | 38.0 | 42.5 | 52.6 |
| D3 | 45.6 | 45.7 | 45.8 | 45.9 | 46.5 | 47.0 | 50.8 | 55.0 |
| E3 | 48.2 | 48.3 | 49.6 | 51.0 | 52.0 | 55.0 | 58.0 | 61.9 |
| F3 | 48.5 | 48.6 | 49.1 | 49.3 | 49.6 | 50.3 | 50.8 | 51.0 |

TABLE 13

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A3 | ○ | ○ | ○ | ○ | ○ | ○ | ◎ | ◎ |
| B3 | ○ | ○ | ○ | ◎~○ | ◎~○ | ◎~○ | ◎ | ◎ |
| C3 | ○ | ○ | ○ | ○ | ◎~○ | ◎~○ | ◎ | ◎ |
| D3 | ◎ | ◎ | ◎ | ◎ | ◎ | ◎ | ◎ | ◎ |
| E3 | ◎ | ◎ | ◎ | ◎ | ◎ | ◎ | ◎ | ◎~○ |
| F3 | ◎ | ◎ | ◎ | ◎ | ◎ | ◎ | ◎ | ◎ |

TABLE 14

Stability of Cleaning Feastibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A3 | — | ◎ | ◎ | ◎ | ◎ | ◎ | ◎ | ◎ |
| B3 | — | ◎ | ◎ | ◎ | ◎ | ◎ | ◎ | ◎~○ |
| C3 | — | ◎ | ◎ | ◎ | ◎ | ◎ | ◎ | ◎ |
| D3 | — | ◎ | ◎ | ◎ | ◎ | ◎ | ◎ | ◎ |
| E3 | — | ◎ | ◎ | ◎ | ◎ | ◎ | ◎ | ◎ |

TABLE 15

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A4 | 60.0 | 62.5 | 62.7 | 62.7 | 62.7 | 62.7 | 62.7 | 62.7 |
| B4 | 58.4 | 59.6 | 59.7 | 60.0 | 60.0 | 60.0 | 60.0 | 60.0 |
| C4 | 48.6 | 49.8 | 50.1 | 50.2 | 50.1 | 50.1 | 50.1 | 50.1 |
| D4 | 63.4 | 63.0 | 63.0 | 62.8 | 62.8 | 62.7 | 62.8 | 62.8 |
| E4 | 43.5 | 44.6 | 45.0 | 45.1 | 44.8 | 45.0 | 45.0 | 44.9 |
| F4 | 41.3 | 42.5 | 43.0 | 42.9 | 42.9 | 42.9 | 42.9 | 42.8 |

TABLE 16

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A4 | ◎ | ◎~○ | ○ | ○ | ○ | ○ | ○ | ○ |
| B4 | ◎ | ◎ | ◎ | ◎ | ◎ | ◎ | ◎ | ◎ |
| C4 | ◎ | ◎ | ◎ | ◎ | ◎ | ◎ | ◎ | ◎ |
| D4 | ○ | ○ | ○ | ○ | ○ | ○ | ○ | ○ |
| E4 | ◎ | ◎ | ◎ | ◎ | ◎ | ◎ | ◎ | ◎ |
| F4 | ◎ | ◎ | ◎ | ◎ | ◎ | ◎ | ◎ | ◎ |

TABLE 17

Stability of Cleaning Feastibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A4 | — | ◎ | ◎ | ◎ | ◎ | ◎ | ◎ | ◎ |
| B4 | — | ◎ | ◎ | ◎ | ◎ | ◎ | ◎ | ◎ |
| C4 | — | ◎ | ◎ | ◎ | ◎ | ◎ | ◎ | ◎ |
| D4 | — | ◎ | ◎ | ◎ | ◎ | ◎ | ◎ | ◎ |
| E4 | — | ◎ | ◎ | ◎ | ◎ | ◎ | ◎ | ◎ |
| F4 | — | ◎ | ◎ | ◎ | ◎ | ◎ | ◎ | ◎ |

TABLE 18

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A5 | 35.1 | 35.6 | 35.6 | 35.6 | 35.6 | 35.6 | 35.6 | 35.6 |
| B5 | 48.4 | 49.6 | 49.7 | 49.7 | 49.7 | 49.7 | 49.7 | 49.7 |
| C5 | 44.6 | 45.6 | 45.6 | 45.6 | 45.6 | 45.6 | 45.6 | 45.6 |
| D5 | 50.5 | 52.1 | 52.3 | 52.2 | 52.2 | 52.1 | 52.2 | 52.2 |
| E5 | 43.5 | 46.5 | 47.5 | 47.6 | 47.5 | 47.6 | 47.6 | 47.6 |
| F5 | 54.2 | 53.1 | 53.0 | 52.9 | 53.0 | 53.1 | 53.1 | 53.1 |

TABLE 19

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A5 | ○ | ○ | ○ | ○ | ○ | ○ | ○ | ○ |
| B5 | ◎ | ◎ | ◎ | ◎ | ◎ | ◎ | ◎ | ◎ |
| C5 | ◎ | ◎ | ◎ | ◎ | ◎ | ◎ | ◎ | ◎ |
| D5 | ◎ | ◎ | ◎ | ◎ | ◎ | ◎ | ◎ | ◎ |
| E5 | ◎ | ◎ | ◎ | ◎ | ◎ | ◎ | ◎ | ◎ |
| F5 | ◎ | ◎ | ◎ | ◎ | ◎ | ◎ | ◎ | ◎ |

TABLE 20

Stability of Cleaning Feasibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| A5 | — | ◎ | ◎ | ◎ | ◎ | ◎ | ◎ | ◎ |
| B5 | — | ◎ | ◎ | ◎ | ◎ | ◎ | ◎ | ◎ |
| C5 | — | ◎ | ◎ | ◎ | ◎ | ◎ | ◎ | ◎ |
| D5 | — | ◎ | ◎ | ◎ | ◎ | ◎ | ◎ | ◎ |
| E5 | — | ◎ | ◎ | ◎ | ◎ | ◎ | ◎ | ◎ |
| F5 | — | ◎ | ◎ | ◎ | ◎ | ◎ | ◎ | ◎ |

TABLE 21

Surface Free Energy of Photosensitive Members (γ)[mN/m]

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| G1 | 50.0 | 50.2 | 50.5 | 55.9 | 58.9 | 63.0 | 68.0 | 74.0 |
| H1 | 42.2 | 42.3 | 45.0 | 50.2 | 52.6 | 57.5 | 64.2 | 68.9 |
| I1 | 35.6 | 35.7 | 36.8 | 39.0 | 42.0 | 45.6 | 57.5 | 68.9 |
| J1 | 30.2 | 31.8 | 35.1 | 37.8 | 41.3 | 44.6 | 55.9 | 72.5 |

TABLE 22

Result of Durability Evaluation

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| G1 | ◎ | ◎ | ◎ | ◎ | ◎ | ○ | ● | ● |
| H1 | ◎ | ◎ | ◎ | ◎ | ◎ | ◎ | ○ | ● |
| I1 | ○~● | ◎ | ◎ | ◎ | ◎ | ◎ | ◎ | ● |
| J1 | ● | ● | ○ | ◎~○ | ◎ | ◎ | ◎ | ● |

TABLE 23

Stability of Cleaning Feasibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| G1 | — | ◎ | ◎ | ◎ | ◎ | ◎ | ◎ | ◎ |
| H1 | — | ◎ | ◎ | ◎ | ◎ | ◎~○ | ○ | ● |

TABLE 23-continued

Stability of Cleaning Feasibility

| Photo-sensitive member | Running number of Sheets in durability test | | | | | | | |
|---|---|---|---|---|---|---|---|---|
| | initial | 10 k | 20 k | 50 k | 100 k | 200 k | 500 k | 1000 k |
| I1 | — | ◎ | ◎ | ◎ | ◎ | ◎ | ○ | ○~● |
| J1 | — | ◎ | ◎ | ◎ | ◎ | ◎~○ | ○~● | ● |

TABLE 24

Surface Free Energy of Photosensitive Members (γ)[mN/m]

| Photo-sensitive member | Running number of Sheets in durability test | | | | | | | |
|---|---|---|---|---|---|---|---|---|
| | initial | 1 k | 2 k | 5 k | 10 k | 12 k | 15 k | 20 k |
| G2 | 30.5 | 30.6 | 28.0 | 25.6 | 25.6 | 25.6 | 25.6 | 25.6 |
| H2 | 25.0 | 25.2 | 25.6 | 35.6 | 40.2 | 45.5 | 49.2 | 60.8 |
| I2 | 20.5 | 22.0 | 24.0 | 27.4 | 31.5 | 33.6 | 38.25 | 45.9 |

TABLE 25

Result of Durability Evaluation

| Photo-sensitive member | Running number of Sheets in durability test | | | | | | | |
|---|---|---|---|---|---|---|---|---|
| | initial | 1 k | 2 k | 5 k | 10 k | 12 k | 15 k | 20 k |
| G2 | ● | ● | ● | ● | ● | ● | ● | ● |
| H2 | ● | ● | ● | ● | ◎ | ◎ | ◎ | ◎~○ |
| I2 | ● | ● | ● | ● | ● | ○~● | ◎~○ | ◎ |

TABLE 26

Stability of Cleaning Feasibility

| Photo-sensitive member | Running number of Sheets in durability test | | | | | | | |
|---|---|---|---|---|---|---|---|---|
| | initial | 1 k | 2 k | 5 k | 10 k | 12 k | 15 k | 20 k |
| G2 | — | ◎ | ◎ | ◎ | ◎ | ◎ | ◎ | ◎ |
| H2 | — | ○~● | ○~● | ○~● | ○~● | ○~● | ○~● | ○~● |
| I2 | — | ○~● | ○~● | ○~● | ○~● | ○~● | ○~● | ○~● |

What is claimed is:

1. A photosensitive member to be used for an image-forming apparatus adapted to repeatedly form an image by the following image-forming process comprising steps of:

forming a latent image by electrostatically charging the photosensitive member and exposing it to light;

forming a toner image;

transferring the toner image onto transfer medium; and cleaning the surface of the photosensitive member to remove foreign matters therefrom;

the surface free energy (γ) derived from the Forke's extension theory on the uppermost surface of the photosensitive member being between 35 and 65 mN/m.

2. A photosensitive member to be used for an image-forming apparatus according to claim 1, wherein the surface free energy (γ) on the uppermost surface of the photosensitive member being between 40 and 60 mN/m.

3. A photosensitive member to be used for an image-forming apparatus according to claim 1, wherein the surface free energy (γ) of an photosensitive member can be derived from the Forkes's extension theory.

4. A photosensitive member to be used for an image-forming apparatus according to claim 1, wherein the variation of the surface free energy is less than 25 mN/m.

5. A photosensitive member to be used for an image-forming apparatus according to claim 1, wherein the variation of the surface free energy γ by use is less than 15 mN/m.

6. A photosensitive member to be used for an image-forming apparatus according to claim 1, further comprising (a) an electroconductive substrate; and (b) a light-receiving member made of an amorphous material containing silicon as primary component and containing hydrogen atoms and halogen atoms; the resistivity of the uppermost surface being between $1\times10^{10}$ and $5\times10^{15}$ Ω·cm.

7. A photosensitive member to be used for an image-forming apparatus according to claim 6, wherein the surface layer includes at least a region mainly made of amorphous silicon carbide.

8. A photosensitive member to be used for an image-forming apparatus according to claim 6, wherein the surface layer includes at least a region mainly made of amorphous carbon.

9. A photosensitive member to be used for an image-forming apparatus according to claim 8, wherein said amorphous carbon contains fluorine.

10. A photosensitive member to be used for an image-forming apparatus according to claim 8, wherein said fluorine is bonded to carbon atoms.

11. A photosensitive member to be used for an image-forming apparatus according to claim 1, further comprising a photoconductive layer principally made of an organic photosensitive material.

12. A photosensitive member to be used for an image-forming apparatus according to claim 11, wherein said uppermost surface region includes a region containing fluorine.

13. A photosensitive member to be used for an image-forming apparatus according to claim 1, wherein said foreign matters include toner.

14. An image-forming apparatus comprising:

a photosensitive member to be used for forming an image-forming apparatus as defined in claim 1;

a charging means for electrically charging the surface of the photosensitive member;

an exposure means for forming a latent image on the surface of the photosensitive member;

a developing means for forming a toner image corresponding to the latent image; and a cleaning means for cleaning unnecessary toner from the surface of the photosensitive member.

15. A photosensitive member to be used for an image-forming apparatus adapted to repeatedly form an image by the following image-forming process comprising steps of:

forming a latent image by electrostatically charging the photosensitive member and exposing it to light;

forming a toner image;

transferring the toner image onto transfer paper; and cleaning the surface of the photosensitive member to remove foreign matters therefrom;

the variation of the surface free energy $\Delta\gamma$ being in less than 25 mN/m, wherein the surface free energy ($\gamma$) of a photosensitive member is derived from the Forke's extension theory.

16. A photosensitive member to be used for an image-forming apparatus according to claim 15, wherein the variation of the surface free energy $\Delta\gamma$ is in less than 15 mN/m.

17. A photosensitive member to be used for an image-forming apparatus according to claim 15, wherein the surface free energy ($\gamma$) of an photosensitive member can be derived from the Forkes's extension theory.

18. A photosensitive member to be used for an image-forming apparatus according to claim 15, further comprising:

(a) an electroconductive substrate; and (b) a light-receiving member made of an amorphous material containing silicon as primary component and containing hydrogen atoms and halogen atoms; the resistivity of the uppermost surface being between $1\times10^{10}$ and $5\times10^{15}$ $\Omega\cdot$cm.

19. A photosensitive member to be used for an image-forming apparatus according to claim 18, wherein the surface layer includes at least a region mainly made of amorphous silicon carbide.

20. A photosensitive member to be used for an image-forming apparatus according to claim 18, wherein the surface layer includes at least a region mainly made of amorphous carbon.

21. A photosensitive member to be used for an image-forming apparatus according to claim 20, wherein said amorphous carbon contains fluorine.

22. A photosensitive member to be used for an image-forming apparatus according to claim 20, wherein said fluorine is bonded to carbon atoms.

23. A photosensitive member to be used for an image-forming apparatus according to claim 15, further comprising a photoconductive layer principally made of an organic photosensitive material.

24. A photosensitive member to be used for an image-forming apparatus according to claim 23, wherein said uppermost surface region includes a region containing fluorine.

25. A photosensitive member to be used for an image-forming apparatus according to claim 15, wherein said foreign matters are toner.

26. An image-forming apparatus comprising:

a photosensitive member to be used for forming an image-forming apparatus as defined in claim 15; a charging means for electrically charging the surface of the photosensitive member;

an exposure means for forming a latent image on the surface of the photosensitive member;

a developing means for forming a toner image corresponding to the latent image; and a cleaning means for cleaning unnecessary toner from the surface of the photosensitive member.

* * * * *

UNITED STATES PATENT AND TRADEMARK OFFICE

CERTIFICATE OF CORRECTION

PATENT NO. : 6,171,742 B1
DATED : January 9, 2001
INVENTOR(S) : Masaya Kawada et al.

It is certified that error appears in the above-identified patent and that said Letters Patent is hereby corrected as shown below:

Column 12,
Line 6, "of" should read be deleted (first occurrence).

Column 14,
Line 36, "a" should be deleted.

Column 20,
Line 24, "typicality" should read -- typically --.

Column 21,
Line 61, "a." should read -- a --.

Column 24,
Line 18, "as." should read -- as --.

Column 28,
Line 34, "compornent" should read -- component --;
Line 36, "and." should read -- and --.

Column 29,
Line 45, "an." should read -- an --.

Column 30,
Line 21, "80" should read -- φ80 --;
Line 52, "end" should read -- and --;
Line 66, "their between" should read -- therebetween --.

Column 37,
Line 51, ""574":" shodul read -- "●": --.

Column 39,
Line 32, "head" should read -- hard --.

UNITED STATES PATENT AND TRADEMARK OFFICE

CERTIFICATE OF CORRECTION

PATENT NO. : 6,171,742 B1
DATED : January 9, 2001
INVENTOR(S) : Masaya Kawada et al.

It is certified that error appears in the above-identified patent and that said Letters Patent is hereby corrected as shown below:

Column 43,
Table 3, "[pm]" should read -- [$\mu$m] --.

Column 44,
Table 4, "[pm]" should read -- [$\mu$m] --;
Table 5, "○~ ○~" should read -- ○~● ○~● --.
● ●

Column 45,
Table 8, "503" should read -- 50.3 --;
Table 9, "○(~ ○(~" should read -- ○(~● ○(~● --.
● ●

Column 46,
Table 14, should read --

| Photo-sensitive member | Running number of sheets in durability test | | | | | | | |
|---|---|---|---|---|---|---|---|---|
| | initial | 10k | 20k | 50k | 100k | 200k | 500k | 1000k |
| A3 | — | ◎ | ◎ | ◎ | ◎ | ◎ | ◎ | ◎ |
| B3 | — | ◎ | ◎ | ◎ | ◎ | ◎ | ◎ | ◎ |
| C3 | — | ◎ | ◎ | ◎ | ◎ | ◎ | ◎ | ◎~○ |
| D3 | — | ◎ | ◎ | ◎ | ◎ | ◎ | ◎ | ◎ |
| E3 | — | ◎ | ◎ | ◎ | ◎ | ◎ | ◎ | ◎ |
| F3 | — | ◎ | ◎ | ◎ | ◎ | ◎ | ◎ | ◎ |

--.

Column 49,
Line 57, "transfer" should read -- a transfer --;
Line 61, "Forke's" should read -- Forkes's --.

Column 50,
Line 3, "an" should read -- a --.

UNITED STATES PATENT AND TRADEMARK OFFICE

CERTIFICATE OF CORRECTION

PATENT NO. : 6,171,742 B1
DATED : January 9, 2001
INVENTOR(S) : Masaya Kawada et al.

It is certified that error appears in the above-identified patent and that said Letters Patent is hereby corrected as shown below:

Column 51,
Lines 11 and 17, "in" should be deleted;
Line 13, "Forke's" should read -- Forkes's --;
Line 20, "an" should read -- a --.

Column 52,
Line 24, "a" should read -- ¶ a --.

Signed and Sealed this

Eighteenth Day of June, 2002

*Attest:*

*Attesting Officer*

JAMES E. ROGAN
*Director of the United States Patent and Trademark Office*